US011214955B2

(12) United States Patent
Joyce

(10) Patent No.: US 11,214,955 B2
(45) Date of Patent: Jan. 4, 2022

(54) BUILDING CONSTRUCTION

(71) Applicant: J & S JOYCE PTY LTD, Lawson (AU)

(72) Inventor: Joseph Nelson Joyce, Lawson (AU)

(73) Assignee: J & S JOYCE PTY LTD, Lawson (AU)

( * ) Notice: Subject to any disclaimer, the term of this patent is extended or adjusted under 35 U.S.C. 154(b) by 0 days.

(21) Appl. No.: 16/649,181

(22) PCT Filed: Sep. 24, 2018

(86) PCT No.: PCT/AU2018/000182
§ 371 (c)(1),
(2) Date: Mar. 20, 2020

(87) PCT Pub. No.: WO2019/056045
PCT Pub. Date: Mar. 28, 2019

(65) Prior Publication Data

US 2020/0217061 A1 Jul. 9, 2020

(30) Foreign Application Priority Data

Sep. 23, 2017 (AU) ..... 2017908376
Dec. 22, 2017 (AU) ..... 2017101799

(51) Int. Cl.
*E04B 1/24* (2006.01)
*E04B 5/14* (2006.01)
(Continued)

(52) U.S. Cl.
CPC ..... *E04B 1/2403* (2013.01); *E04B 5/14* (2013.01); *E04B 7/20* (2013.01); *E04C 3/08* (2013.01);
(Continued)

(58) Field of Classification Search
CPC . E04B 1/2403; E04B 5/14; E04B 7/20; E04B 2001/2415; E04B 2001/2451;
(Continued)

(56) References Cited

U.S. PATENT DOCUMENTS 2,675,895 A * 4/1954 Loewenstein ..... E04B 1/24 52/236.3
4,227,358 A * 10/1980 Gat ..... E04B 1/26 52/650.1
(Continued)

FOREIGN PATENT DOCUMENTS

WO 2016081974 A1 6/2016

OTHER PUBLICATIONS

International Search Report and Written Opinion of International Search Authority for International Application No. PCT/AU2018/000182.

*Primary Examiner* — Rodney Mintz
(74) *Attorney, Agent, or Firm* — JCIP; Joseph G. Chu; Jeremy I. Maynard

(57) ABSTRACT

A modular perimeter frame system (10) is described for forming a perimeter frame (11) used in the construction of floors, walls and roofs of buildings. The modular perimeter frame system has a first modular sub-frame (16) having one or two blunt end portions (26, 28), and a second modular sub-frame (18) having one or two overhang end portions (36, 38). The blunt and overhang end portions are so dimensioned and shaped as to facilitate a continuous abutting engagement between at least two surfaces which meet at a corner of the blunt end portion and at least two surfaces which meet at a corner of the overhang end portion.

9 Claims, 60 Drawing Sheets

(51) Int. Cl.
*E04B 7/20* (2006.01)
*E04C 3/08* (2006.01)

(52) U.S. Cl.
CPC . *E04B 2001/249* (2013.01); *E04B 2001/2415* (2013.01); *E04B 2001/2451* (2013.01); *E04B 2001/2472* (2013.01)

(58) Field of Classification Search
CPC ..... E04B 2001/249; E04B 2001/2472; E04B 2001/0092; E04B 1/24; E04B 7/026; E04C 3/08
See application file for complete search history.

(56) References Cited

U.S. PATENT DOCUMENTS

| | | | | |
|---|---|---|---|---|
| 4,435,928 | A | 3/1984 | Huling | |
| 6,609,336 | B2 | 8/2003 | Matsubara | |
| 8,291,675 | B2 * | 10/2012 | Tikhovskiy | E04B 5/28 52/742.14 |
| 8,966,855 | B1 * | 3/2015 | Miller | E04B 5/14 52/650.3 |
| 10,246,868 | B2 * | 4/2019 | Pridham | E04D 13/12 |
| 10,704,253 | B1 * | 7/2020 | Houston | E04B 1/3511 |
| 2002/0059756 | A1 * | 5/2002 | Matsubara | E04C 3/16 52/79.12 |
| 2004/0134152 | A1 | 7/2004 | Powell | |
| 2012/0131875 | A1 * | 5/2012 | Xu | E04B 1/24 52/650.1 |
| 2012/0167501 | A1 * | 7/2012 | Tikhovskiy | E04B 1/04 52/251 |
| 2017/0321413 | A1 * | 11/2017 | Pridham | E04F 15/02183 |

* cited by examiner

BUILDING CONSTRUCTION

TECHNICAL FIELD

The present invention relates to improvements in structural materials used for building construction.

In particular, the present invention relates to a modular perimeter frame system for forming a perimeter frame used in the construction of floors, walls and roofs of buildings.

BACKGROUND ART

Preassembled (or prefabricated) building frames, such as an entire wall frame, because of their large size, are normally difficult to transport and handle, especially when required to be located at a construction site where there is restricted access and space may be limited, thereby adding substantially to the construction costs. There is, therefore, a need for a modular perimeter frame system which will provide improvements over the aforementioned prior art.

SUMMARY OF INVENTION

According to the present invention, there is provided a modular perimeter frame system for forming a perimeter frame used in the construction of floors, walls and roofs of buildings, comprising:

(a) a first modular sub-frame having a blunt end portion, and (b) a second modular sub-frame having an overhang end portion, wherein the blunt and overhang end portions are so dimensioned and shaped as to facilitate a continuous abutting engagement between at least two surfaces which meet at a corner of the blunt end portion and at least two surfaces which meet at a corner of the overhang end portion.

According to another aspect of the present invention, there is provided a modular perimeter frame system for forming a perimeter frame used in the construction of floors, walls and roofs of buildings, comprising:

(a) a ladder sub-frame having a pair of parallel, spaced apart, ladder beam members interconnected by one or more ladder cross-beam members, the ladder beam members being symmetrically opposite each other, thereby forming a blunt end portion at each opposite end of the ladder sub-frame, a first of the ladder beam members being adapted to be located along an external perimeter of the perimeter frame and a second of the ladder beam members being adapted to be located along an internal perimeter of the perimeter frame, and (b) a top hat sub-frame having a pair of parallel, spaced apart, top hat beam members interconnected by one or more top hat cross-beam members, the top hat beam members being of a different length to each other and being symmetrically opposite each other, such that a first of the top hat beam members extends further in its length by a predetermined distance at each of its opposite ends than the length of a second of the top hat beam members, thereby forming an overhang end portion at each opposite end of the top hat sub-frame, the first of the top hat beam members being adapted to be located along an external perimeter of the perimeter frame and the second of the top hat beam members being adapted to be located along an internal perimeter of the perimeter frame, wherein the predetermined distance is substantially equal to a distance separating the first and second of the ladder beam members, wherein the perimeter frame is formed by locating two of the ladder sub-frames symmetrically opposite each other across a first axis, with the first of the ladder beam members of each ladder sub-frame being outermost, and by locating two of the top hat sub-frames symmetrically opposite each other across a second axis perpendicular to the first axis, with the first of the top hat beam members of each top hat sub-frame being outermost, and then by perpendicularly interconnecting the ladder and top hat sub-frames at their respective end portions.

Preferably, the second of the ladder beam members is an internal ladder beam member of the ladder sub-frame and has opposite ends which are separated by a length which is shorter than the length separating opposite ends of the first of the ladder beam members which is an external ladder beam member of the ladder sub-frame, the shorter length being substantially equal to the width of the overhang end portion of the top hat sub-frame.

In another preferred form, the external ladder beam member includes a corner socket at each of its opposite ends for receiving therethrough a corner post for supporting a wall.

According to another aspect of the present invention, there is provided a modular perimeter frame system for forming an enlarged perimeter frame used in the construction of floors, walls and roofs of buildings, comprising:

(a) the ladder sub-frame described above, (b) the top hat sub-frame described above, (c) a ladder link sub-frame, and (d) a top hat link sub-frame, wherein the enlarged perimeter frame is formed by perpendicularly interconnecting the ladder sub-frame and the top hat sub-frame at their respective end portions to define a corner of the enlarged perimeter frame, and by longitudinally connecting the ladder link sub-frame between respective blunt end portions of a pair of the ladder sub-frames, and by longitudinally connecting the top hat link sub-frame between respective overhang end portions of a pair of the top hat sub-frames.

Preferably, the ladder link sub-frame has a peg end portion at each opposite end thereof, and the top hat link sub-frame has an offset end portion at each opposite end thereof, and each peg end portion is securably engageable within an adjacent blunt end portion of a ladder sub-frame and each offset end portion is securably engageable alongside an adjacent overhang end portion of a top hat sub-frame.

There has been thus outlined, rather broadly, the more important features of the invention in order that the detailed description thereof that follows may be better understood and put into practical effect, and in order that the present contribution to the art may be better appreciated.

There are additional features of the invention that will be described hereinafter. It is important to appreciate, however, that the broad outline of the invention described above can be understood as embracing undisclosed equivalent features to the additional features described hereinafter, insofar as any such equivalent features do not depart from the spirit and scope of the present invention.

SUMMARY OF DRAWINGS

FIG. 49 is a perspective view of the three superior hip radial sub-frames shown in FIG. 48 about to be interconnected in a first step of a process for forming the hexagonally hipped roof frame of FIG. 45.

DETAILED DESCRIPTION OF THE INVENTION

In a broad form, the present invention provides a modular perimeter frame system for forming a perimeter frame used in the construction of floors, walls and roofs of buildings. The modular perimeter frame system has a first modular sub-frame having a blunt end portion, and a second modular sub-frame having an overhang end portion. The blunt and overhang end portions are so dimensioned and shaped as to facilitate a continuous abutting engagement between at least two surfaces which meet at a corner of the blunt end portion and at least two surfaces which meet at a corner of the overhang end portion.

Figure 3:
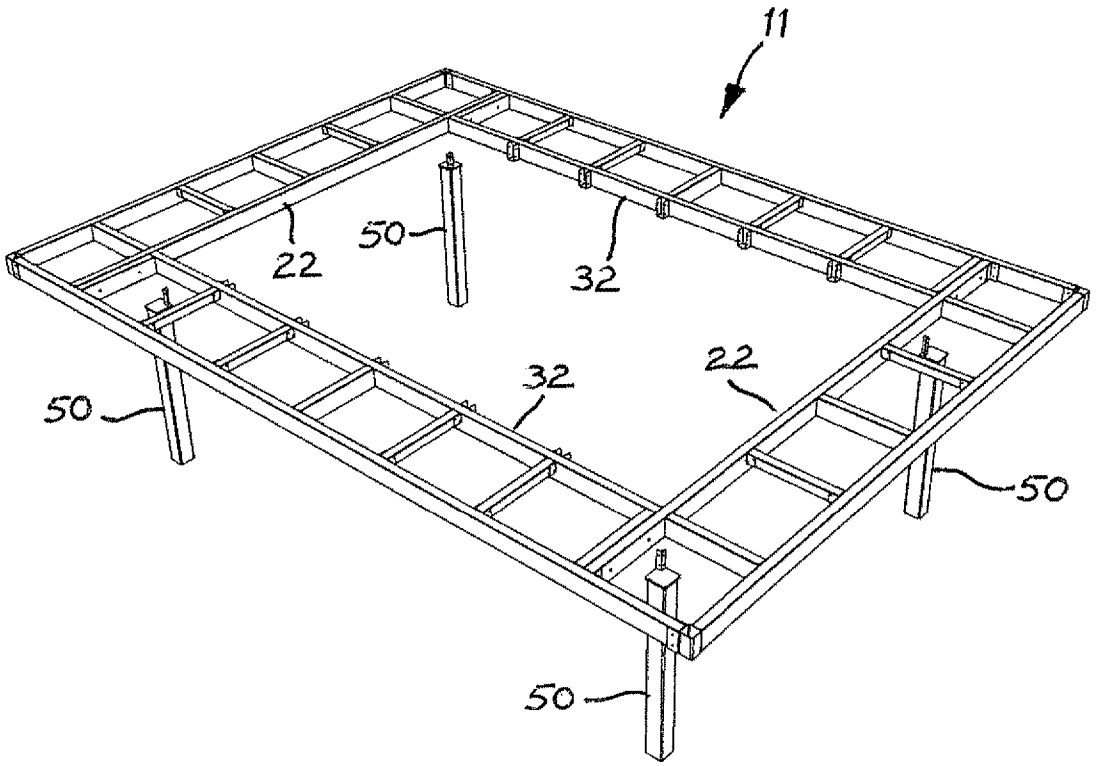
FIG. 3 is a perspective view of the perimeter frame shown in FIG. 2 about to be mounted on piers, as required for use of the perimeter frame in the construction of a floor.
Figure 4:
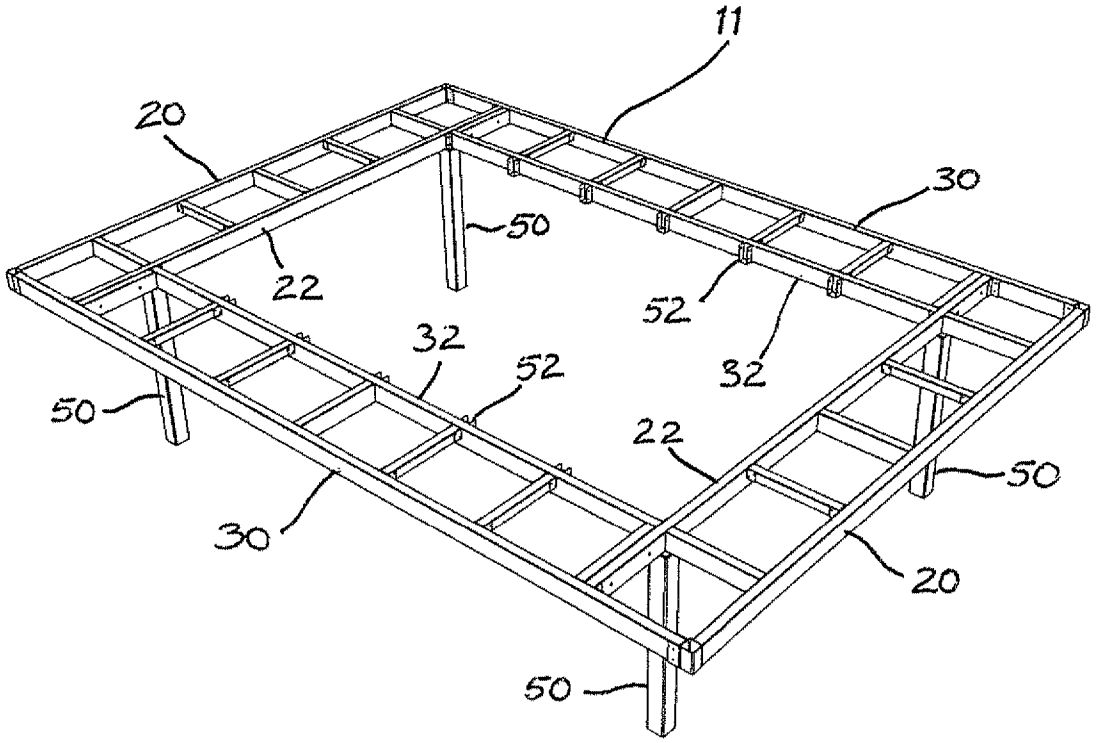
FIG. 4 is a perspective view of the perimeter frame shown in FIG. 2 mounted on piers.
Figure 5:
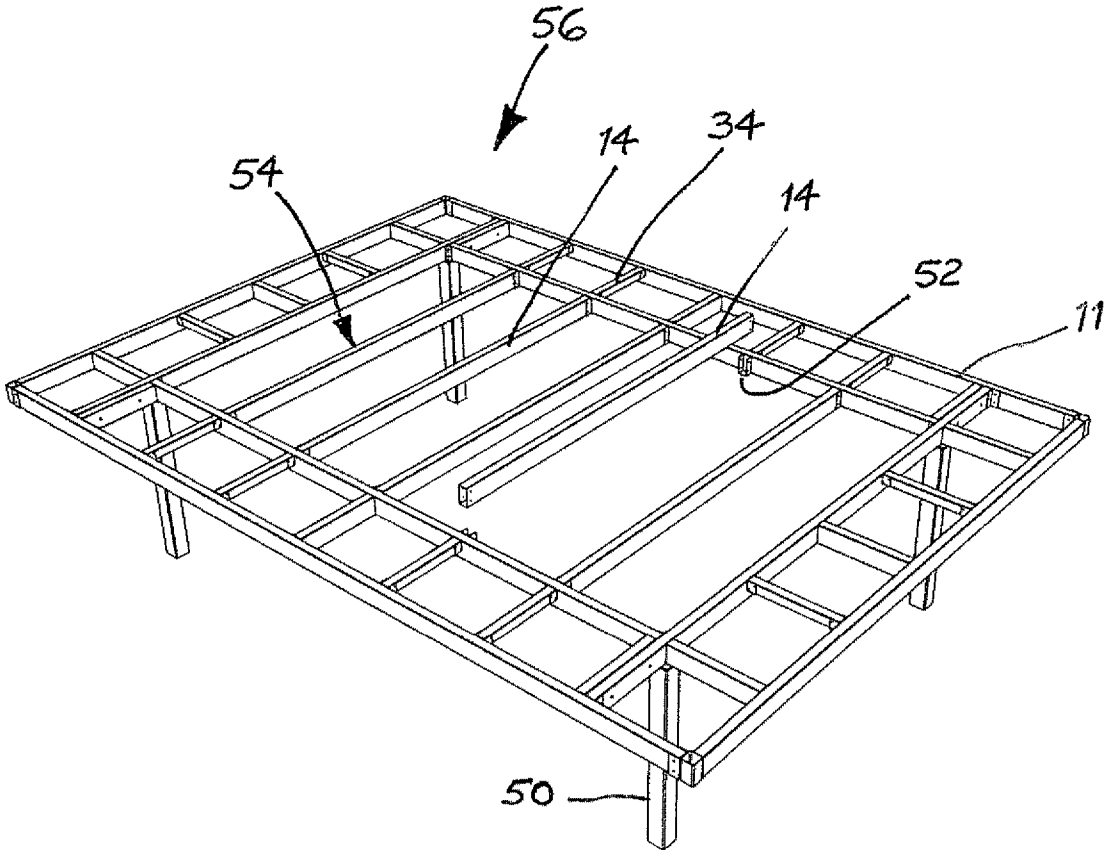
FIG. 5 is a perspective view of the perimeter frame and piers shown in FIG. 4, with floor joists (or inner frame members) shown connected, or about to be connected, to inner frame support brackets secured along the internal perimeter of the perimeter frame to form a floor frame mounted on the piers.
Figure 6:
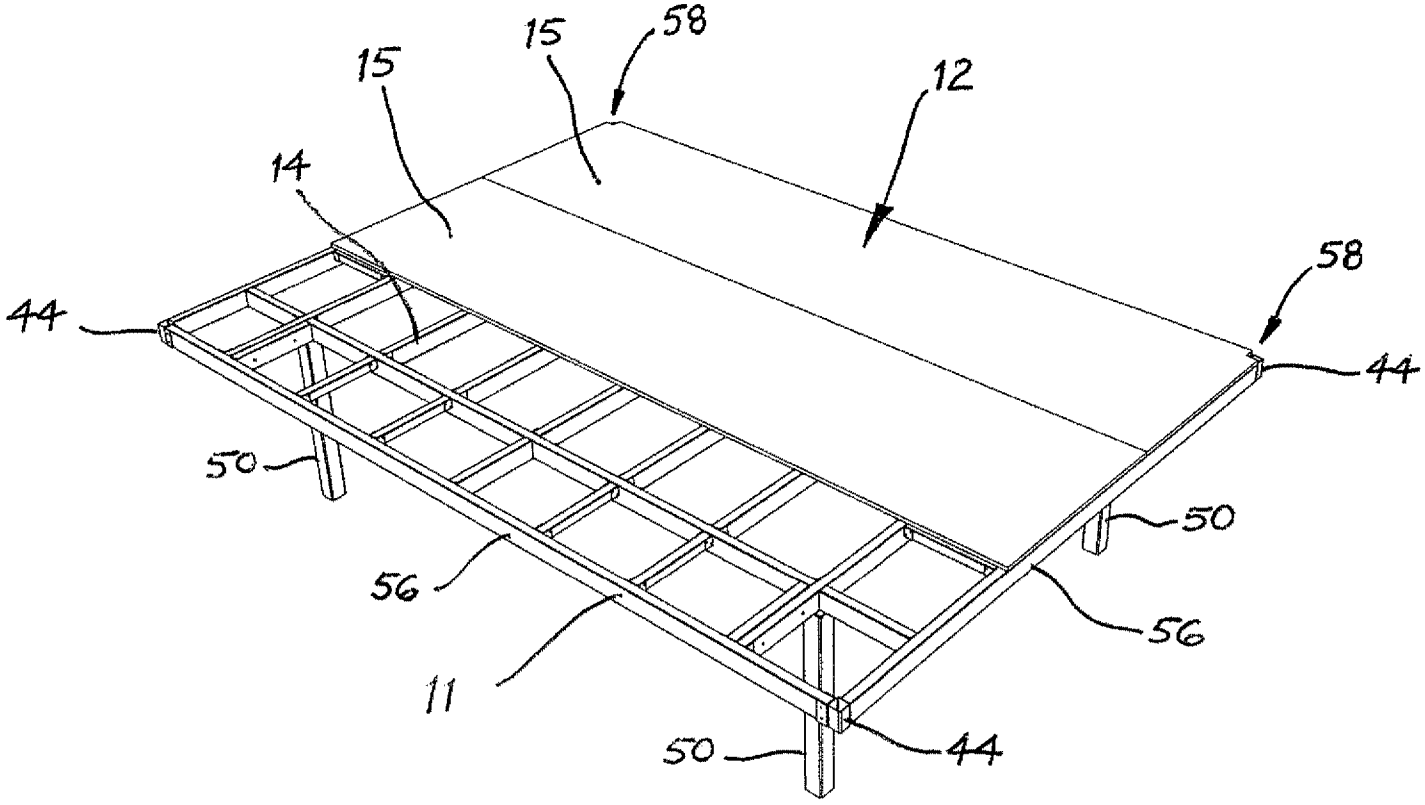
FIG. 6 is a perspective view of the floor frame and piers shown in FIG. 5, with sheet flooring shown supported on the floor frame to form a floor mounted on the piers.

More narrowly, an embodiment of the modular perimeter frame system 10 shown in the accompanying drawings of FIGS. 1 to 8 is for forming a perimeter frame 11 used in the construction of a floor 12 of a building, but it may alternatively be used in the construction of a wall or roof of a building, in which case the floor joists 14 shown in FIG. 5 are replaced by wall studs or rafters, respectively, and the sheet flooring 15 shown in FIG. 6 is replaced by wall cladding or roof cladding, respectively.

The modular perimeter frame system 10 includes two ladder sub-frames 16 and two top hat sub-frames 18 which are preassembled before they arrive at the site of construction. In this embodiment, the sub-frames 16, 18 are made predominantly of a suitable metal or metal alloy, but they may alternatively be made predominantly of timber or plastic of suitable strength.

Each ladder sub-frame 16 is formed of a pair of parallel, spaced apart, ladder beam members 20, 22 interconnected by a plurality of ladder cross-beam members 24. The ladder beam members 20, 22 are symmetrically opposite each other, and thereby form a blunt end portion 26, 28 at each opposite end of each ladder sub-frame 16.

The ladder beam member 20, to be referred hereinafter as the external ladder beam member 20, is adapted to be located along an external perimeter of the perimeter frame 11. The ladder beam member 22, to be referred to hereinafter as the internal ladder beam member 22, is adapted to be located along an internal perimeter of the perimeter frame 11. The external ladder beam member 20 is slightly longer than the internal ladder beam member 22 because the external ladder beam member 20 includes a square-section metal sleeve or corner socket 44 at each of its ends. Each corner socket 44 has substantially the same width as that of the rest of the external ladder beam member 20 so that both the innermost and outermost side surfaces of the external ladder beam member 20 are substantially planar along their respective entire lengths.

Each top hat sub-frame 18 is formed of a pair of parallel, spaced apart, top hat beam members 30, 32 interconnected by a plurality of top hat cross-beam members 34. The top hat beam members 30, 32 are of a substantially different length to each other and are symmetrically opposite each other, such that the top hat beam member 30, to be referred to hereinafter as the external top hat beam member 30, extends further in its length by a predetermined distance D1 at each of its opposite ends than the length L1 of the top hat beam member 32, to be referred to hereinafter as the internal top hat beam member 32. By this arrangement, there is formed an overhang end portion 36, 38 at each opposite end of each top hat sub-frame 18.

The external top hat beam member 30 is adapted to be located along an external perimeter of the perimeter frame 11. The internal top hat beam member 32 is adapted to be located along an internal perimeter of the perimeter frame 11.

Inner frame support brackets 52 are secured to each internal top hat beam member 32 at the positions as shown in FIGS. 1 to 4, ready to receive floor joists as shown in FIG. 5. If the perimeter frame 11 was to be used in the construction of a wall, the brackets 52 would suitably receive wall studs and/or window frames or door frames.

Figure 1:
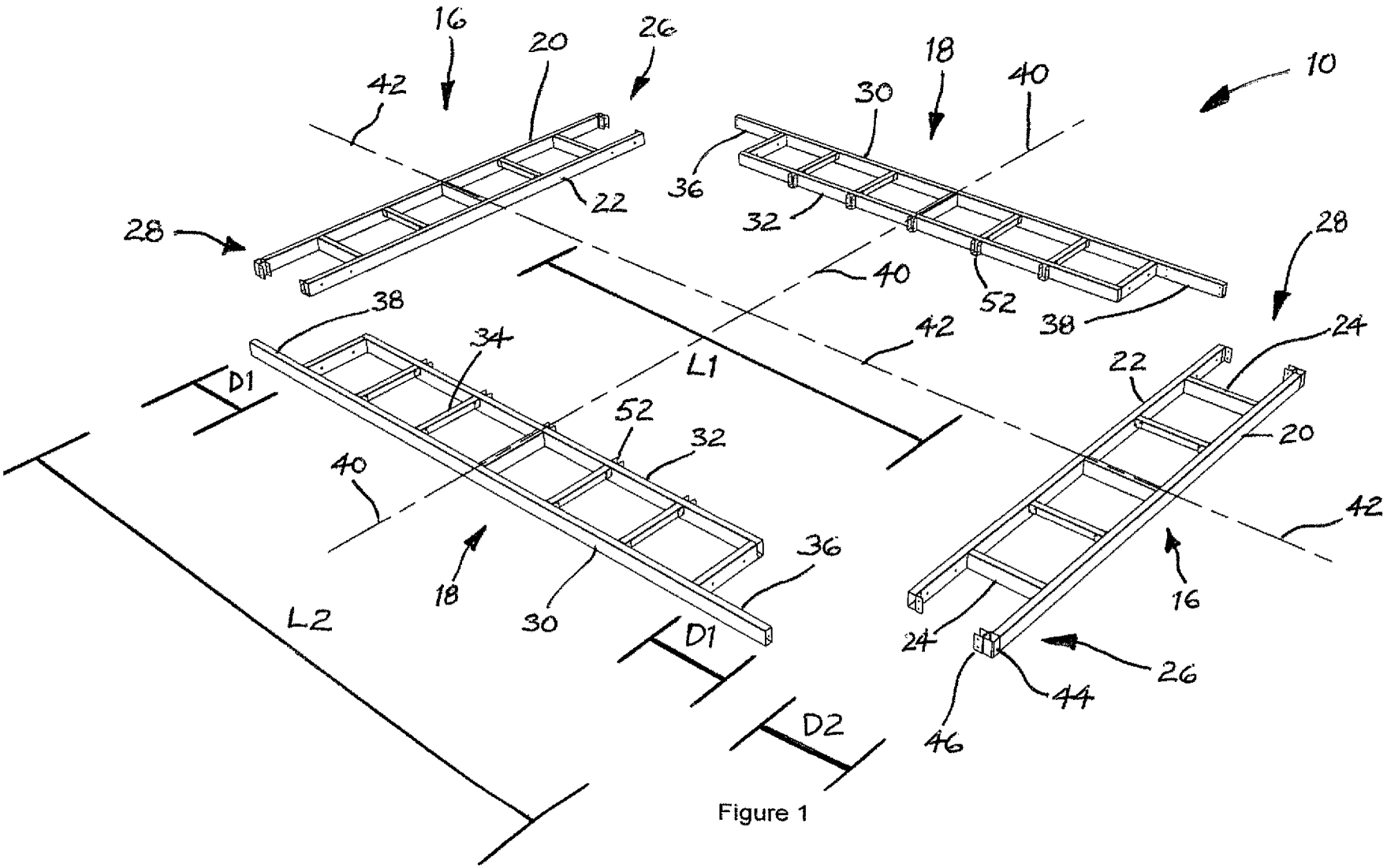
FIG. 1 is a perspective view of a first embodiment of a modular perimeter frame system according to the present invention, the system comprising a pair of ladder sub-frames and a pair of top hat sub-frames, located separately from each other and shown prior to being perpendicularly interconnected at their respective end portions to form a perimeter frame for use in the construction of a floor, wall and/or roof of a building.

The predetermined distance D1 by which the external top hat beam member 30 extends further in its length L2 at each of its opposite ends than the length L1 of the internal top hat beam member 32, and which defines the length of each overhang end portion 36, 38, is substantially equal to a distance D2 separating the innermost side surfaces of the external and internal ladder beam members 20, 22. As shown in FIG. 1, the distance D2 is the perpendicular distance between the innermost side surface of the square-section corner socket 44 and the innermost side surface of the internal ladder beam member 22. In an alternative embodiment where the corner socket 44 is not used, the distance D2 may be the perpendicular distance between the outermost side surface of the external ladder beam member 20 and the innermost side surface of the internal ladder beam member 22.

Figure 2:
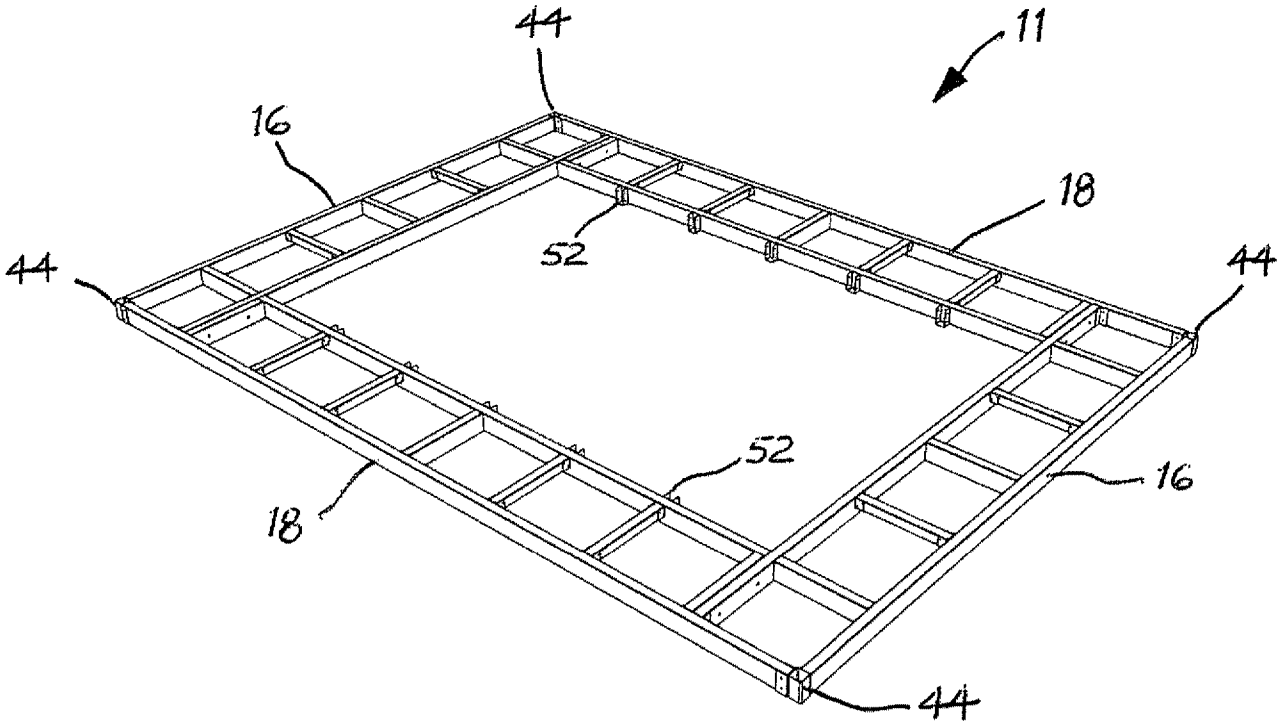
FIG. 2 is a perspective view of the perimeter frame formed by the interconnection of the sub-frames shown in FIG. 1.

The perimeter frame 11 is formed by locating the two ladder sub-frames 16 symmetrically opposite each other across a first axis 40, with the external ladder beam member 20 being outermost, and by locating the two top hat sub-frames 18 symmetrically opposite each other across a second axis 42 perpendicular to the first axis 40, with the external top hat beam member 30 being outermost, as shown in FIG. 1. The ladder sub-frames 16 and the top hat sub-frames 18 are then perpendicularly interconnected at their respective end portions. Specifically, the overhang end portion 36 of any one of the top hat sub-frames 18 is connected with a blunt end portion 26 of one of the ladder sub-frames 16 at a right angle, and the overhang end portion 38 of the same one of the top hat sub-frames 18 is connected with the blunt end portion 28 of the other one of the ladder sub-frames 16 at a right angle, as shown in FIG. 2. The connection of the blunt end portions 26 with the overhang end portions 36 may be achieved by any suitable means, such as by an arrangement of through-bolts and nuts.

In a preferred embodiment shown in the accompanying drawings of FIGS. 1 to 8, the internal ladder beam member 22 of the ladder sub-frame 16 has opposite ends which are separated by a length which is slightly shorter than the length separating the opposite ends of the external ladder beam member 20. That slightly shorter length is substantially equal to the horizontal thickness (or width) of an overhang end portion 36, 38 of a top hat sub-frame 18. The square-section metal sleeves or corner sockets 44 which were mentioned earlier are connected, such as by welding, in an upright direction to the opposite ends of each external ladder beam member 20 to form a corner region, and a U-shaped receiving bracket 46 is connected to each corner socket 44. The configuration of each bracket 46 is such that it receives therewithin a short length of the free end of the overhang end portion 36, 38 (as shown in FIG. 2) and Tek screws are used to secure the free end to the bracket 46. The configuration of each corner socket 44 is such that it can receive therethrough a corner post 48 (to be described later with respect to FIG. 7) for supporting a wall. In an alternative embodiment, the corner sockets 44 and brackets 46 may be omitted and, instead, the free end of the overhang end portion 36, 38 may extend to occupy the now unoccupied corner region, thereby preserving the square corner shape of the perimeter frame 11.

When formed with the modular perimeter frame system 10 in the manner described above, and with reference to FIGS. 1 and 2, the perimeter frame 11 can be used in the construction of a floor, wall or roof of a building.

In order to form a floor, the perimeter frame 11 shown in FIG. 2, is mounted on piers 50 or stumps. As shown in FIGS. 3 and 4, there are, in this instance, four square hollow section (SHS) piers, but the number and shape of piers may vary depending on the structure and weight bearing requirements of a floor. Each of the piers 50, which may have a fixed or adjustable head, is positioned such that its central axis is directly underneath a respective internal perimeter intersection of an internal ladder beam member 22 and an internal top hat beam member 32. Ideally, the perimeter frame 11 and the piers 50 are able to support the self-weight of the frame and, say, 19 mm particle board flooring, together with an applicable roof and wall load along the cantilevered external perimeter of the frame, and an applicable floor live load over the total area of the floor. Typically, the cross-sectional size of the piers will be 75 mm×75 mm, or 90 mm×90 mm, and they may be made of steel (suitably formed and/or treated) and have an appropriate thickness to suit their purpose.

FIG. 5 shows metal floor joists 14 connected, or being connected, to the inner frame support brackets 52 to create an inner frame 54 or in-fill to the perimeter frame. The joists 14 are, by virtue of the positions of the brackets 52, aligned with the top hat cross-beam members 34, to form a floor frame 56 mounted on the piers 50. Sheet flooring, such as particle board flooring 15, some with square cut-out corner portions 58 to leave the sockets 44 exposed, is then laid over the floor frame 56, as shown in FIG. 6, and secured in place in the normal manner, to form a floor 12 mounted on the piers 50.

Figure 7:
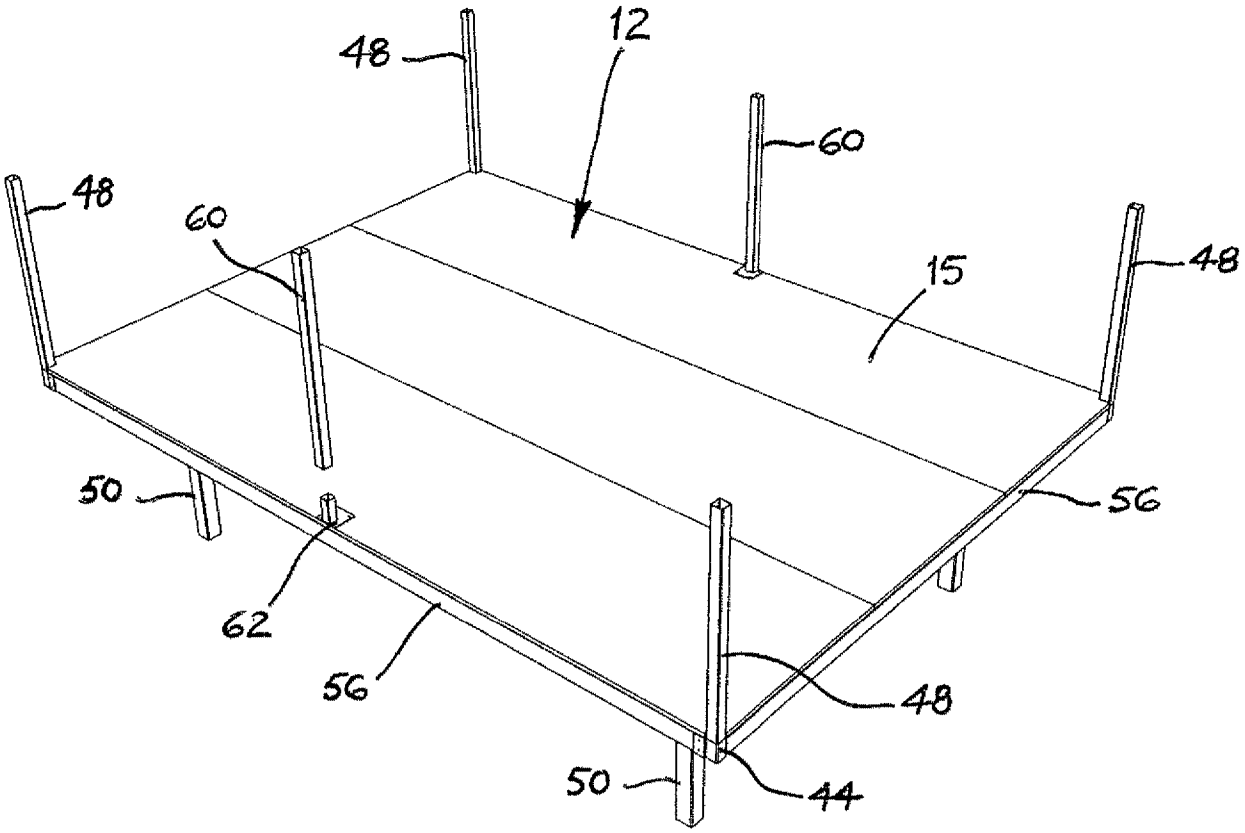
FIG. 7 is a perspective view of the floor and piers shown in FIG. 6, with wall support posts shown connected to corner sockets of the perimeter frame and connected, or about to be connected, by brackets to mid points along the opposite long sides of the floor.

Corner posts 48 for supporting the walls are then inserted tightly through each corner socket 44 and secured in place with through-bolts and nuts, as shown in FIG. 7. Additional wall support posts 60 are shown connected, or about to be connected, by brackets 62 to mid points along the opposite long sides of the floor 12.

The walls are then erected, followed by the roof of the building.

Figure 8:
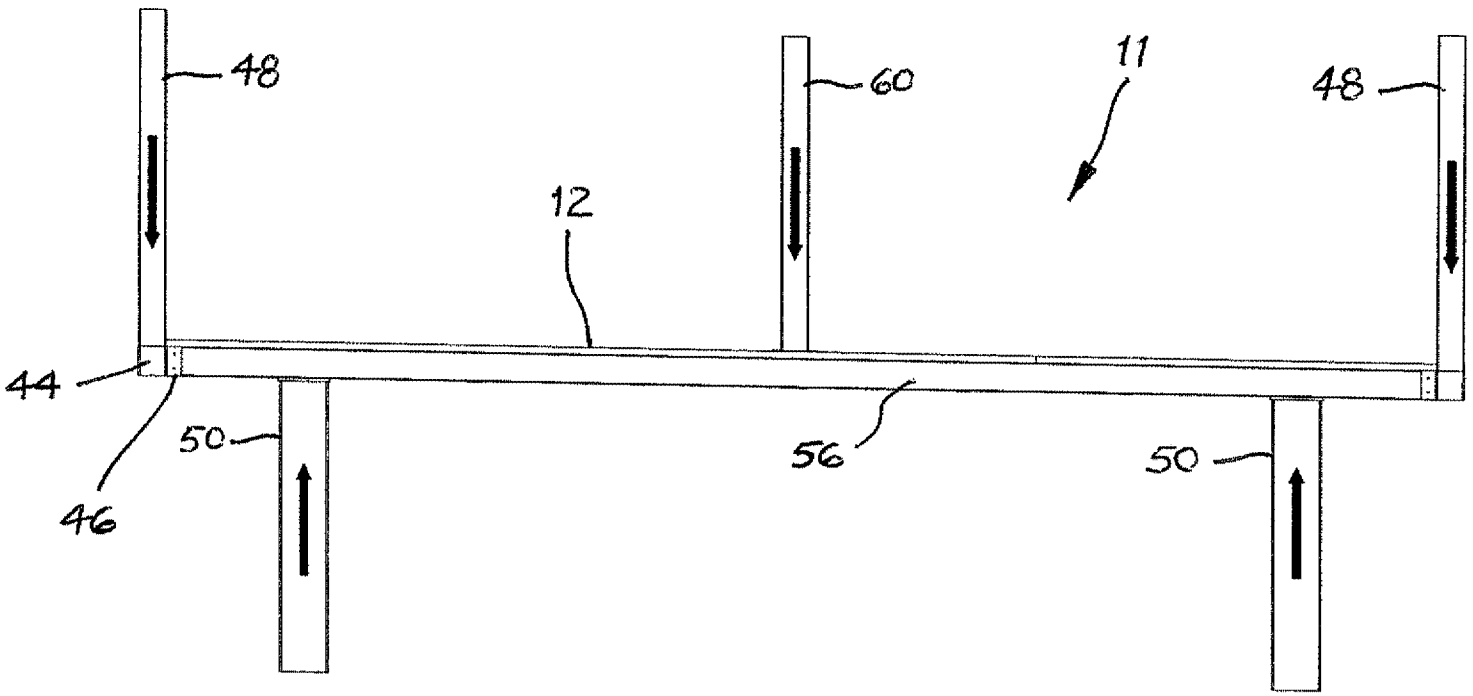
FIG. 8 is a side elevation view of the floor, piers and wall support posts shown in FIG. 7, but also showing the directions of the forces exerted on the floor when assembled on site.

FIG. 8 shows, with the use of arrows, the direction of the opposing forces exerted by the piers and by the roof and walls on the floor 12 when assembled on site. Having the piers 50 located at internal perimeter intersections of the perimeter frame 11 allows for the wall support posts 48, 60 and the roof and walls to be bearing on the cantilevered external perimeter of the perimeter frame, and the external downward force of the roof and walls is balanced by the internal weight of the joists 14 and flooring 15.

Figure 9:
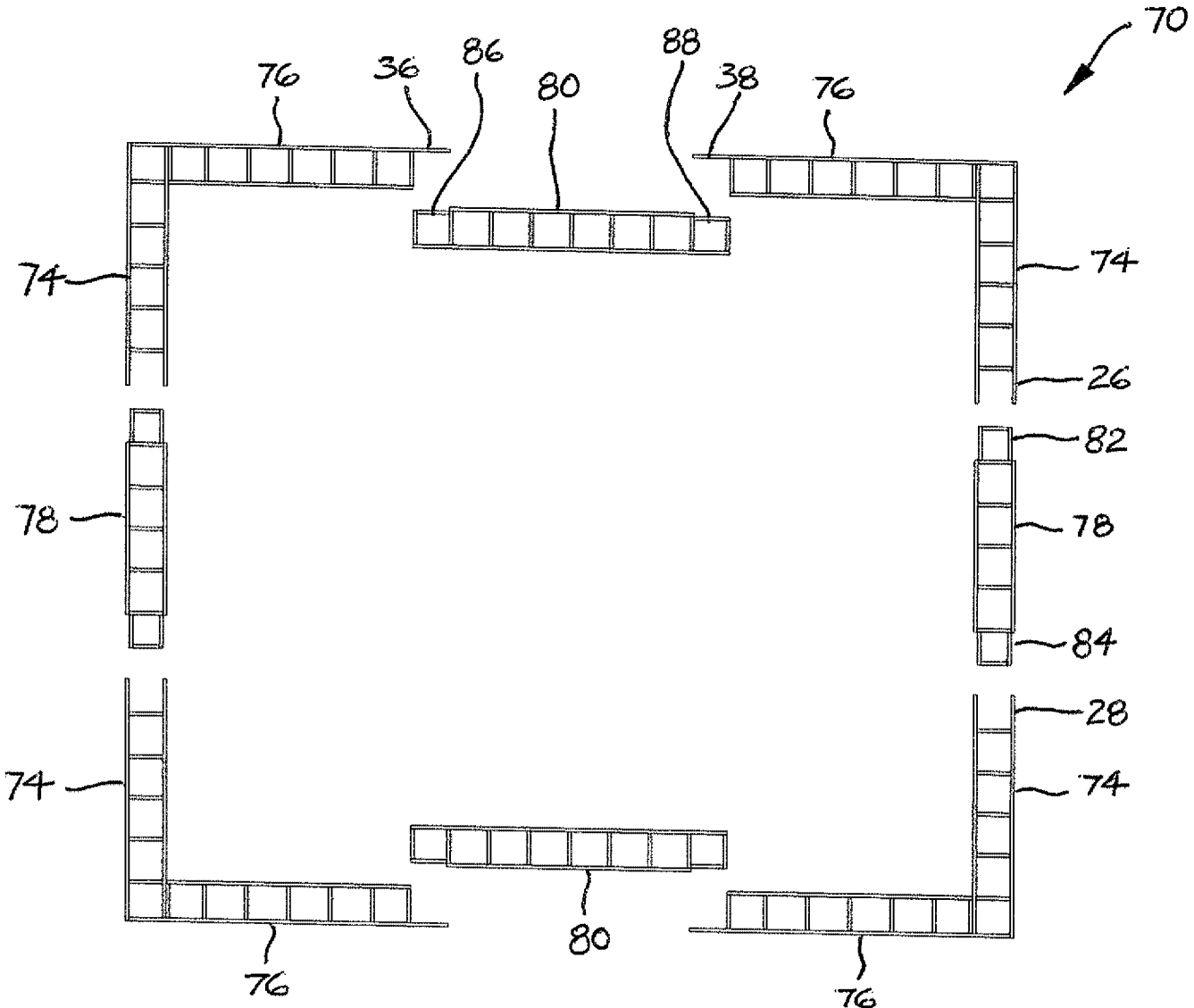
FIG. 9 is a plan view of a second embodiment of a modular perimeter frame system according to the present invention, the system comprising four ladder sub-frames, four top hat sub-frames, two ladder link sub-frames, and two top hat link sub-frames, with each ladder sub-frame shown connected perpendicularly to a respective top hat sub-frame to define a corner of a perimeter frame, and with each ladder link sub-frame located separately but in a position where it is about to be connected longitudinally between respective end portions of a pair of the ladder sub-frames, and with each top hat link sub-frame located separately but in a position where it is about to be connected longitudinally between respective end portions of a pair of the top hat sub-frames, to form an enlarged perimeter frame for use in the construction of a floor, wall and/or roof of a building.
Figure 10:
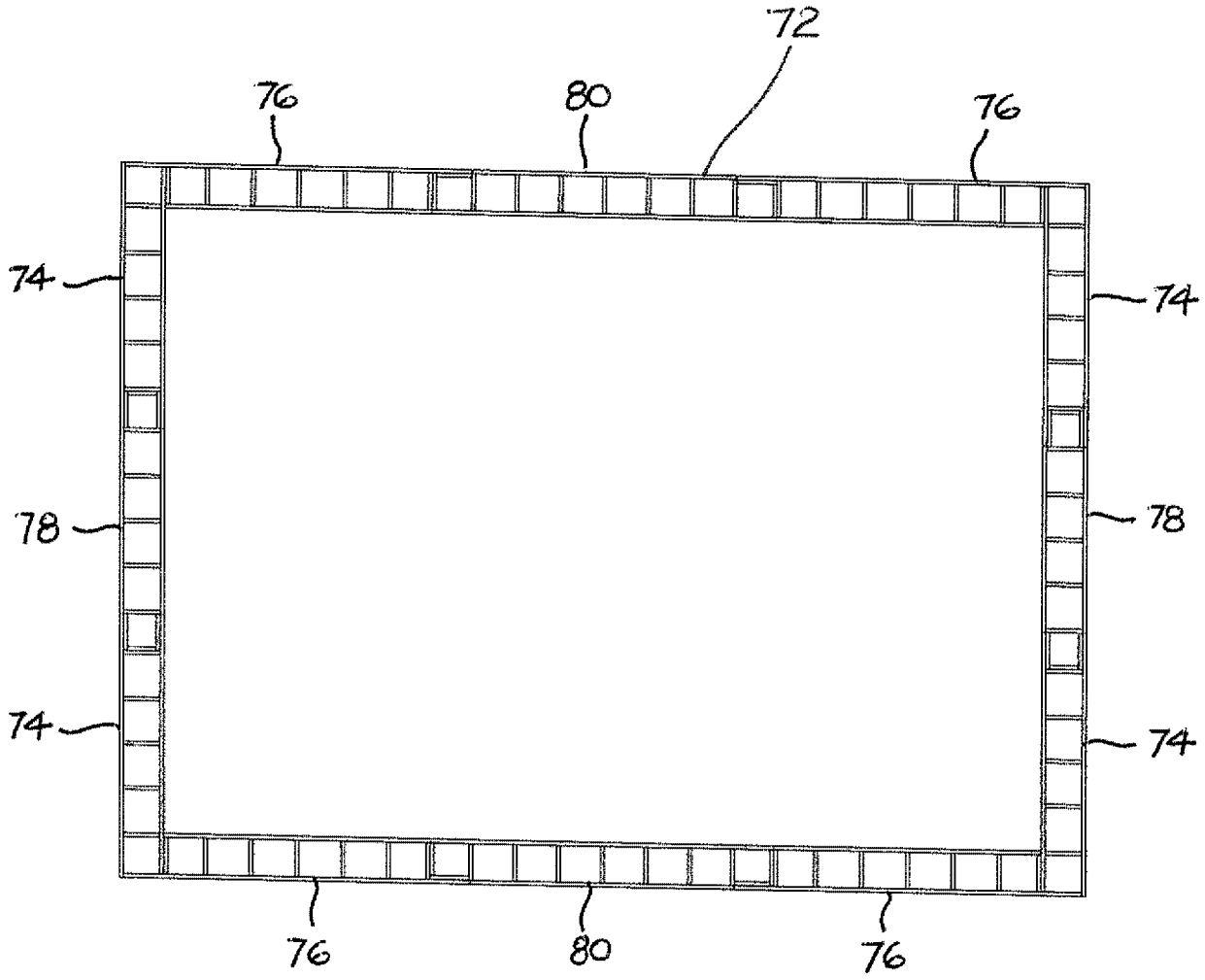
FIG. 10 is a plan view of the perimeter frame formed by the interconnection of the sub-frames shown in FIG. 9.
Figure 11:
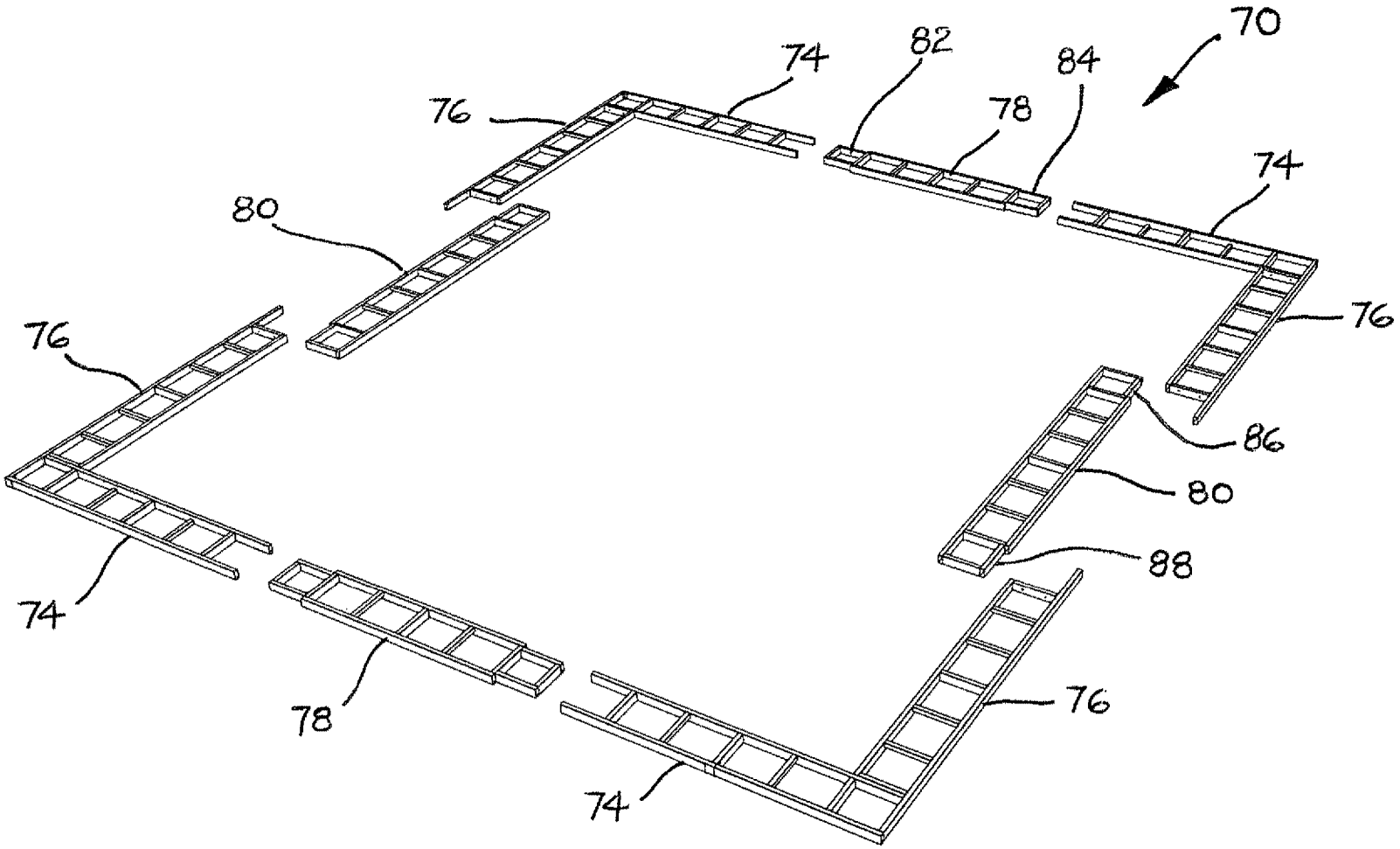
FIG. 11 is a perspective view of the modular perimeter frame system shown in FIG. 9.
Figure 12:
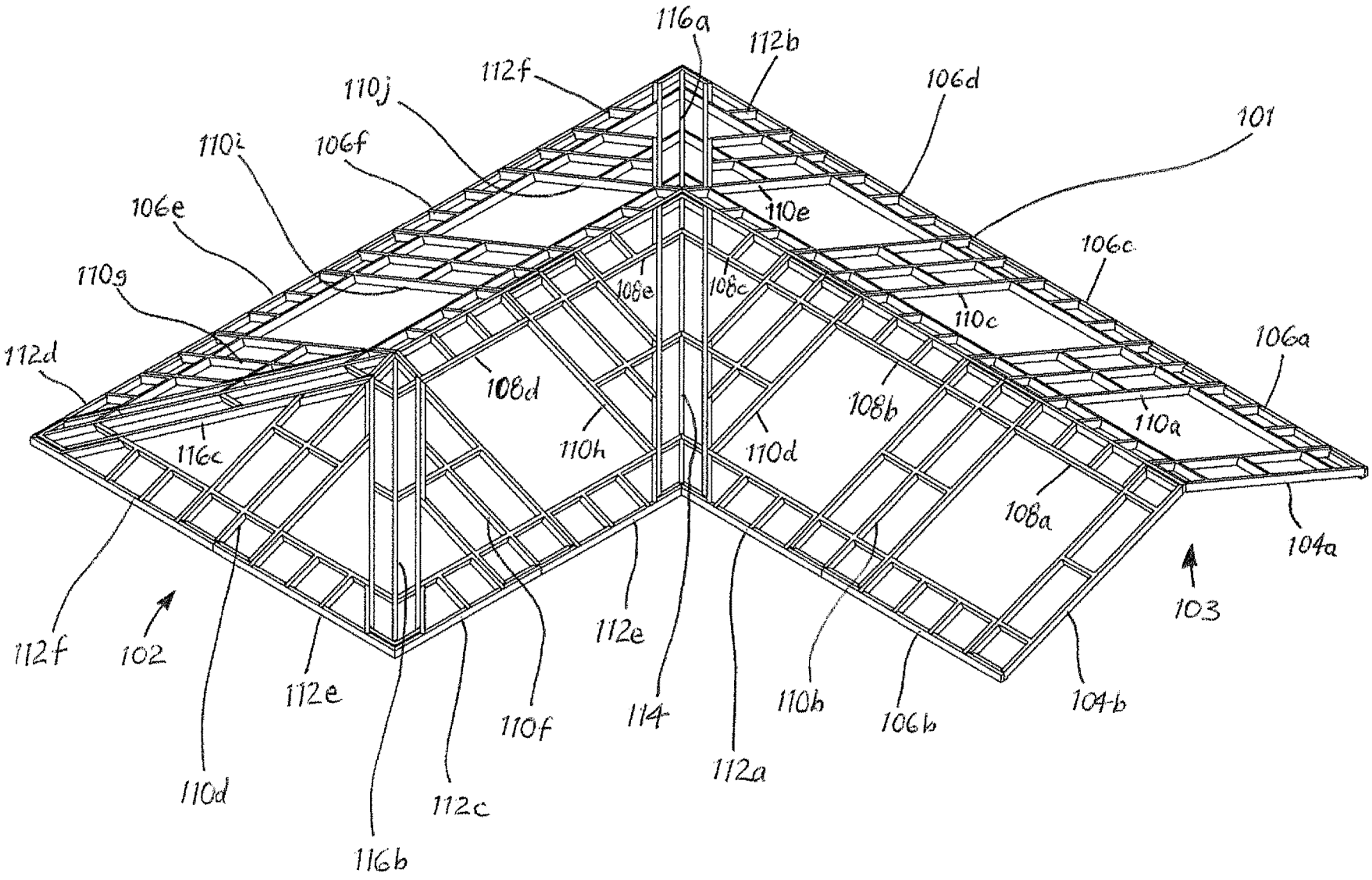
FIG. 12 is a perspective view of a hip and gable roof frame formed from a modular perimeter frame system according to a third embodiment of the present invention, the system comprising a plurality of sub-frames which are shown after they have been interconnected to form the roof frame for use in the construction of a roof of a building.
Figure 13:
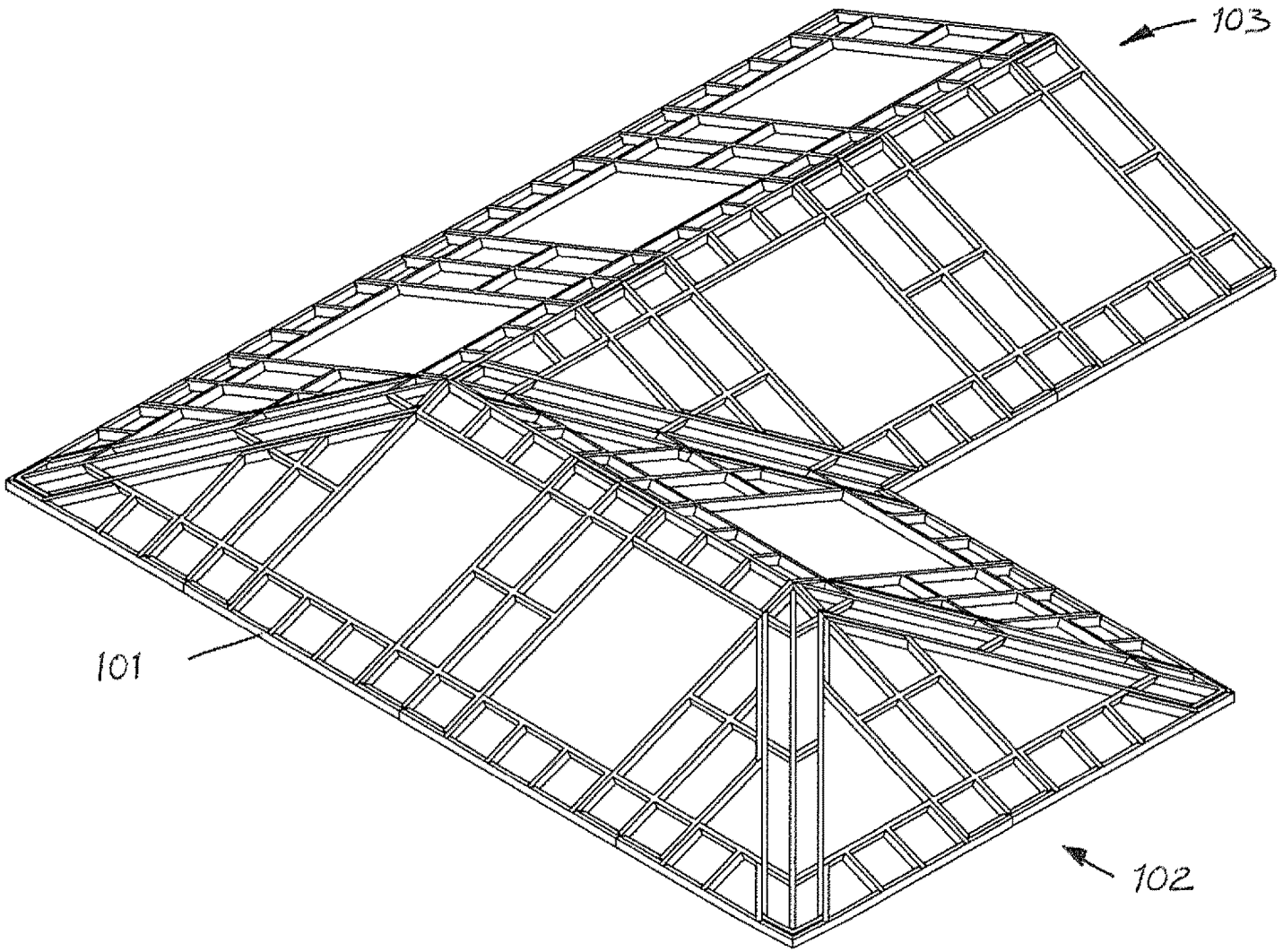
FIG. 13 is a second perspective view of the hip and gable roof frame shown in FIG. 12.
Figure 14:
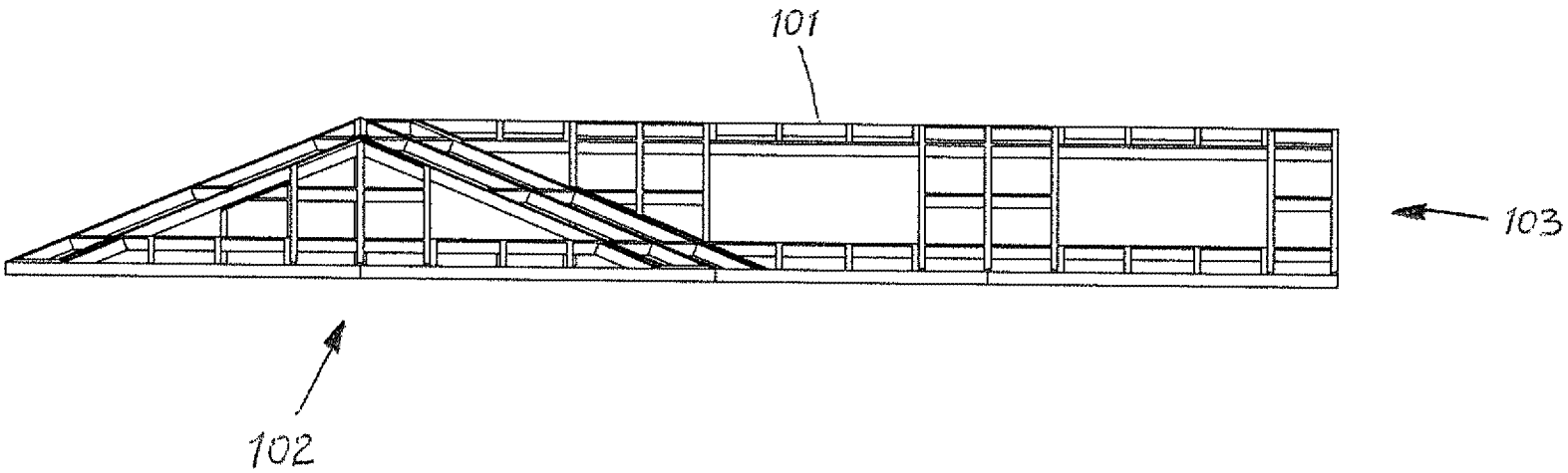
FIG. 14 is a front view of the hip and gable roof frame shown in FIG. 12.
Figure 15:
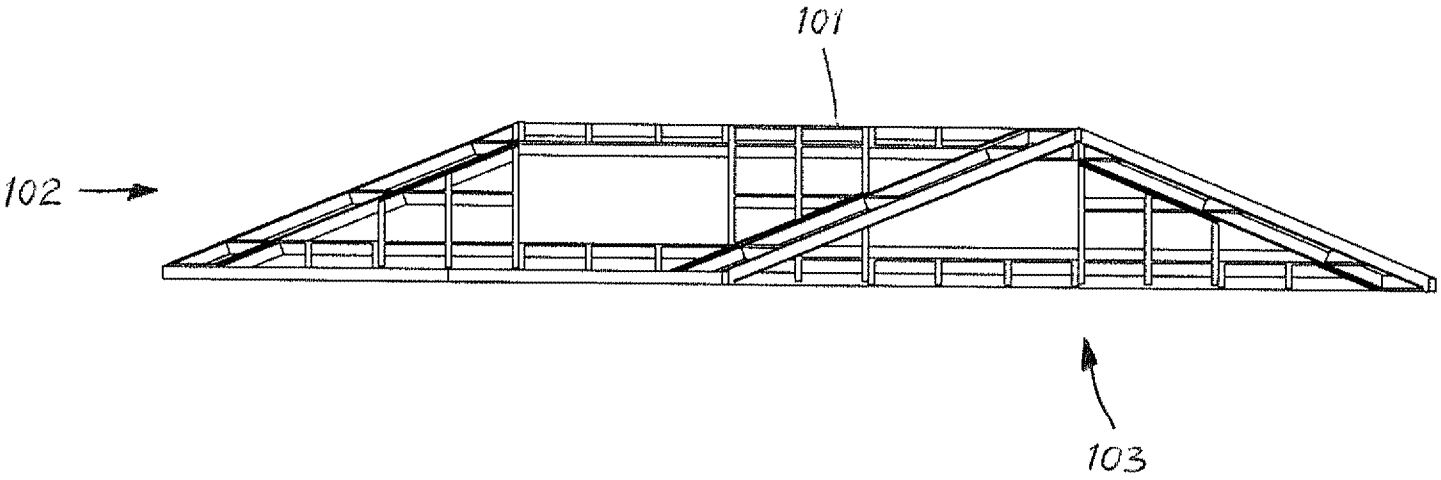
FIG. 15 is a right-side view of the hip and gable roof frame shown in FIG. 12.
Figure 16:
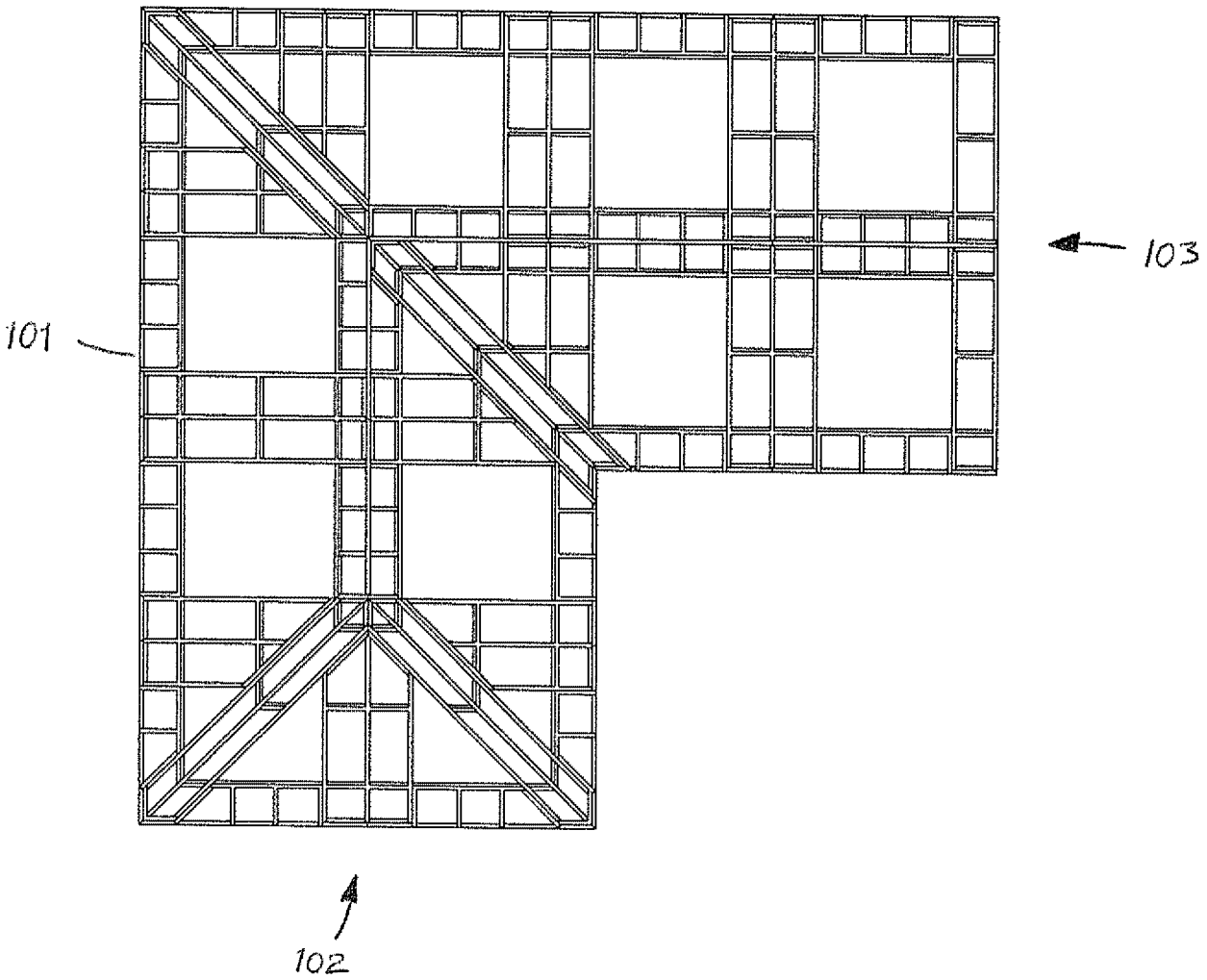
FIG. 16 is a plan view of the hip and gable roof frame shown in FIG. 12.

Another embodiment of the modular perimeter frame system 70 shown in the accompanying drawings of FIGS. 9 to 11 is for forming an enlarged perimeter frame 72 used in the construction of a floor, wall or roof of a building.

Unless otherwise stated, the structure and function of both the modular perimeter frame system 70 and the enlarged perimeter frame 72 formed with that system are substantially similar to, or would be readily understood from a comparison with, the above described structure and function of the modular perimeter frame system 10 and the frame 11 formed therewith.

The modular perimeter frame system 70 includes four ladder sub-frames 74, four top hat sub-frames 76, two ladder link sub-frames 78, and two top hat link sub-frames 80 which are preassembled before they arrive at the site of construction.

As shown in FIGS. 9 and 11, each ladder sub-frame 74 is shown connected perpendicularly to a respective top hat sub-frame 76 to define a corner of the enlarged perimeter frame 72. Each ladder link sub-frame 78 is located separately but in a position where it is about to be connected longitudinally between respective blunt end portions of a pair of the ladder sub-frames 74, and each top hat link sub-frame 80 is located separately but in a position where it is about to be connected longitudinally between respective overhang end portions of a pair of the top hat sub-frames 76.

Each ladder link sub-frame 78 has peg end portions 82, 84 at opposite ends thereof, and each peg end portion 82, 84 can engage within, and is securable to, the adjacent blunt end portion 26, 28 of a ladder sub-frame 74. Each top hat link sub-frame 80 has offset end portions 86, 88 at opposite ends thereof, and each offset end portion 86, 88 can engage alongside, and is securable to, the adjacent overhang end portion 36, 38 of a top hat sub-frame 76.

FIG. 10 shows the enlarged perimeter frame 72 formed after the sub-frames 74, 76, 78, 80 have been interconnected.

The inclusion of the ladder link sub-frames 78 and the top hat link sub-frames 80 in the modular perimeter frame system 70 allows for modular enlargement of a floor, wall or roof of a building in a relatively quick and easy manner compared to other known frame systems. The link sub-frames also allow for customization and flexibility in the forming of a perimeter frame to suit the desired size of a floor, wall, roof or similar structure. For example, the link sub-frames can be used to form eaves around an existing structure or to form a catch platform scaffold around a building.

FIGS. 12 to 18 show a hip and gable roof frame 101 formed from a modular perimeter frame system 100 according to another embodiment of the present invention. The roof frame 101 is used in the construction of a roof of a building.

Unless otherwise stated, the structure and function of both the modular perimeter frame system 100 and the hip and gable roof frame 101 formed with that system are substantially similar to, or would be readily understood from a comparison with, the above described structure and function of the modular perimeter frame systems 10, 70 and the frames 11, 72, respectively, formed therewith.

The hip end of the roof frame 101 is denoted by the numeral 102, and the gable end of the roof frame 101 is denoted by the numeral 103.

Figure 17:
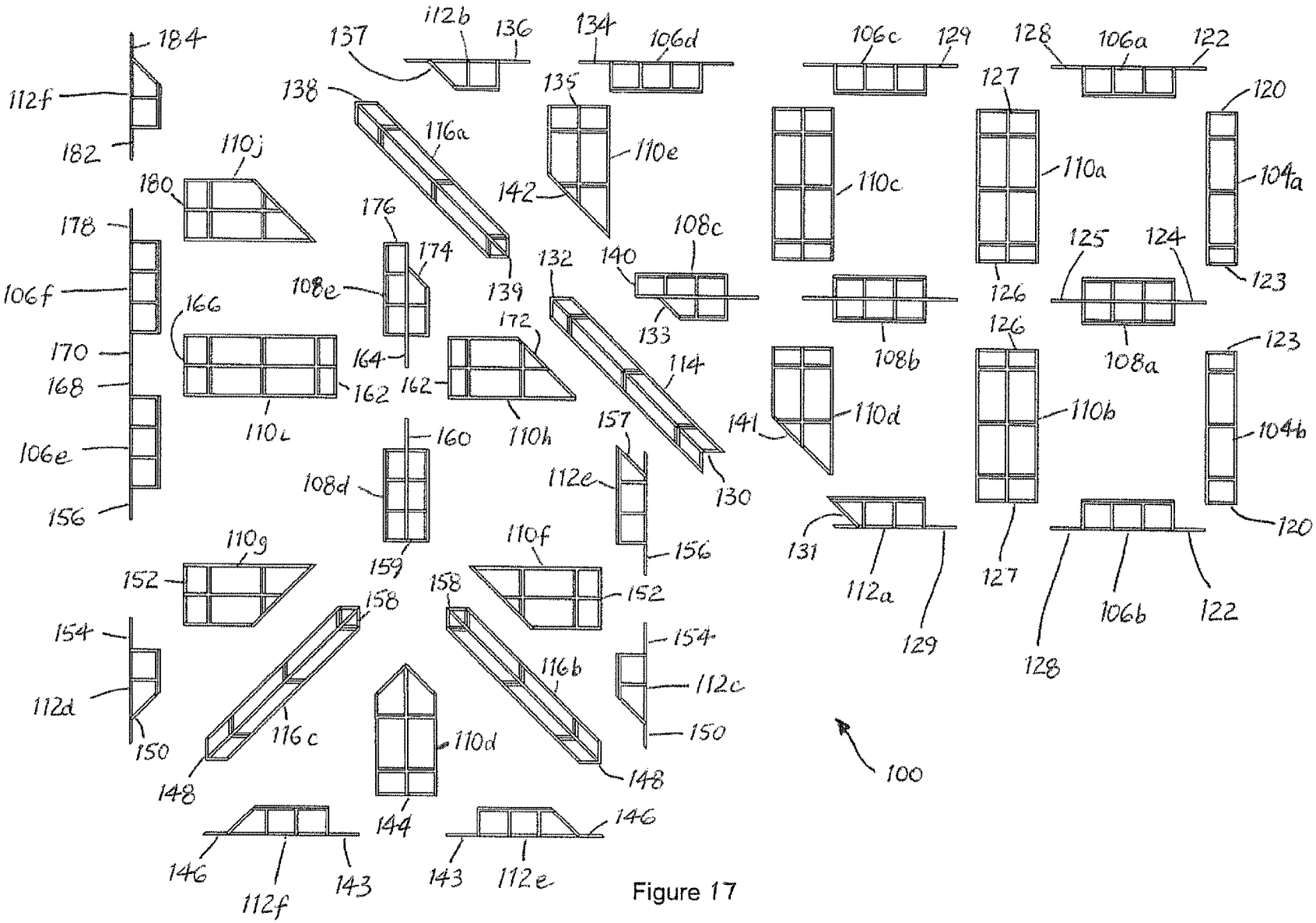
FIG. 17 is a plan view of a plurality of sub-frames located separately from each other and shown prior to being interconnected to form the hip and gable roof frame shown in FIG. 12.
Figure 18:
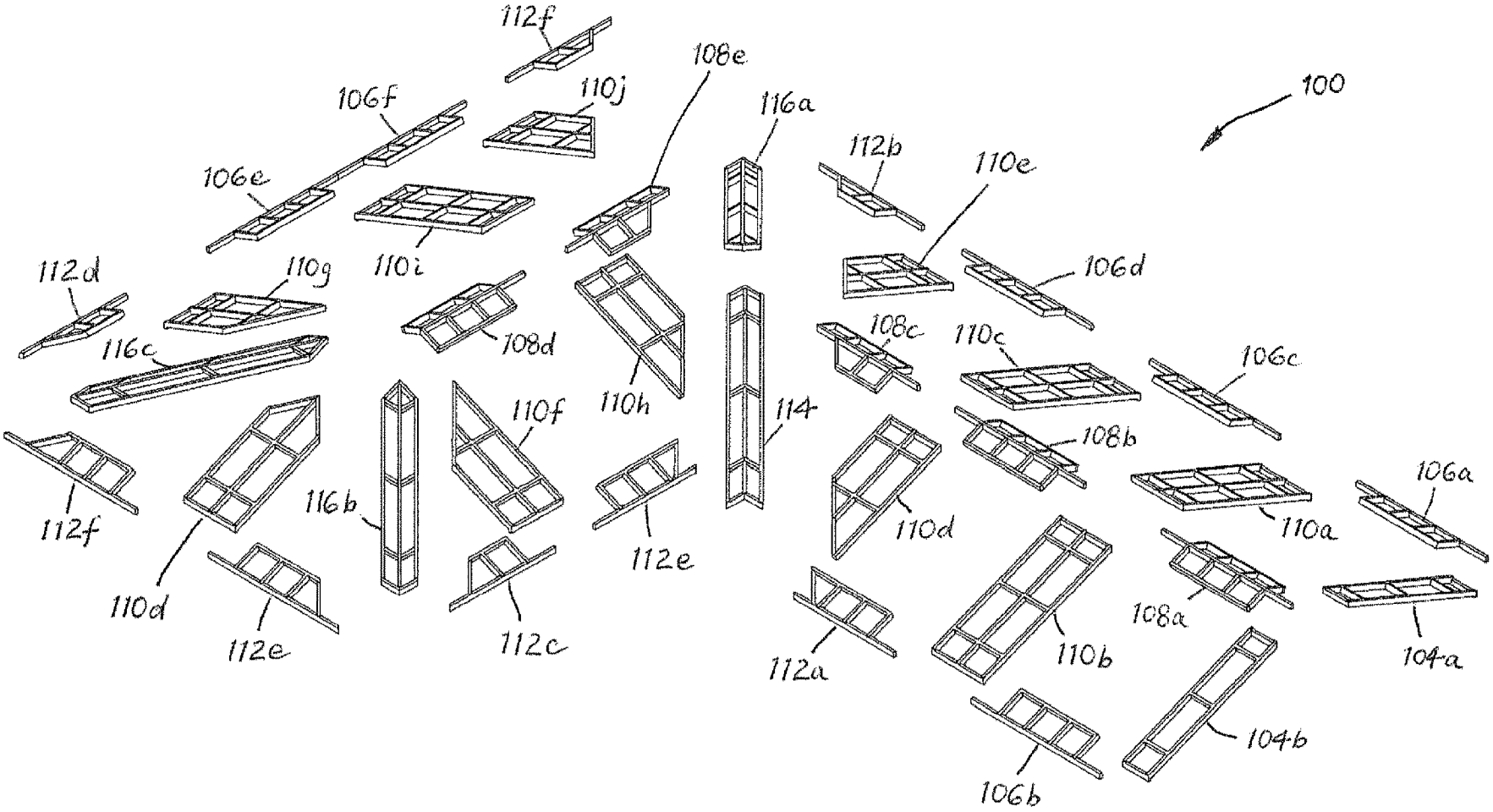
FIG. 18 is a perspective view of the plurality of sub-frames shown in FIG. 17.

As best shown in FIGS. 17 and 18, the modular perimeter frame system 100 includes bridging single sub-frames 104*a*, 104*b*, top hat sub-frames 106*a* to 106*f*, ridge sub-frames 108*a* to 108*e*, bridging twin sub-frames 110*a* to 110*j*, non-perpendicularly interconnecting top hat sub-frames 112*a* to 112*f*, a valley sub-frame 114, and hip sub-frames 116*a* to 116*c* which are preassembled before they arrive at the site of construction.

As shown in FIGS. 12 to 16, at the gable end 103 of the roof frame 101, a lowermost blunt end portion 120 of each bridging single sub-frame 104*a*, 104*b* is connected perpendicularly to an overhang end portion 122 of a respective top hat sub-frame 106*a*, 106*b*. The uppermost blunt end portion 123 of each bridging single sub-frame 104*a*, 104*b* is connected perpendicularly to respective opposite sides of an overhang end portion 124 of a ridge sub-frame 108*a*. The opposite sides of an overhang end portion 125 at the opposite end of the ridge sub-frame 108*a* are connected perpendicularly to uppermost blunt end portions 126 of respective bridging twin sub-frames 110*a*, 110*b*. The lowermost blunt end portion 127 of each bridging twin sub-frame 110*a*, 110*b* is connected perpendicularly to an overhang end portion 128 of a respective top hat sub-frame 106*a*, 106*b* and to an adjacent overhang end portion 129 of respective top hat sub-frames 106*c*, 112*a*.

As will be apparent from FIGS. 12 to 18, the bridging twin sub-frames 110*a*, 110*b* are also similarly connected to another adjoining ridge sub-frame 108*b*, which is, in turn, connected to other bridging twin sub-frames 110*c*, 110*d*, 110*e*, 112*b*, and another ridge sub-frame 108*c*.

For example, the ridge sub-frame 108*b* and top hat sub-frames 106*c*, 112*a* are also connected via their overhang end portions to the blunt end portions of the bridging twin sub-frames 110*c*, 110*d* and to the lowermost blunt end portion 130 of valley sub-frame 114. In the case of the lowermost blunt end portion 130 of valley sub-frame 114, that blunt end portion is connected non-perpendicularly to an overhang end portion 131 of the top hat sub-frame 112*a*. These bridging twin sub-frames 110*c*, 110*d* and the valley sub-frame 114 are, in turn, similarly connected via their blunt end portions to the overhang end portions of another top hat sub-frame 106*d* and of another ridge sub-frame 108*c*. In the case of the uppermost blunt end portion 132 of valley sub-frame 114, that blunt end portion is connected non-perpendicularly to an overhang end portion 133 of the ridge sub-frame 108*c*.

The top hat sub-frame 106*d* is also connected via its other overhang end portion 134 to the blunt end portion 135 of another bridging twin sub-frame 110*e*. A non-perpendicularly interconnecting top hat sub-frame 112*b* has one of its overhang end portions 136 connected perpendicularly to the blunt end portion 135 of the bridging twin sub-frame 110*e* and has the other of its overhang end portions 137 connected non-perpendicularly to a lowermost blunt end portion 138 of the hip sub-frame 116*a*. The uppermost blunt end portion 139 of the hip sub-frame 116*a*, which is at the apex (or peak) where the ridges from the gable end 103 and from the hip end 102 meet, is connected non-perpendicularly to the blunt end portion 140 of the ridge sub-frame 108*c*.

The lowermost blunt end portion 141 of bridging twin sub-frame 110*d* is connected along a side portion of the valley sub-frame 114. An uppermost blunt end portion 142 of another bridging twin sub-frame 110*e* is connected along a side portion of the hip sub-frame 116*a*.

At the hip end 102 of the roof frame 101, an overhang end portion 143 of each top hat sub-frame 112*e*, 112*f* is connected perpendicularly to a lowermost blunt end portion 144 of a bridging twin sub-frame 110*d*. The other overhang end portion 146 of each top hat sub-frame 112*e*, 112*f* is connected non-perpendicularly to a lowermost blunt end portion 148 of hip sub-frame 116*b*, 116*c*. The lowermost blunt end portion 148 of each hip sub-frame 116*b*, 116*c* is also connected non-perpendicularly to an overhang end portion 150 of top hat sub-frame 112*c*, 112*d*.

The lowermost blunt end portion 152 of each bridging twin sub-frame 110*f*, 110*g* is connected perpendicularly to another overhang end portion 154 of respective top hat sub-frames 112*c*, 112*d*. The lowermost blunt end portion of each bridging twin sub-frame 110*f*, 110*g* is also connected perpendicularly to an overhang end portion 156 of top hat sub-frame 112*e* and of top hat sub-frame 106*e*, respectively.

The other overhang end portion 157 of non-perpendicularly interconnecting top hat sub-frame 112*e* is connected non-perpendicularly to the lowermost blunt end portion 130 of valley sub-frame 114.

The uppermost blunt end portion 158 of each hip sub-frame 116*b*, 116*c* is connected to the blunt end portion 159 of ridge sub-frame 108*d*. Connected perpendicularly to respective opposite sides of an overhang end portion 160 of the ridge sub-frame 108*d* is the uppermost blunt end portion 162 of each bridging twin sub-frame 110*h*, 110*i*.

The bridging twin sub-frames 110*h*, 110*i* are similarly connected to respective opposite sides of an overhang end portion 164 of another adjoining ridge sub-frame 108*e*. The lowermost blunt end portion 166 of bridging twin sub-frame 110*i* is connected perpendicularly to overhang end portions 168, 170 of adjacent top hat sub-frames 106*e*, 106*f*.

The lowermost blunt end portion 172 of bridging twin sub-frame 110*h* is connected along a side portion of the valley sub-frame 114. Connected non-perpendicularly to the overhang end portion 174 of the ridge sub-frame 108*e*is an uppermost blunt end portion 132 of the valley sub-frame 114. Connected non-perpendicularly to the blunt end portion 176 of the ridge sub-frame 108*e* is the uppermost blunt end portion 139 of the hip sub-frame 116*a*.

The top hat sub-frame 106*f* is also connected via its other overhang end portion 178 to the blunt end portion 180 of another bridging twin sub-frame 110*j*. A non-perpendicularly interconnecting top hat sub-frame 112*f* has one of its overhang end portions 182 connected perpendicularly to the blunt end portion 180 of the bridging twin sub-frame 110*j*, and has its other overhang end portion 184 connected non-perpendicularly to a lowermost blunt end portion 138 of the hip sub-frame 116*a*.

Figure 19:
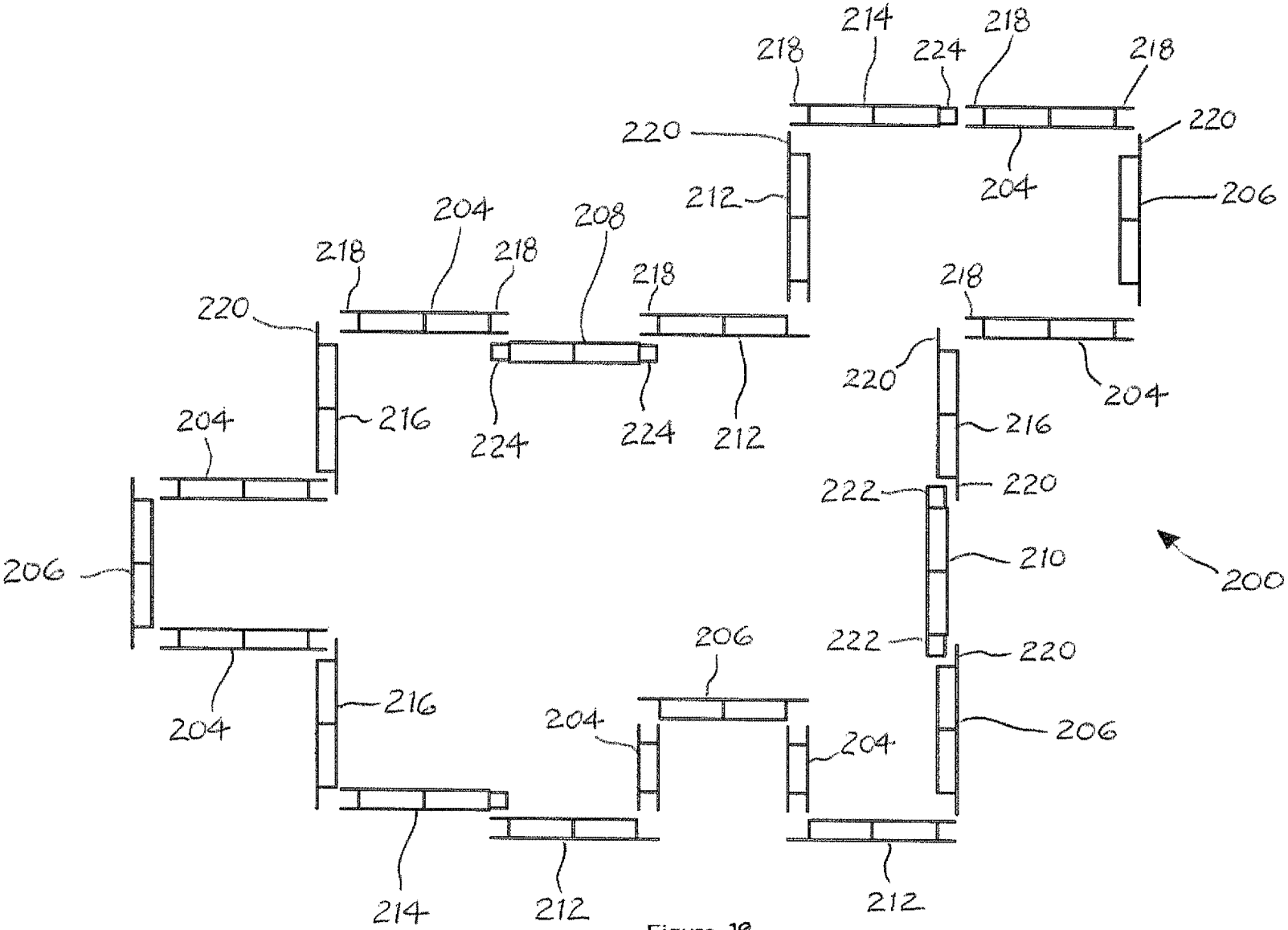
FIG. 19 is a plan view of a fourth embodiment of a modular perimeter frame system according to the present invention, the system comprising a plurality of sub-frames located separately from each other and shown prior to being interconnected to form an irregular shape perimeter frame for use in the construction of a floor and/or roof of a building.
Figure 20:
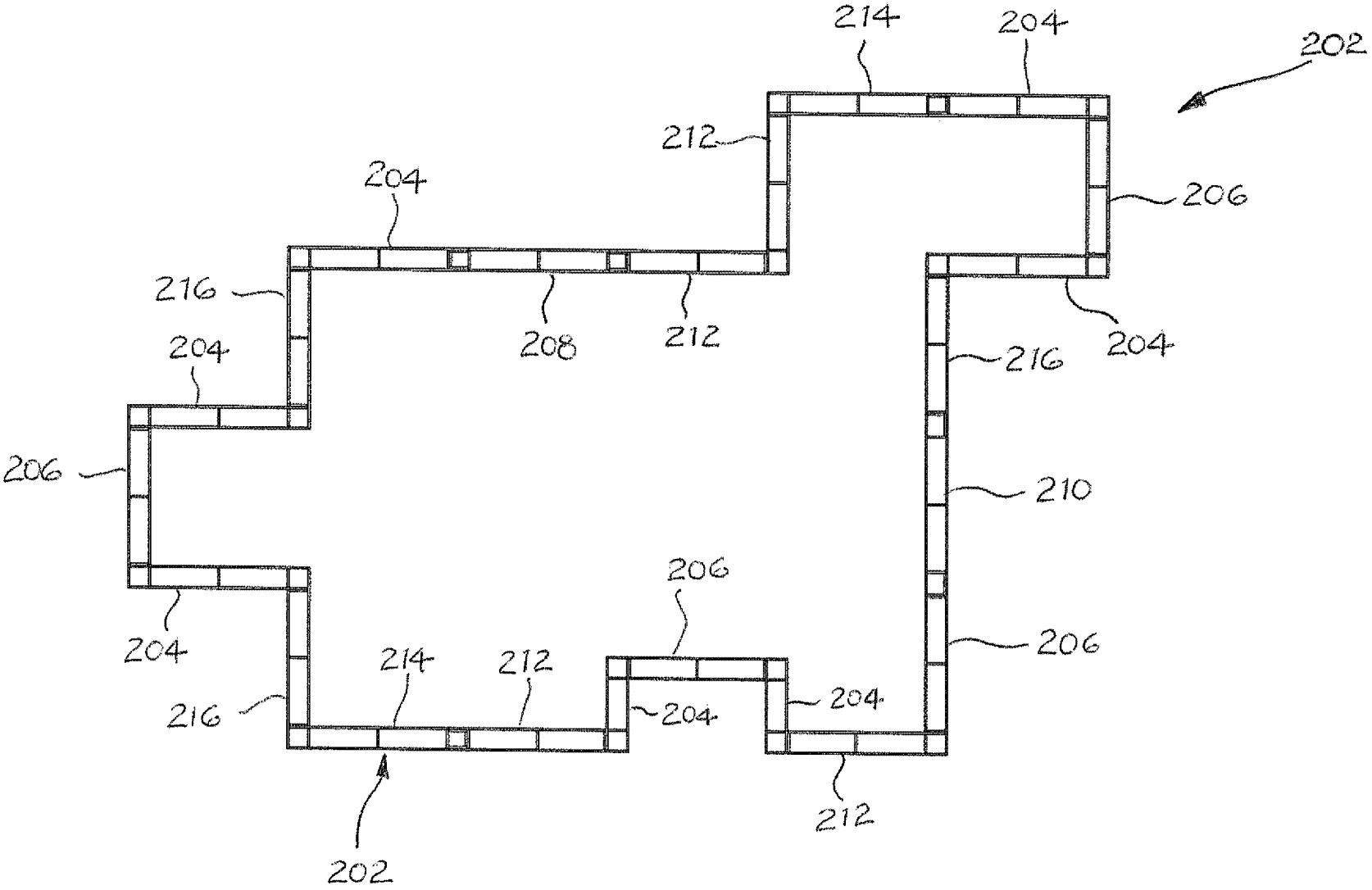
FIG. 20 is a plan view of the perimeter frame formed by the interconnection of the sub-frames shown in FIG. 19.

The embodiment of the modular perimeter frame system 200 shown in the accompanying drawings of FIGS. 19 and 20 is for forming an irregular shape perimeter frame 202 used in the construction of a floor or roof of a building.

Unless otherwise stated, the structure and function of both the modular perimeter frame system 200 and the irregular shape perimeter frame 202 formed with that system are substantially similar to, or would be readily understood from a comparison with, the above described structure and function of the modular perimeter frame systems 10, 70, 100 and the frames 11, 72, 101, respectively, formed therewith.

The modular perimeter frame system 200 includes seven ladder sub-frames 204, four top hat sub-frames 206, one ladder link sub-frame 208, one top hat link sub-frame 210, two corner link sub-frames 214, and three offset sub-frames 216 which are preassembled before they arrive at the site of construction.

As shown in FIGS. 19 and 20, there are many perpendicular connections which can define a corner of the irregular shape perimeter frame 202. A blunt end portion 218 is present at both ends of any ladder sub-frame 204 and at only one end of any chair sub-frame 212.

A blunt end portion 218, when at any corner of the frame 202, can connect perpendicularly to an overhang end portion 220 of any one of a top hat sub-frame 206, chair sub-frame 212, and offset sub-frame 216 which is also at the corner. Overhang end portions 220 which are not at any corner can provide linear connections which define an extended wall of the frame 202. Such an overhang end portion 202 can connect linearly to an offset end portion 222 at either end of a top hat link sub-frame 210.

Blunt end portions 218 which are not at any corner can also provide linear connections which define an extended wall of the frame 202. Such a blunt end portion 218 can connect linearly to a peg end portion 224 at either end of a ladder link sub-frame 208 or at only one end of a corner link sub-frame 214.

The embodiment of the modular perimeter frame system 300 shown in the accompanying drawings of FIGS. 21 to 32 is for forming a perimeter frame 301 used in the construction of a floor 302 of a building, although it may also be used in the construction of a wall or roof of a building.

Unless otherwise stated, the structure and function of both the modular perimeter frame system 300 and the perimeter frame 301 formed with that system are substantially similar to, or would be readily understood from a comparison with, the above described structure and function of the modular perimeter frame systems 10, 70, 100, 200 and the frames 11, 72, 101, 202, respectively, formed therewith.

The modular perimeter frame system 300 includes a bridging twin sub-frame 304, four chair sub-frames 306 and two top hat sub-frames 308 which are preassembled before they arrive at the site of construction.

Figure 21:
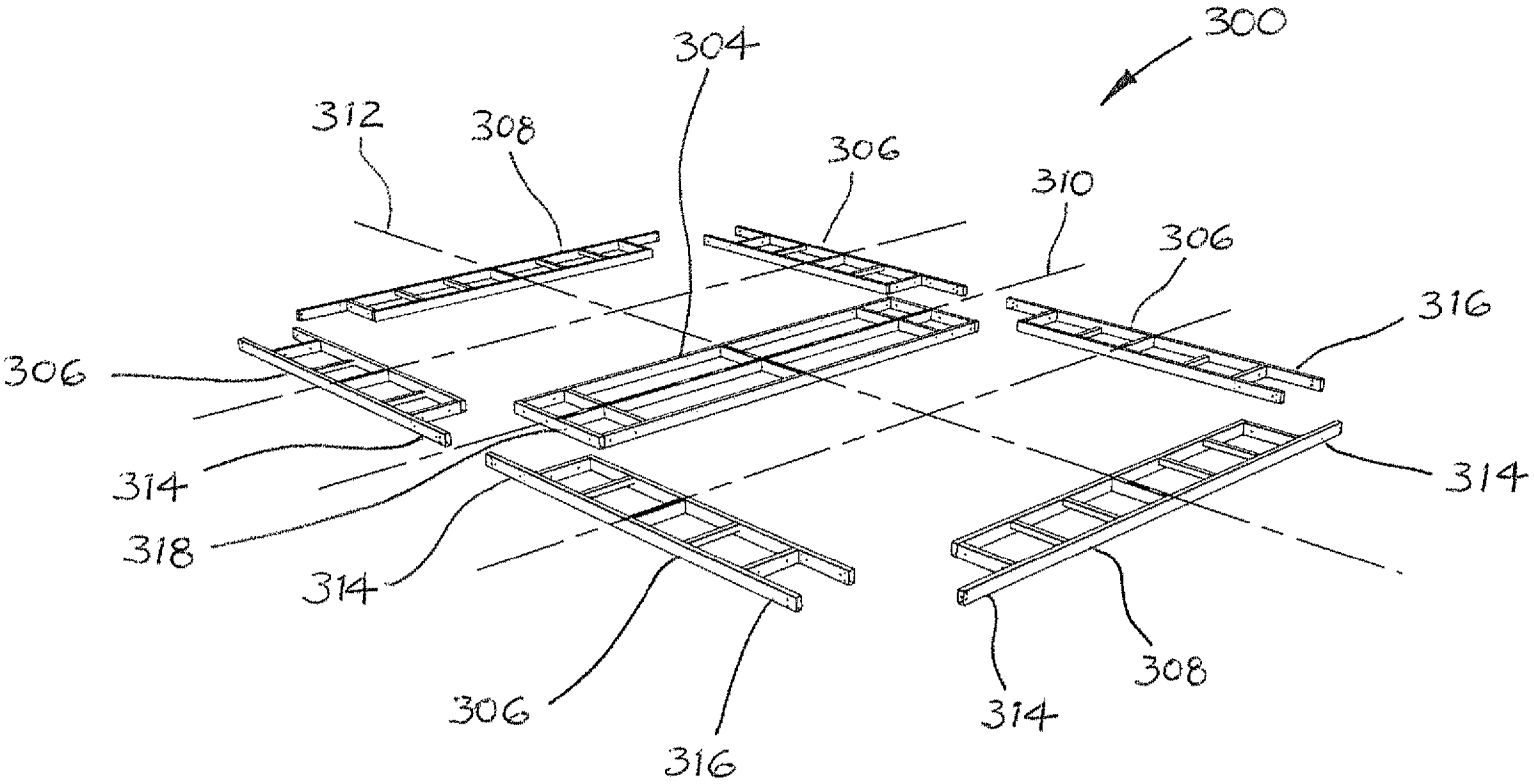
FIG. 21 is a perspective view of a fifth embodiment of a modular perimeter frame system according to the present invention, the system comprising a bridging twin sub-frame, four chair sub-frames and two top hat sub-frames, located separately from each other and shown prior to being perpendicularly interconnected at their respective end portions to form a perimeter frame for use in the construction of a floor, wall and/or roof of a building.

As shown in FIG. 21, the perimeter frame 301 is formed by locating the bridging twin sub-frame 304 at a desired location, and by locating the two top hat sub-frames 308 at symmetrically spaced apart, opposite sides of the sub-frame 304 and across a first axis 310 which extends longitudinally through the centre of the sub-frame 304.

A first pair of chair sub-frames 306 is located perpendicularly to one side of the first axis 310, but at symmetrically spaced apart, opposite sides across a second axis 312 perpendicular to the first axis 310 and which extends laterally through the centre of the bridging twin sub-frame 304.

A second pair of chair sub-frames 306 is located perpendicularly to the other side of the first axis 310, but again at symmetrically spaced apart, opposite sides across a second axis 312.

The bridging twin sub-frame 304, the chair sub-frames 306 and the top hat sub-frames 308 are then perpendicularly interconnected at their respective end portions.

Figure 22:
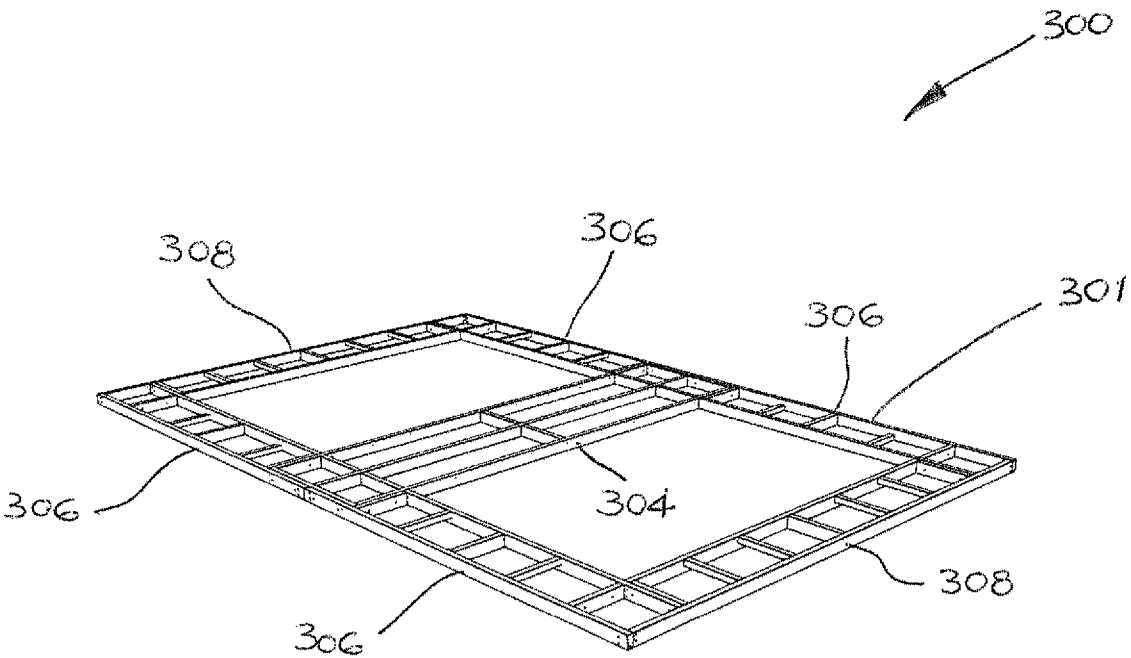
FIG. 22 is a perspective view of the perimeter frame formed by the interconnection of the sub-frames shown in FIG. 21.

Specifically, each overhang end portion 314 of the top hat sub-frames 308 is connected with a blunt end portion 316 of one of the chair sub-frames 306 at a right angle to define a corner of the perimeter frame, and each overhang end portion 314 of the chair sub-frame 306 is connected with a blunt end portion 318 of the bridging twin sub-frame 304 to form the perimeter frame 301 shown in FIG. 22.

Figure 23:
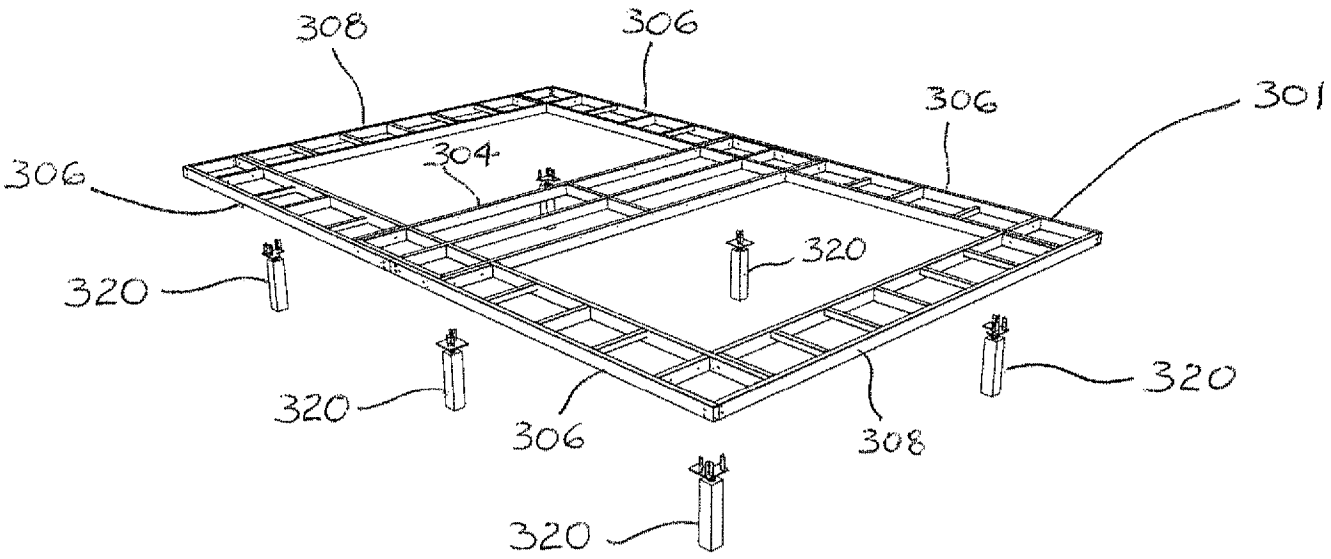
FIG. 23 is a perspective view of the perimeter frame shown in FIG. 22 about to be mounted on piers, as required for use of the perimeter frame in the construction of a floor.
Figure 24:
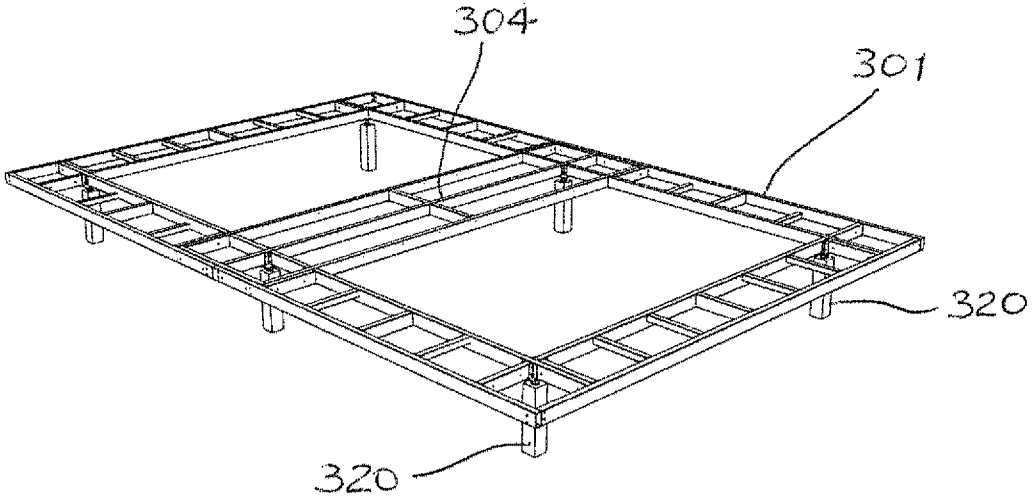
FIG. 24 is a perspective view of the perimeter frame shown in FIG. 22 mounted on piers.
Figure 25:
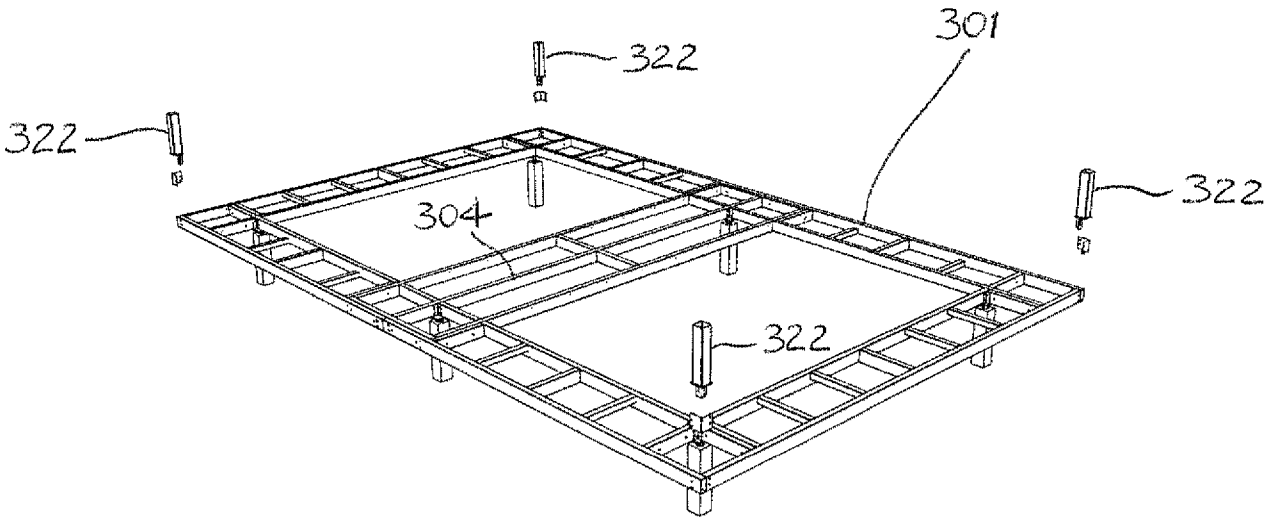
FIG. 25 is a perspective view of the perimeter frame and piers shown in FIG. 24, with corner pegs shown about to be connected to each corner of the perimeter frame.

In order to form a floor, the perimeter frame 301 shown in FIG. 22 is mounted on piers 320 or stumps. As shown in FIGS. 23 and 24, there are, in this instance, six square hollow section piers. The structure and function of the piers 320 are substantially similar to the earlier described structure and function of the piers 50 used in the construction of the floor as described with reference to FIGS. 3 and 4.

Normally, for a perimeter frame of this size, it would be expected that eight piers be used to provide the desired strength and stability to support the floor and any walls or roof erected thereon. However, the presence of the bridging twin sub-frame 304 and the connection of its blunt end portions 318 with the overhang end portions 314 of the chair sub-frames 306 in the manner described above, provides increased strength and stability. Further strength and stability is provided by the engagement of the piers 320 at reinforced internal frame regions where, for the corner piers, the internal top hat beam member joins the internal chair beam member, and where, for the middle piers, the central bridging twin beam member is connected to the inner bridging twin cross-beam member.

Corner pegs (or socket posts) 322, which are used for receiving taller structural posts for supporting walls and a roof, are then connected securely to each corner of the perimeter frame 301.

Figure 26:
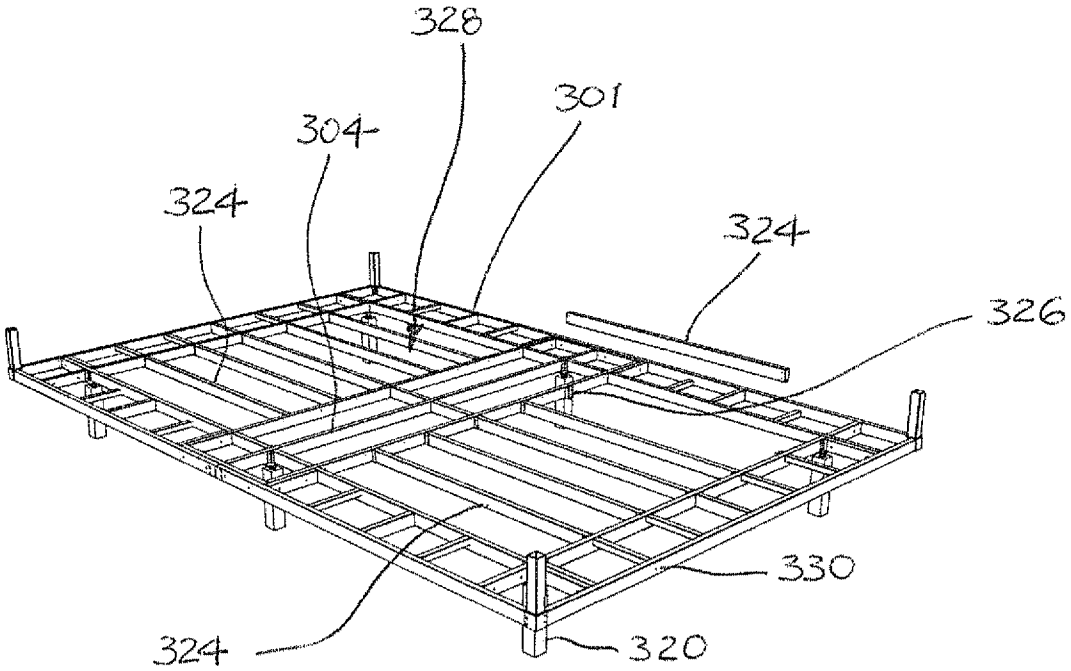
FIG. 26 is a perspective view of the perimeter frame and piers shown in FIG. 25, with corner pegs shown connected to each corner of the perimeter frame, and with floor joists shown connected, or about to be connected, by brackets to internal beam members of the perimeter frame to form a floor frame mounted on the piers.

FIG. 26 shows floor joists 324 connected, or being connected, to inner frame support brackets 326 which are secured to each internal top hat beam member and to the outermost beam members of the bridging twin sub-frame 304.

The joists create an inner frame 328 or in-fill to the perimeter frame and, because they are aligned with the top hat cross-beam members, the joists 324 form a floor frame 330 mounted on the piers 320.

Figure 27:
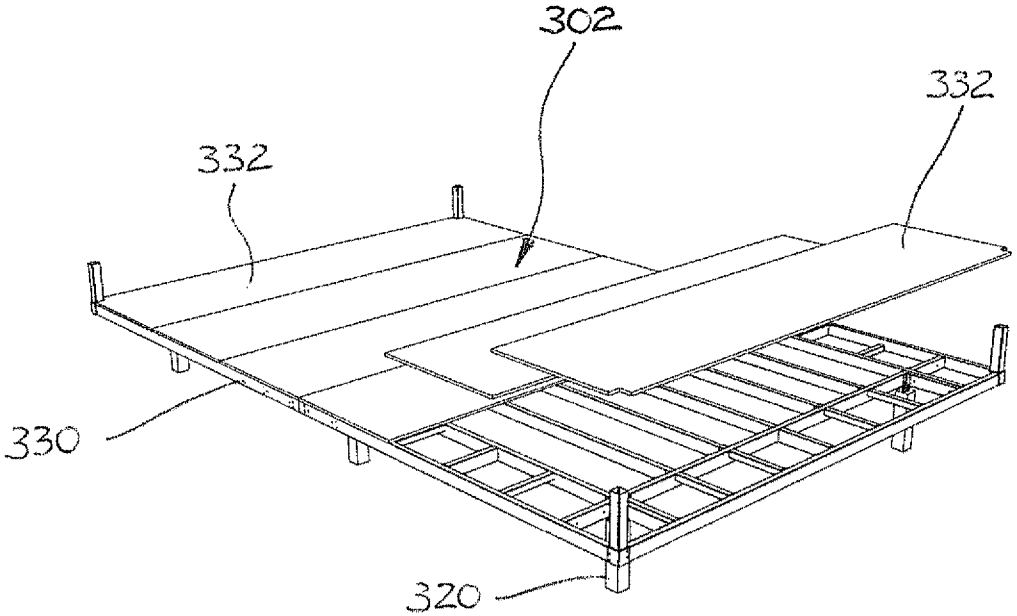
FIG. 27 is a perspective view of the floor frame and piers shown in FIG. 26, with sheet flooring shown connected, or about to be connected, to the floor frame to form a floor mounted on the piers.

Sheet flooring 332 is then laid over the floor frame 330, as shown in FIG. 27, and secured in place in the normal manner, to form a floor 334 mounted on the piers 320.

Figure 28:
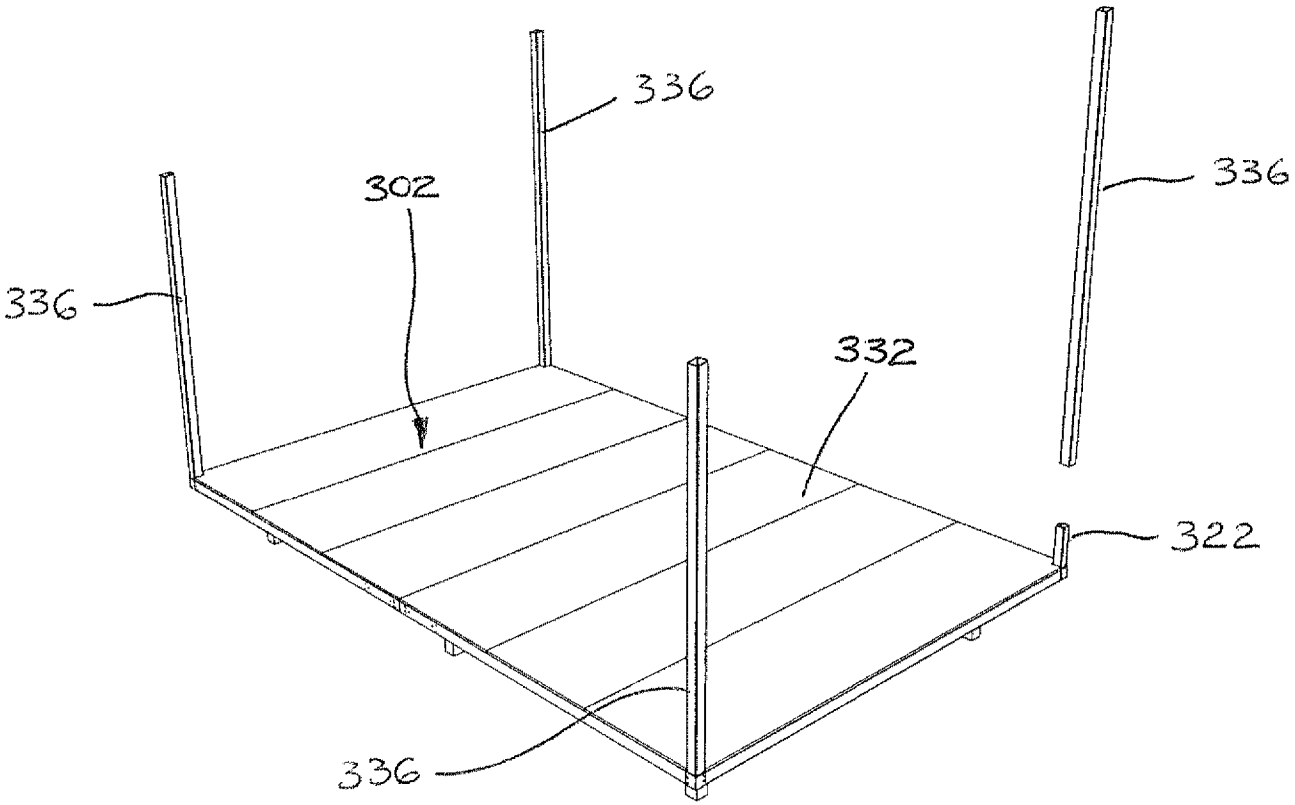
FIG. 28 is a perspective view of the floor and piers shown in FIG. 27, with corner posts shown connected, or about to be connected, to the corner pegs.
Figure 29:
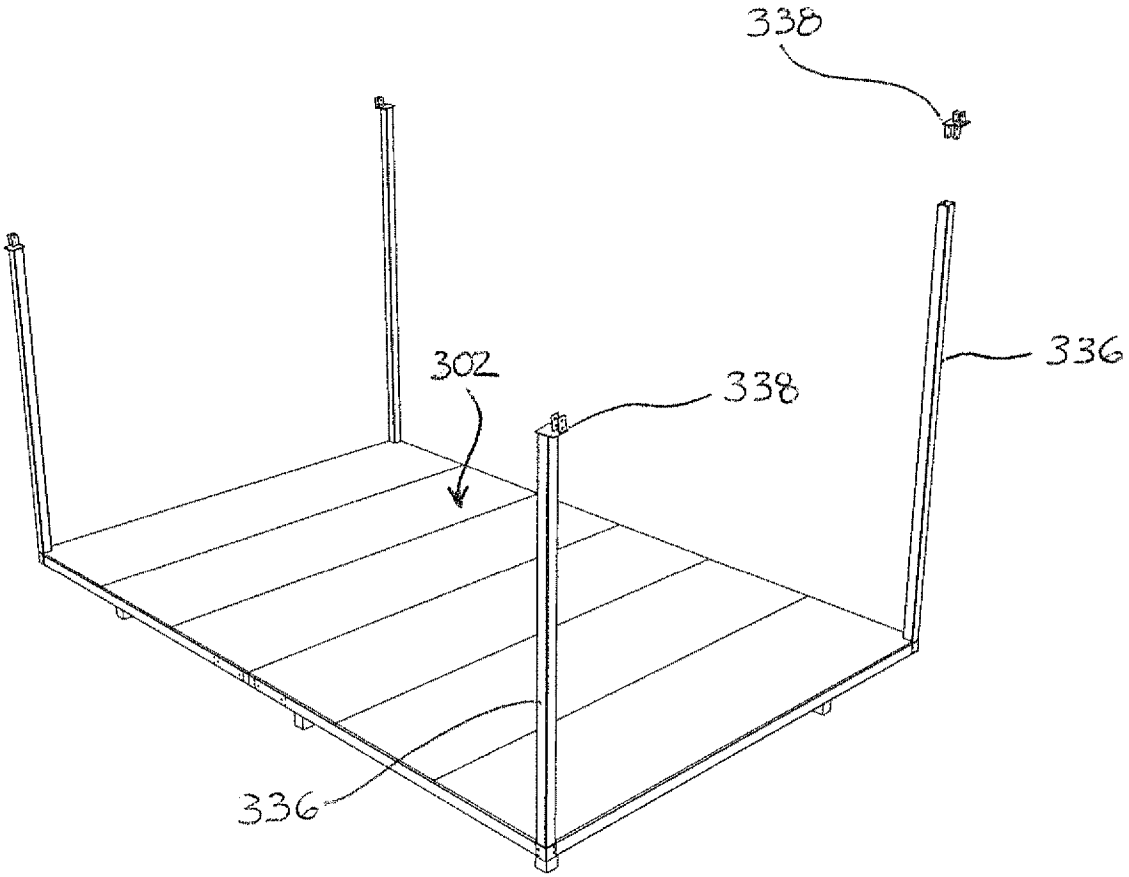
FIG. 29 is a perspective view of the floor and piers shown in FIG. 28, with corner posts shown connected to each corner of the floor, and with post top brackets connected, or about to be connected, to the top of the corner posts.

As shown in FIG. 28, corner posts 336 for supporting walls and a roof, are then telescopically lowered over the corner pegs 322 and secured in place in the normal manner. Post top brackets 338 are shown in FIG. 29 connected, or being connected, to the top of each corner post 336 for securing a roof. The brackets 338 include a main plate and upper cleats which are angularly configured to accommodate a desired angle of inclination, or pitch, of a roof.

Figure 30:
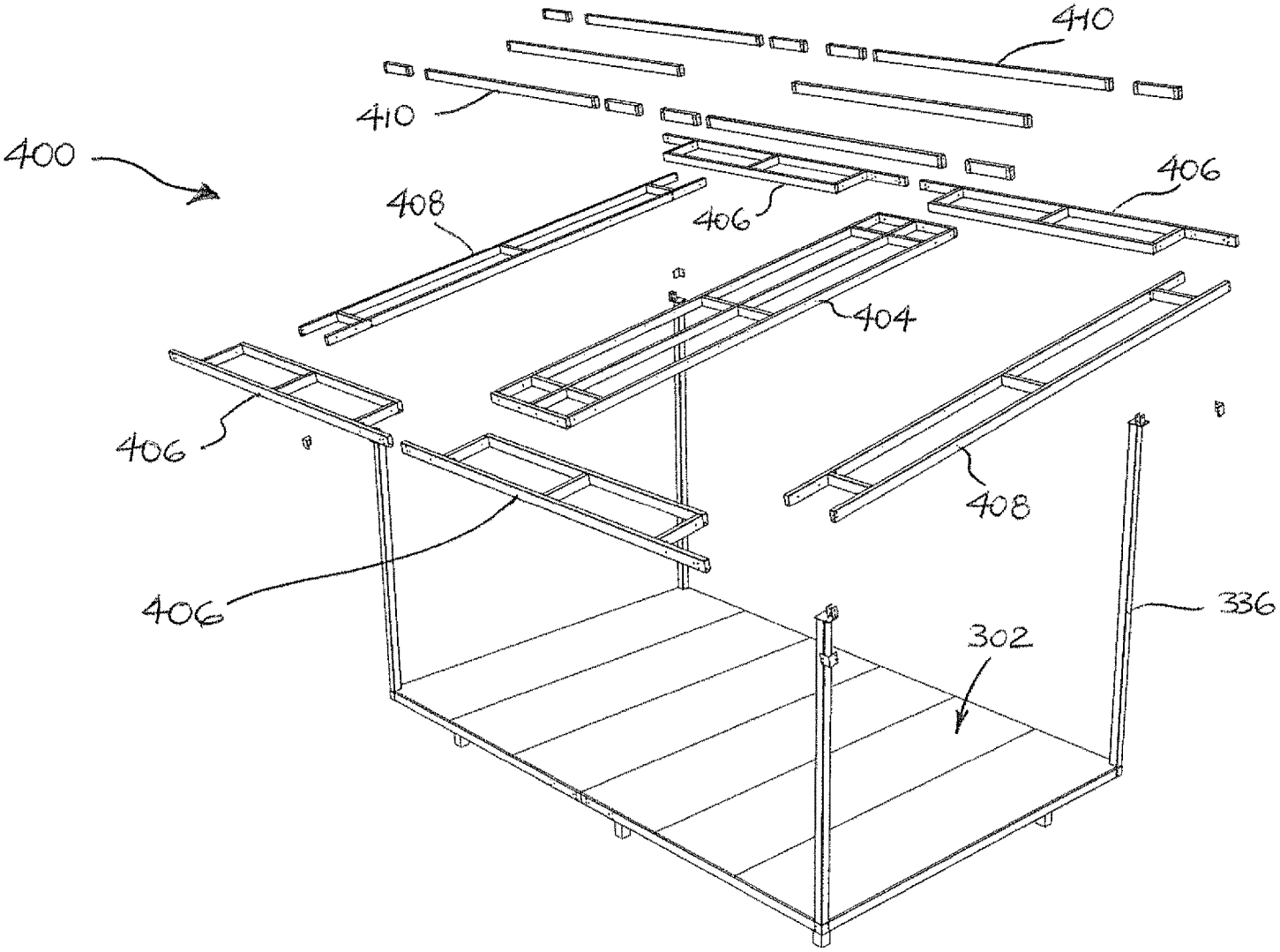
FIG. 30 is a perspective view of the floor and piers shown in FIG. 29, and of a plurality of roof sub-frames of a modular perimeter frame system according to a sixth embodiment of the present invention and roof joists, the sub-frames and joists being located separately from each other and shown prior to being interconnected to form a roof frame to be mounted on the corner posts.

Although it may be desired under particular circumstances to erect the walls before erecting the roof of the building, FIG. 30 shows an embodiment of the modular perimeter frame system 400 for forming a perimeter frame 401 used in the construction of a roof 402 of a building.

Unless otherwise stated, the structure and function of both the modular perimeter frame system 400 and the perimeter frame 401 formed with that system are substantially similar to, or would be readily understood from a comparison with, the above described structure and function of the modular perimeter frame systems 10, 70, 100, 200, 300 and the frames 11, 72, 101, 202, 301, respectively, formed therewith.

The modular perimeter frame system 400 includes a bridging twin sub-frame 404, four top hat sub-frames 406 and two ladder sub-frames 408 which are preassembled before they arrive at the site of construction, as well as roof joists 410.

Figure 31:
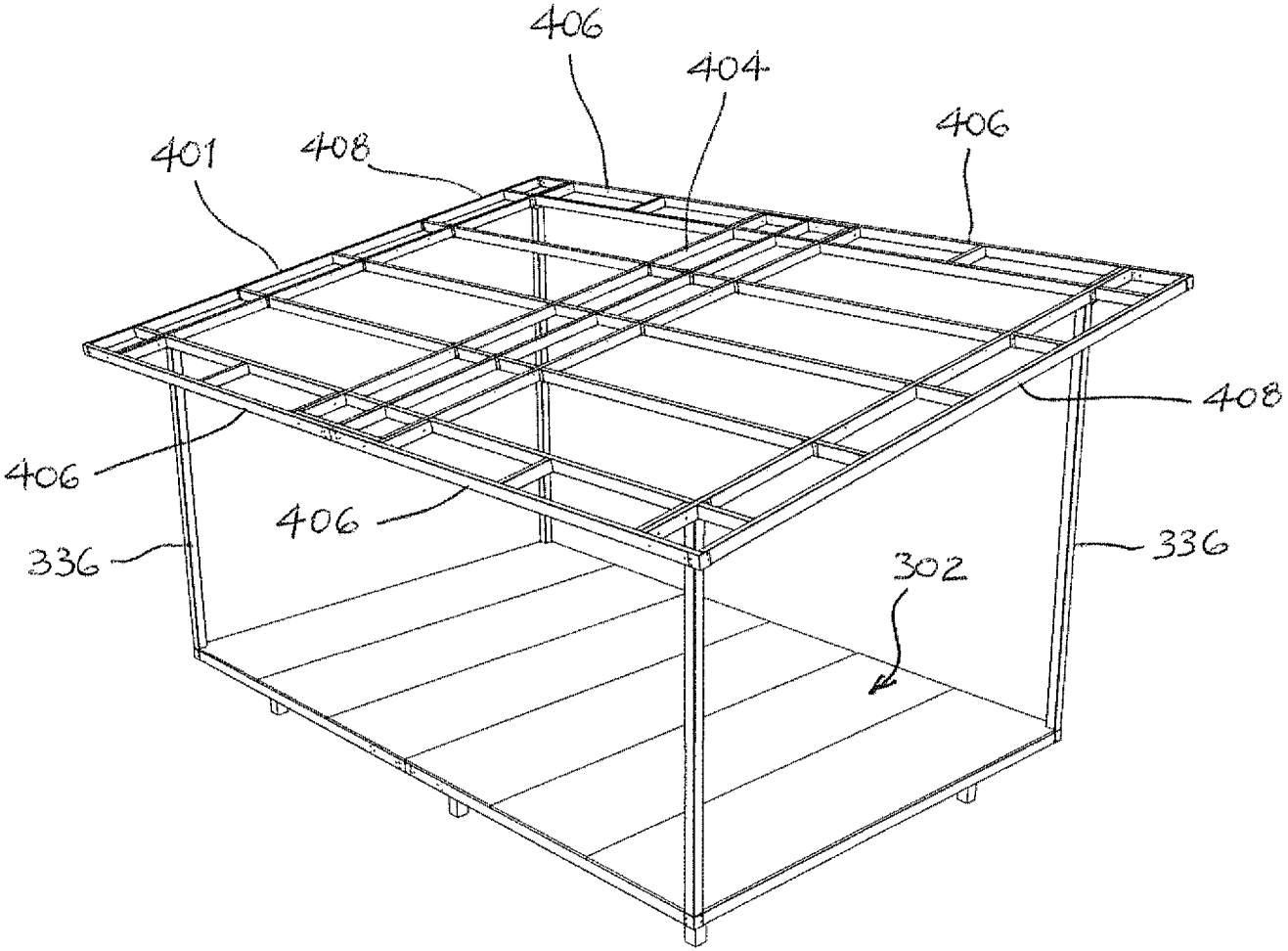
FIG. 31 is a perspective view of the roof frame formed by the interconnection of the sub-frames and joists shown in FIG. 30 and shown mounted on the corner posts.

As shown in FIG. 31, the perimeter frame 401 is formed by perpendicularly interconnecting the aforementioned sub-frames 404, 406, 408 and the roof joists 410 in a manner similar to that described for other embodiments of the modular perimeter frame system.

Figure 32:
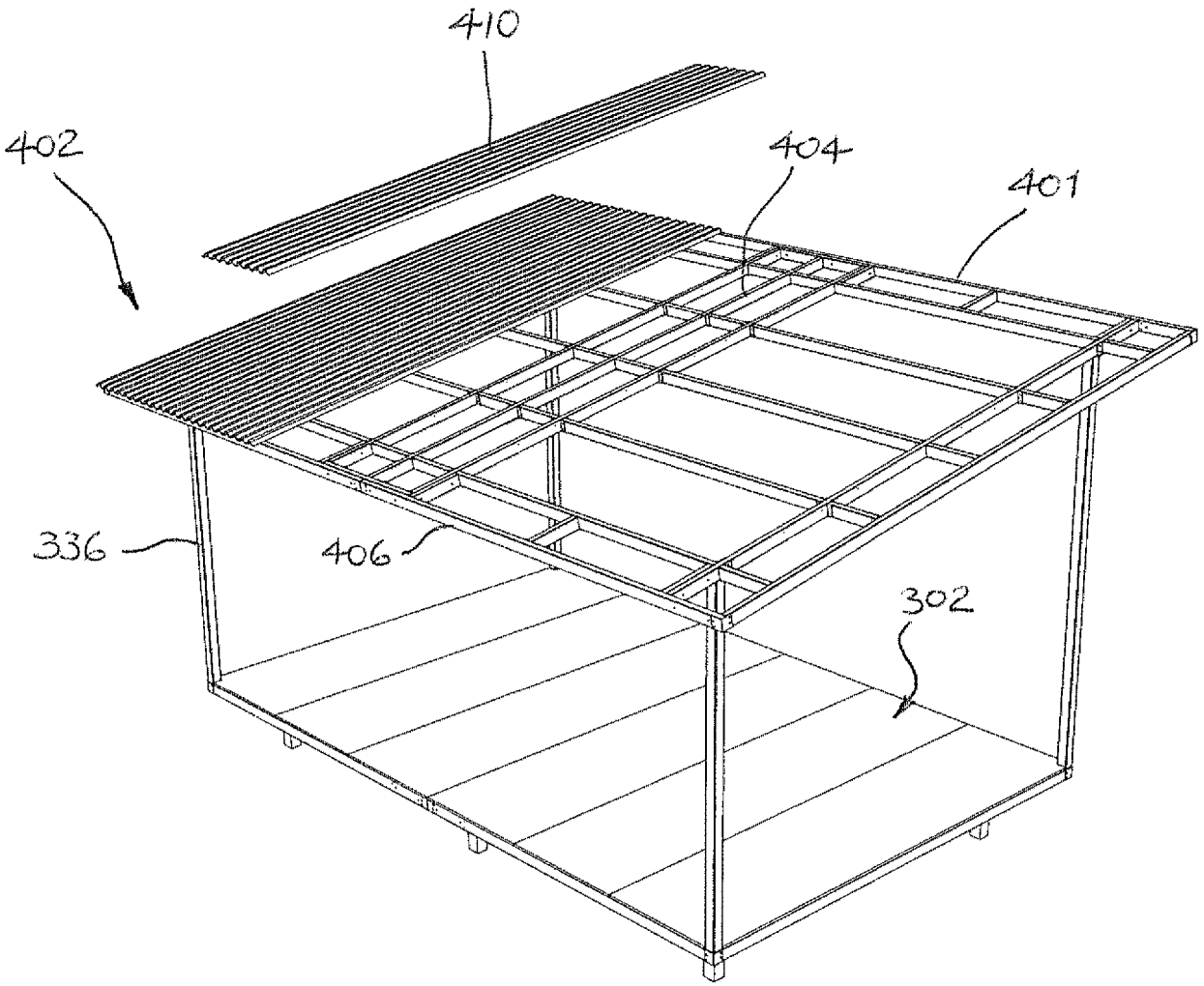
FIG. 32 is a perspective view of the roof frame, floor, piers and corner posts shown in FIG. 31, with corrugated roof sheeting shown connected, or about to be connected, to the roof frame to form a roof.

FIG. 32 shows an inclined roof 402 partly formed by laying a plurality of corrugated roof sheeting 410 onto the perimeter frame 401 and securing the roof sheeting to the frame members in the usual manner.

The embodiment of the modular perimeter frame system 500 shown in the accompanying drawings of FIGS. 33 to 44 is for forming a hexagonal shape perimeter frame 501 used in the construction of a floor 502 of a building, although it may also be used in the construction of a flat roof of a building, in which case some of the floor components will be replaced with suitable roof components.

Unless otherwise stated, the structure and function of both the modular perimeter frame system 500 and the hexagonal shape perimeter frame 501 formed with that system are substantially similar to, or would be readily understood from a comparison with, the above described structure and function of the modular perimeter frame systems 10, 70, 100, 200, 300, 400 and the perimeter frames 11, 72, 101, 202, 301, 401, respectively, formed therewith.

The modular perimeter frame system 500 includes three superior radial sub-frames 504, three inferior radial sub-frames 506 and six non-perpendicularly interconnecting top hat sub-frames 508 which are preassembled before they arrive at the site of construction.

Figure 33:
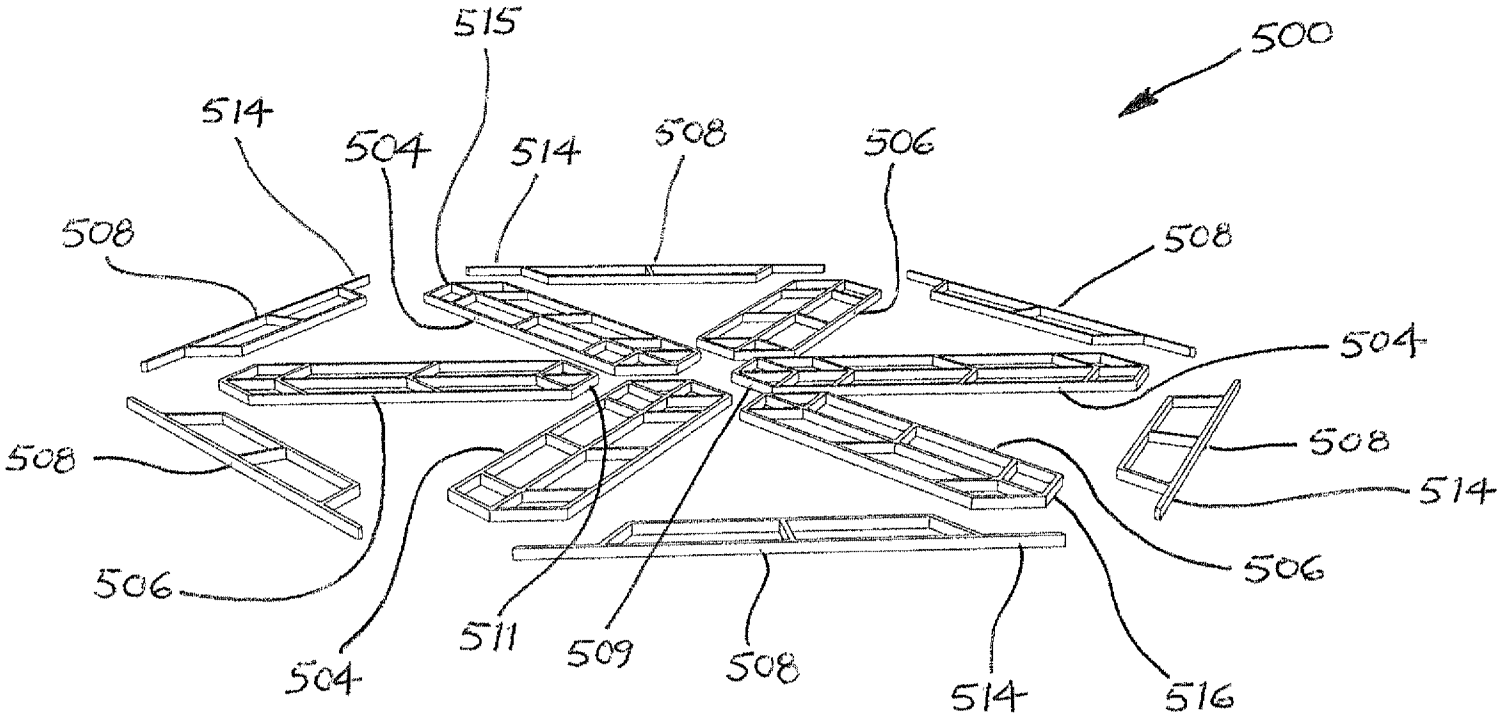
FIG. 33 is a perspective view of a seventh embodiment of a modular perimeter frame system according to the present invention, the system comprising three superior radial sub-frames, three inferior radial sub-frames and six non-perpendicularly interconnecting top hat sub-frames, located separately from each other and shown prior to being interconnected at their respective end portions to form a hexagonal shape perimeter frame for use in the construction of a floor and/or roof of a building.

As shown in FIG. 33, the perimeter sub-frame 501 is formed by locating the superior and inferior radial sub-frames 504, 506 at desired radially-centred, but spaced apart positions, and by locating the top hat sub-frames 508 at symmetrically spaced apart positions around a perimeter.

Each superior radial sub-frame 504 is located between a pair of inferior radial sub-frames 506, and vice versa, such that there is a 60° angle between the longitudinal axes of any two adjacent radial sub-frames 504, 506.

The innermost blunt end portions 509 of the superior radial sub-frames 504 are interconnected to define a primary hexagon structure 510 at the centre of the desired frame, and then each of the innermost blunt end portions 511 of the inferior radial sub-frames 506 are connected to a converging region of adjoining surfaces of each adjacent pair of superior radial sub-frames 504 to define a secondary hexagon structure 512 around the primary hexagon structure 510. This symmetrical arrangement at the centre of the desired frame provides the frame with strength and stability.

Figure 34:
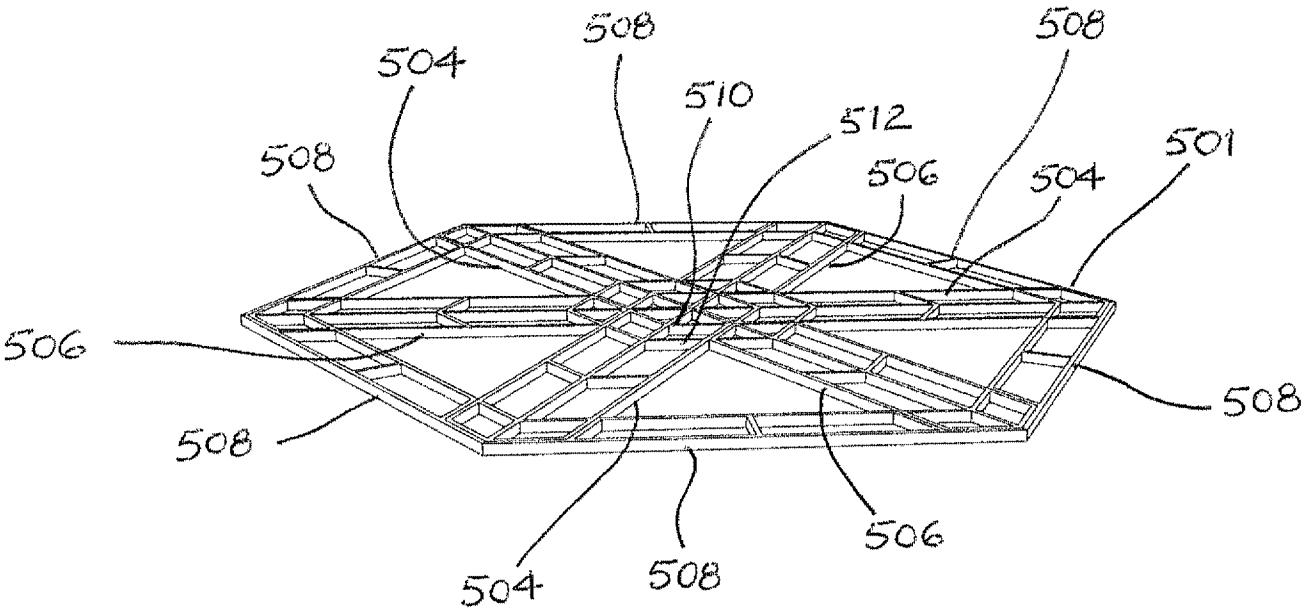
FIG. 34 is a perspective view of the perimeter frame formed by the interconnection of the sub-frames shown in FIG. 33.

The overhang end portions 514 of the top hat sub-frames 508 and the outermost blunt end portions 515, 516 of the superior and inferior radial sub-frames 504, 506 are then interconnected to define the six corners of the perimeter frame 501, as shown in FIG. 34.

Figure 35:
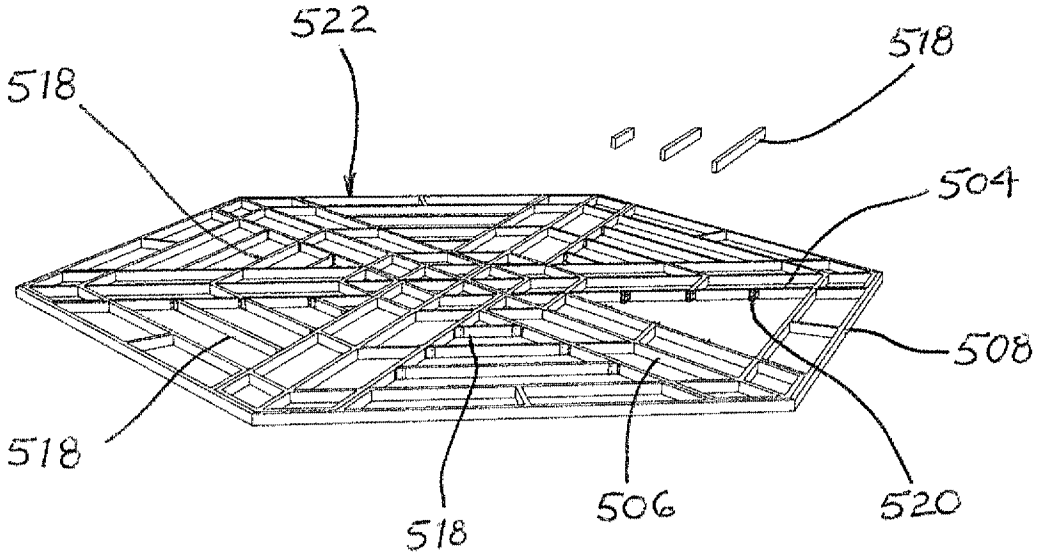
FIG. 35 is a perspective view of the perimeter frame shown in FIG. 34, with floor joists shown connected, or about to be connected, by brackets to internal beam members of the perimeter frame to form a floor frame 22.

FIG. 35 shows floor joists 518 connected, or about to be connected, to inner frame support brackets 520 which are secured to each radial sub-frame 504, 506, and thereby form a fully assembled floor frame 522.

Figure 36:
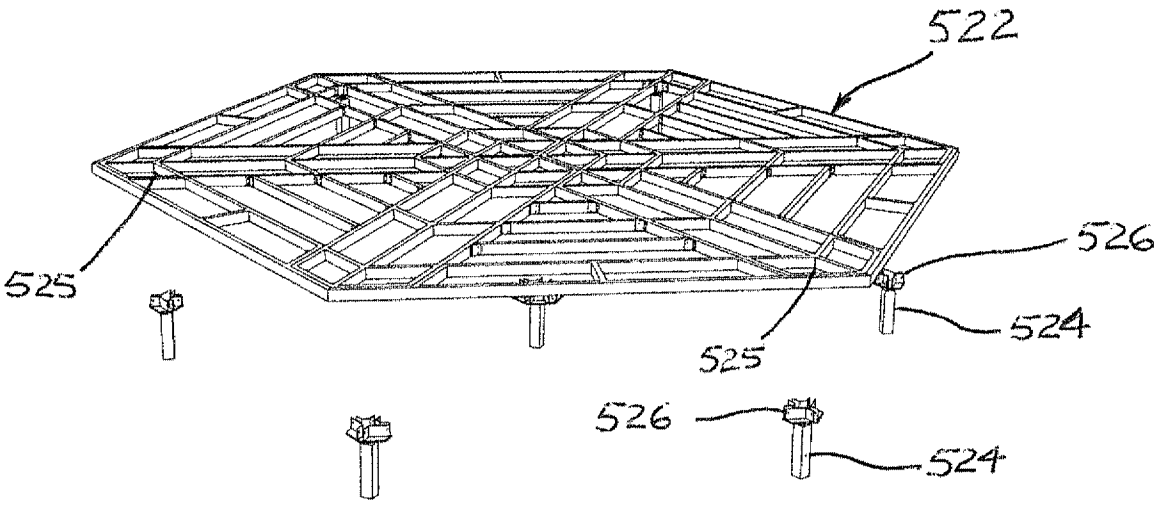
FIG. 36 is a perspective view of the floor frame shown in FIG. 35 about to be mounted on piers, as required for use of the floor frame in the construction of a floor.
Figure 37:
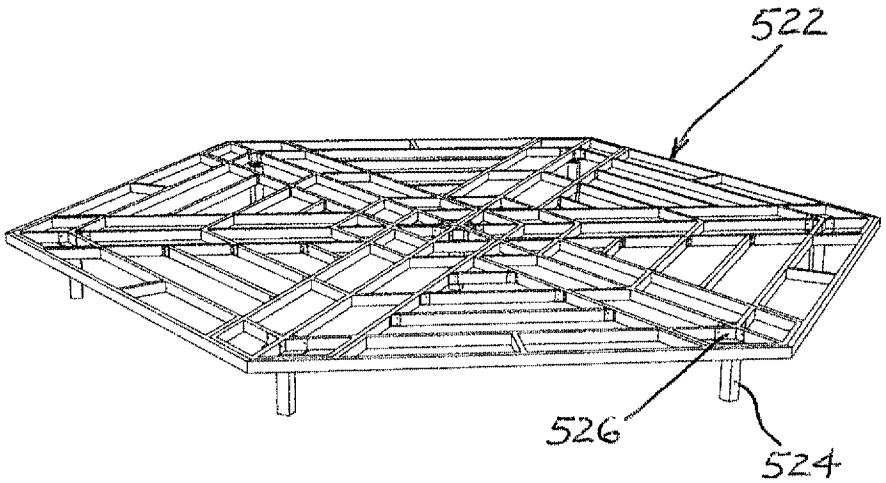
FIG. 37 is a perspective view of the floor frame shown in FIG. 36 mounted on piers.

The floor frame 522 shown in FIG. 36 is mounted on piers 524. There are six piers which include suitable attachment brackets 526 at the top for enabling the piers 524 to engage the internal frame regions 525 of the radial sub-frames 504, 506. Once the piers 524 are engaged to the floor frame 522, as shown in FIG. 37, corner posts 528 for supporting walls and a roof can then be secured in place.

Figure 38:
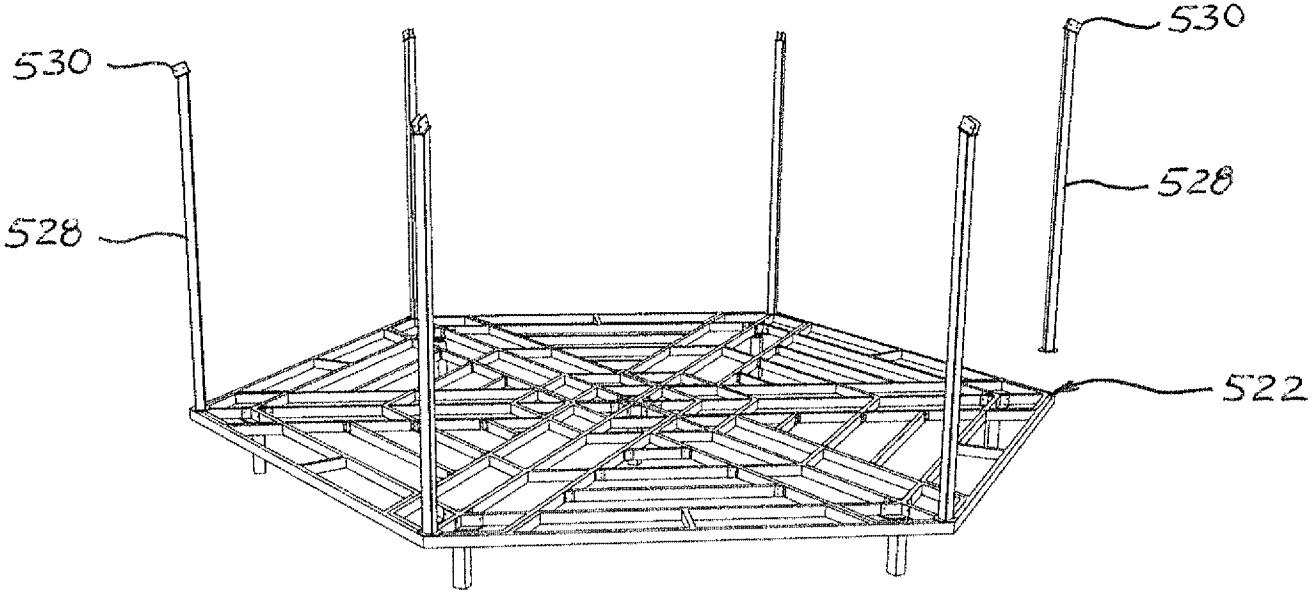
FIG. 38 is a perspective view of the floor frame and piers shown in FIG. 37, with corner posts shown connected, or about to be connected, to each corner of the floor frame, and with post top brackets connected to the top of the corner posts.

FIG. 38 shows corner posts 528 connected, or about to be connected, to each corner of the floor frame 522. Each corner post 528 includes top brackets 530 for securing a roof thereto. The top brackets 530 include a main plate and upper cleats which are angularly configured to accommodate a desired angle of inclination of a hexagonal roof, whether such a roof is flat or hipped.

Figure 39:
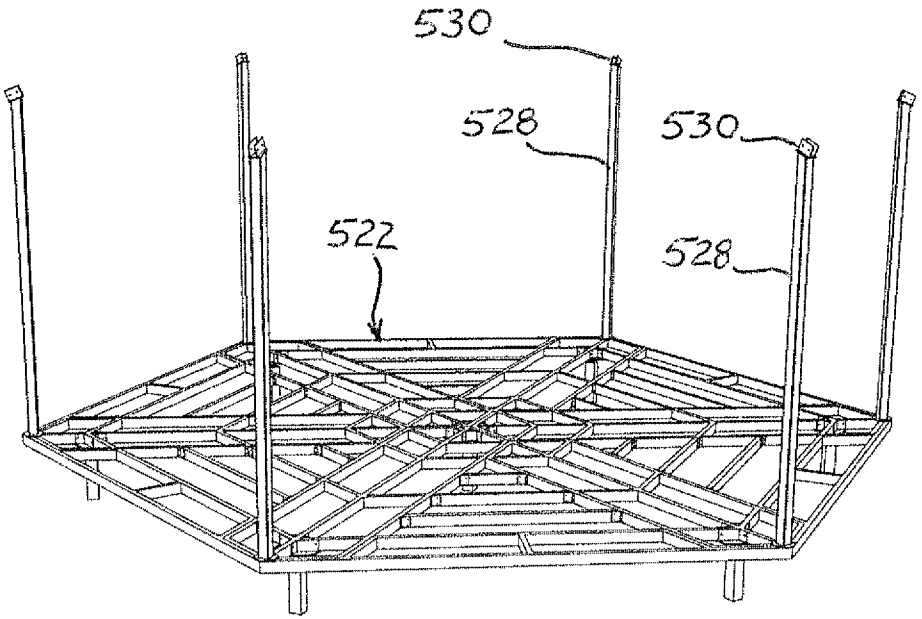
FIG. 39 is a perspective view of the floor frame and piers shown in FIG. 38, with corner posts shown connected to each corner of the floor frame.
Figure 40:
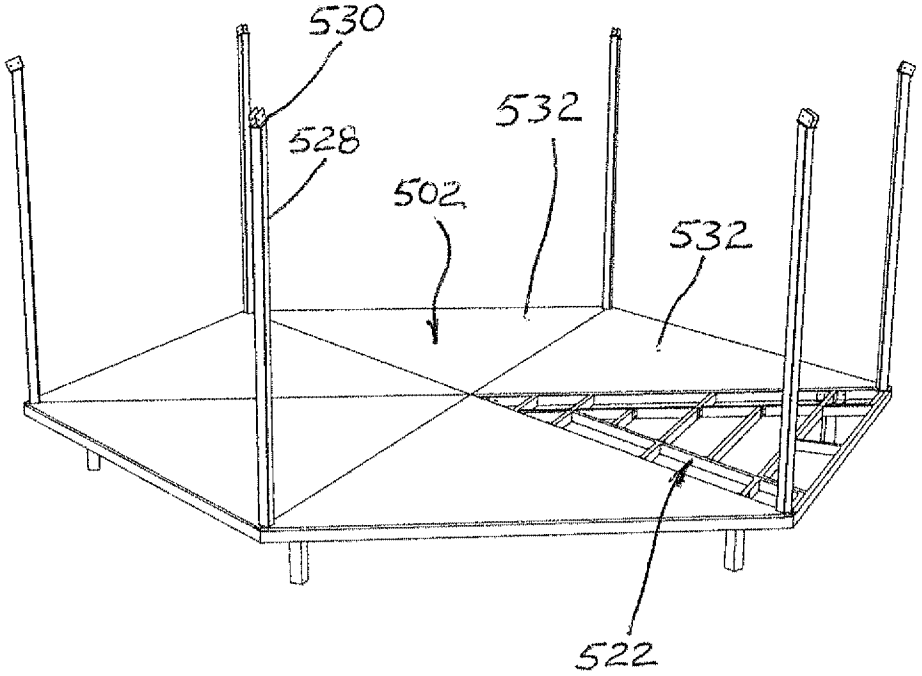
FIG. 40 is a perspective view of the floor frame and piers shown in FIG. 39, with sheet flooring shown connected to the floor frame to partially form a floor mounted on the piers.

Once the corner posts 528 are engaged to the floor frame 522, as shown in FIG. 39, sheet flooring 532 is then laid over the floor frame, as shown in FIG. 40, and secured in place in the normal manner, to form a floor 502.

Figure 41:
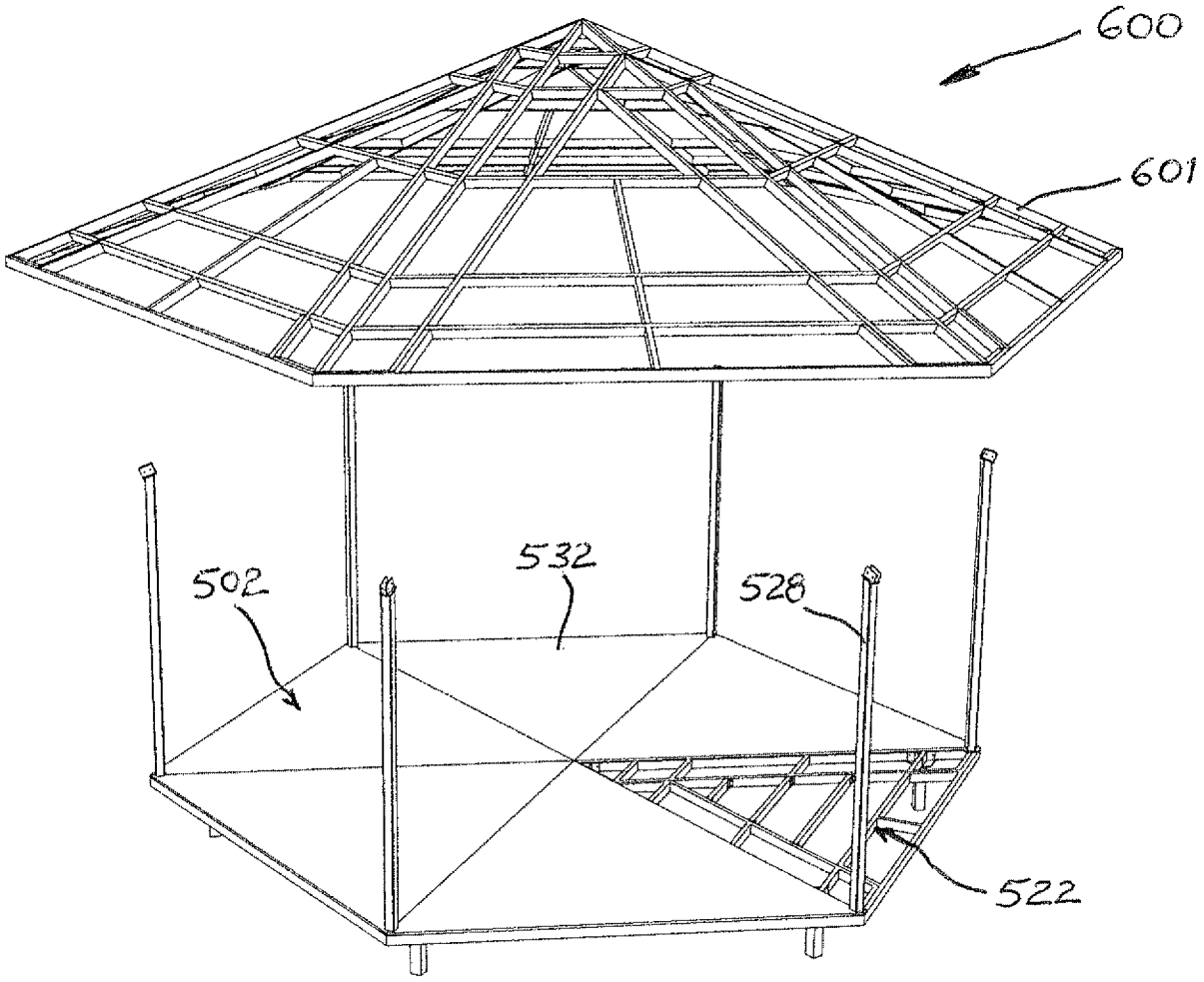
FIG. 41 is a perspective view of the floor and piers shown in FIG. 40, and of a hexagonally hipped roof frame formed from a modular perimeter frame system according to an eighth embodiment of the present invention, the roof frame being shown prior to being mounted on the corner posts.

FIG. 41 shows a hexagonally hipped roof frame 601 formed from a modular perimeter frame system 600, the roof frame being shown prior to being mounted on the corner posts 528 so that it can be used in the construction of a roof 602 of a building.

Unless otherwise stated, the structure and function of both the modular perimeter frame system 600 and the hexagonally hipped roof frame 601 formed with that system are substantially similar to, or would be readily understood from a comparison with, the above described structure and function of the modular perimeter frame systems 10, 70, 100, 200, 300, 400, 500 and the frames 11, 72, 101, 202, 301, 401, 501, respectively, formed therewith.

The components of the hexagonally hipped roof frame 601 and the process by which it is formed will be described later by reference to the accompanying drawings of FIGS. 45 to 52, which show a similar roof frame.

Figure 42:
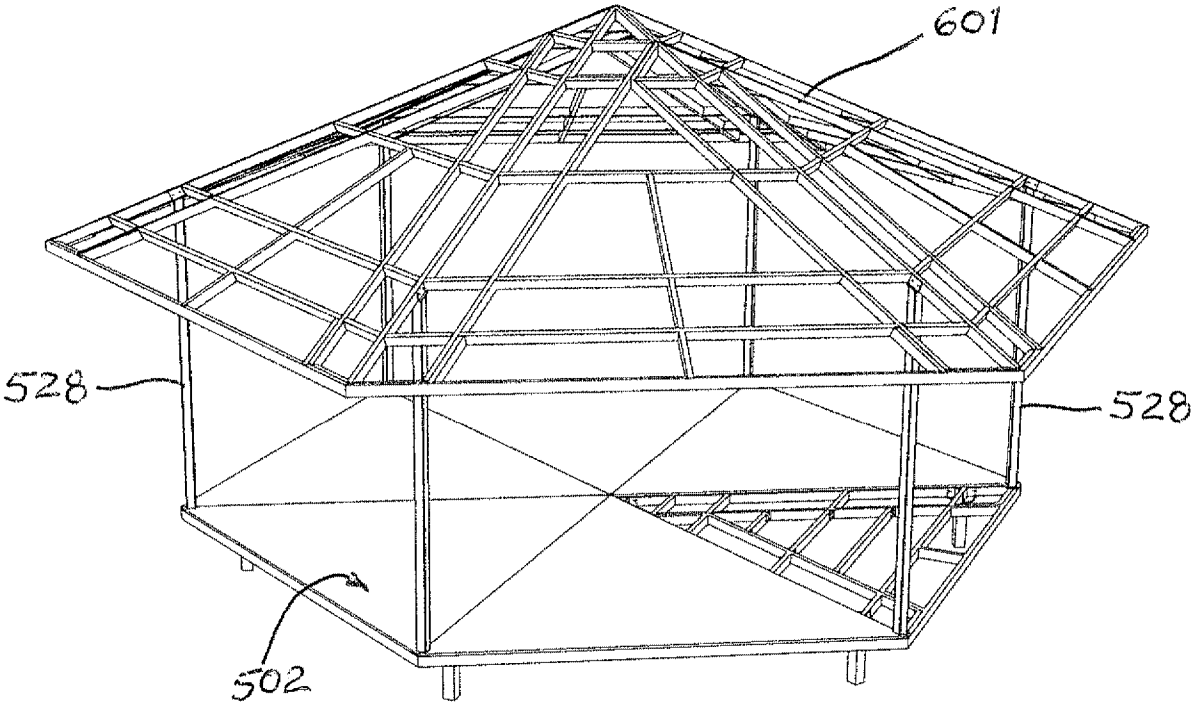
FIG. 42 is a perspective view of the floor, piers and hexagonally hipped roof frame shown in FIG. 41, with the roof frame shown mounted on the corner posts.

As shown in FIG. 42, the hexagonally hipped roof frame 601 is lowered and then secured onto the corner posts 528.

Figure 43:
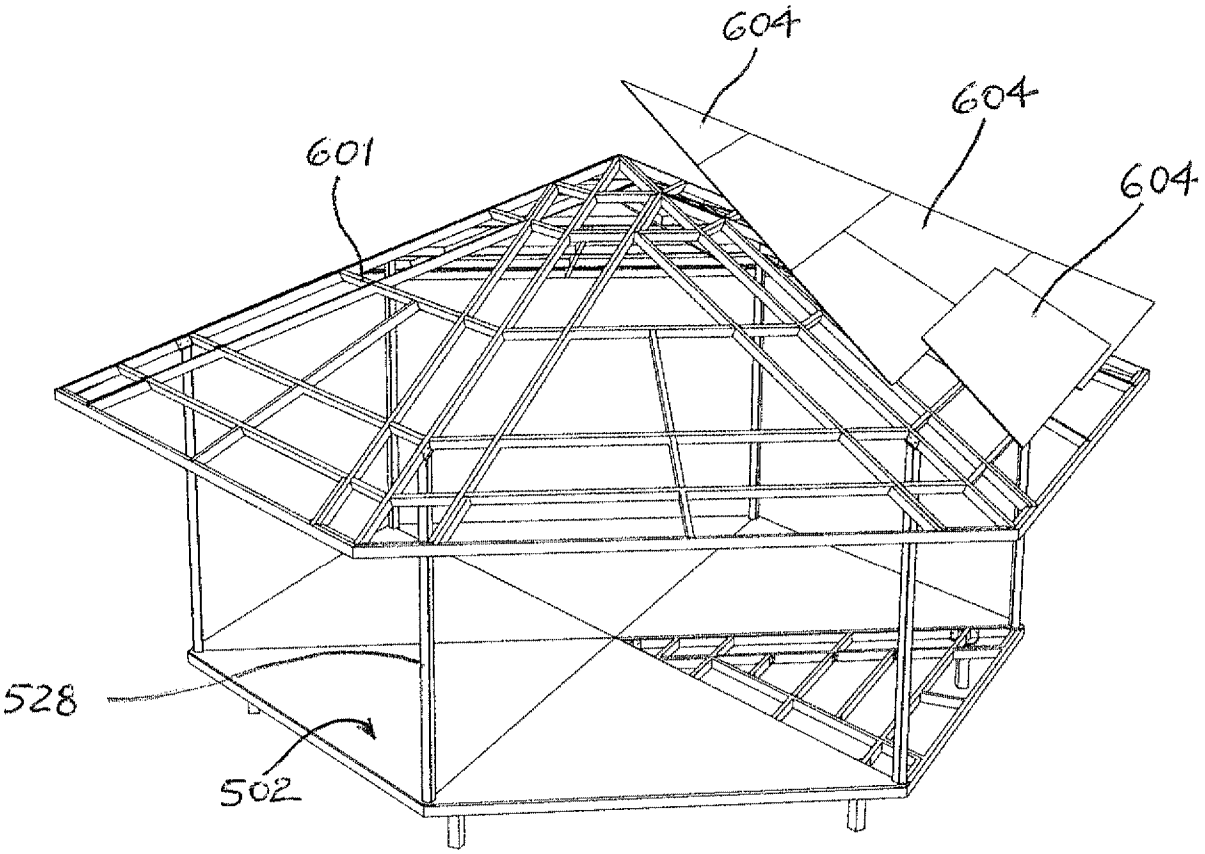
FIG. 43 is a perspective view of the floor, piers and hexagonally hipped roof frame shown in FIG. 42, with flat roof sheeting shown about to be connected to the roof frame.
Figure 44:
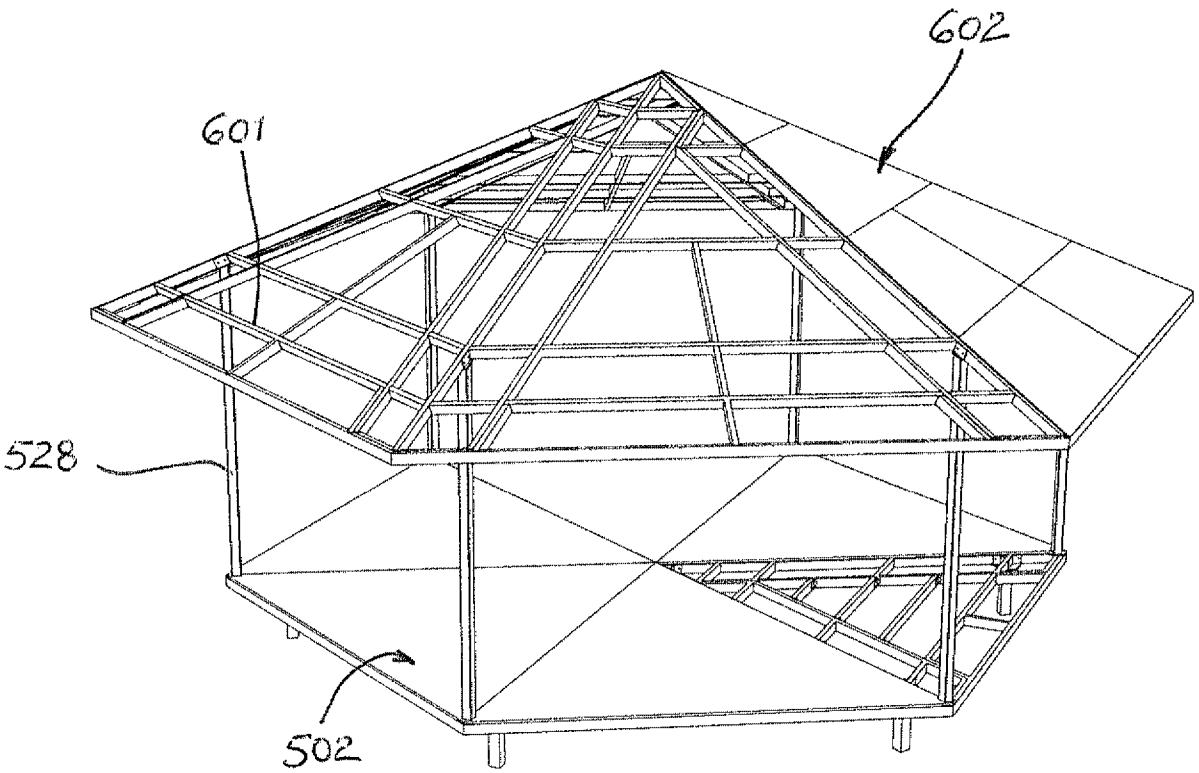
FIG. 44 is a perspective view of the floor, piers and roof frame shown in FIG. 43, with the flat roof sheeting shown connected to the roof frame to partially form a roof.

A roof 602 is formed by laying a plurality of corrugated roof sheeting 604 onto the roof frame 601 and securing the roof sheeting to the frame members in the usual manner, as shown in FIGS. 43 and 44.

Figure 46:
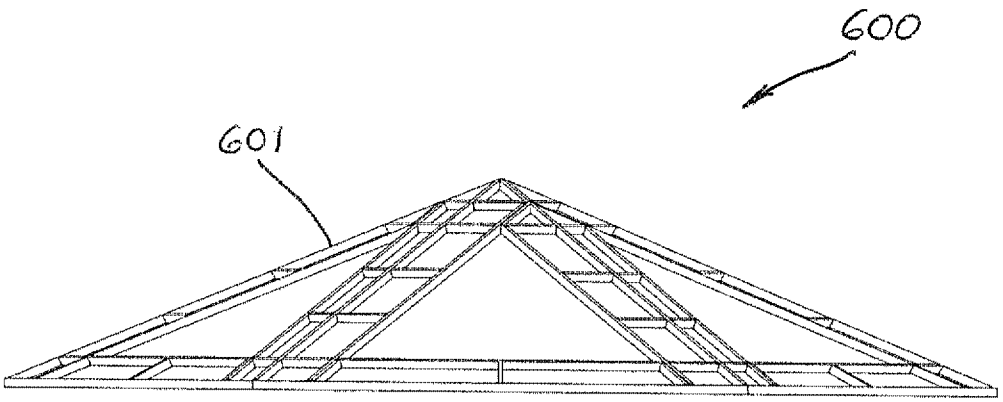
FIG. 46 is a front view of the hexagonally hipped roof frame shown in FIG. 45.
Figure 47:
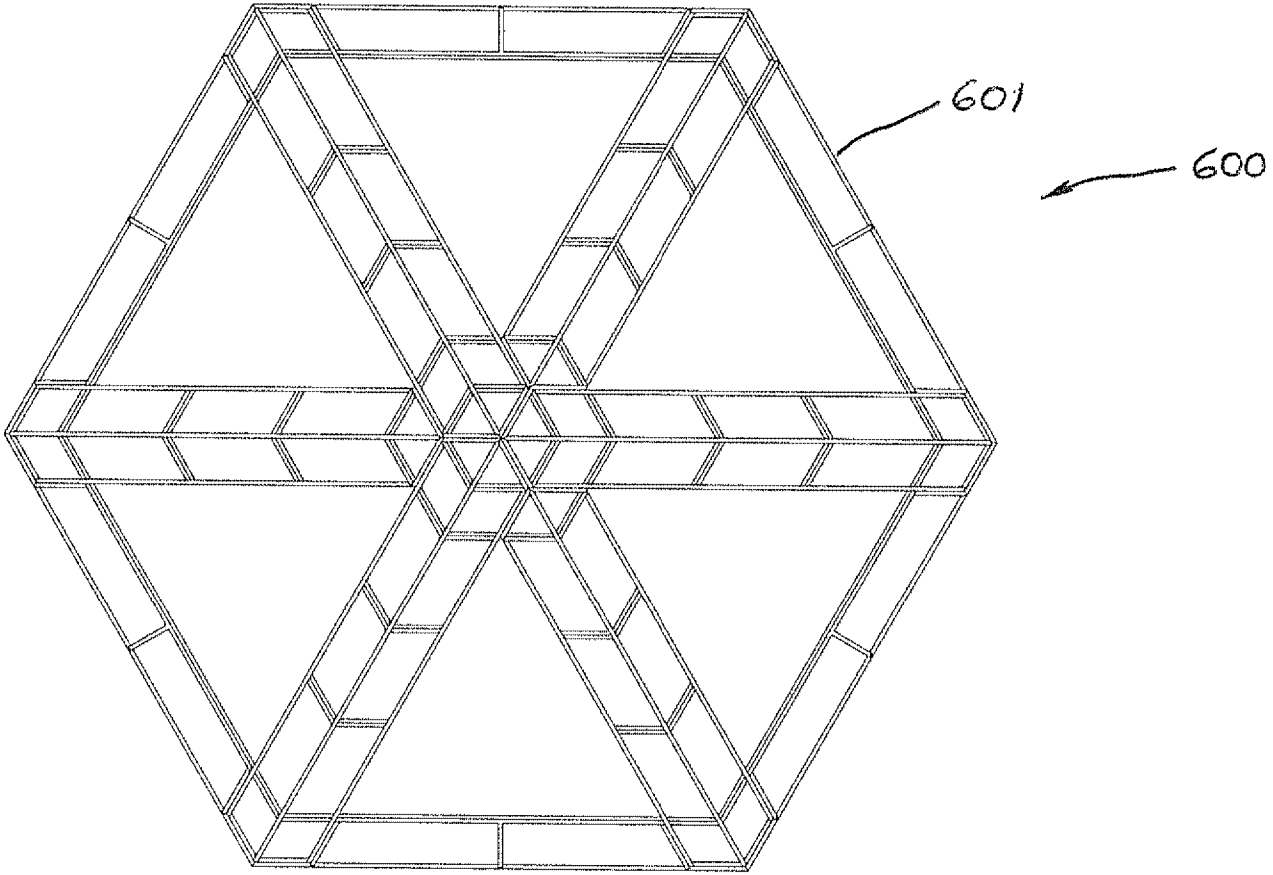
FIG. 47 is a plan view of the hexagonally hipped roof frame shown in FIG. 45.
Figure 48:
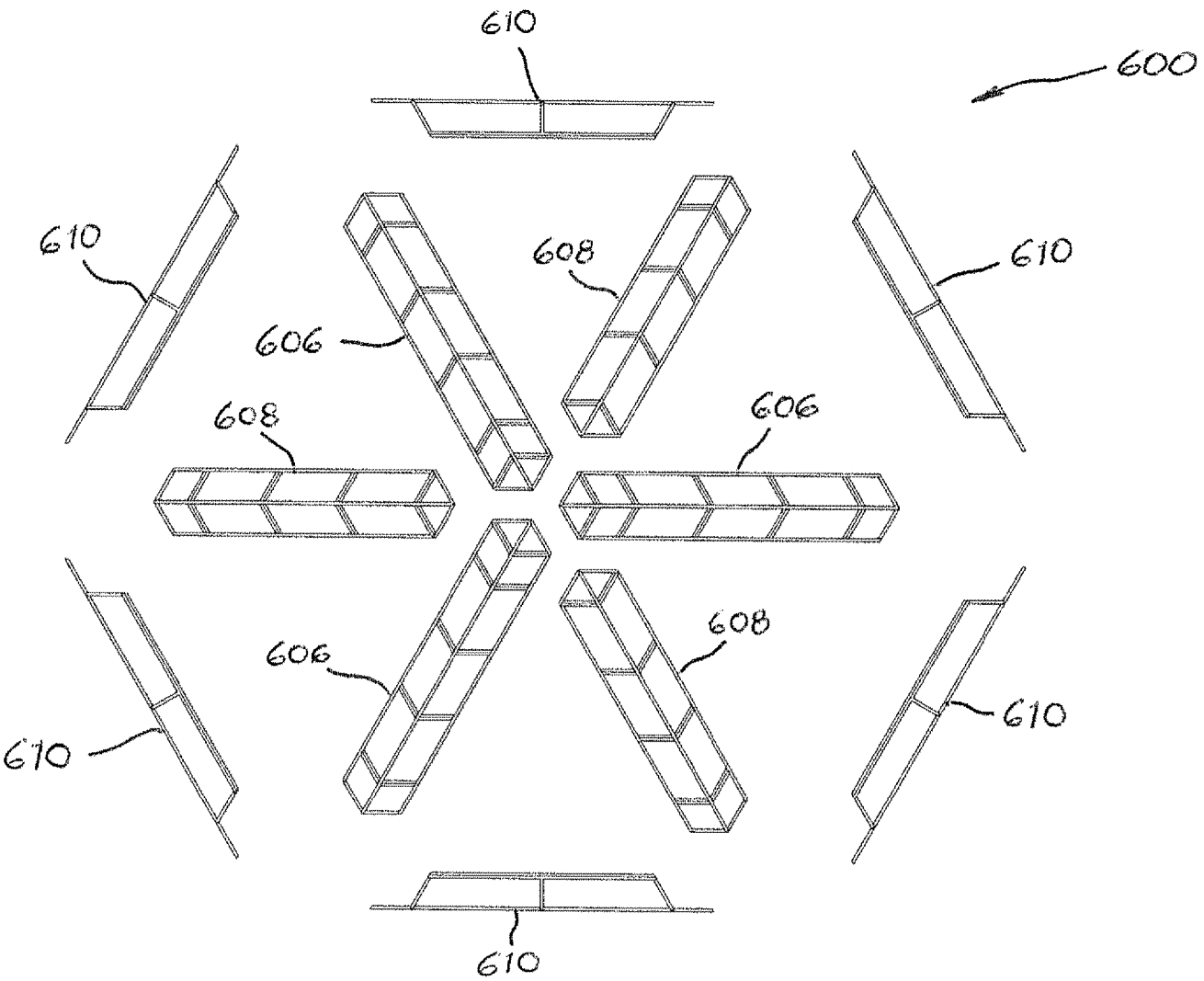
FIG. 48 is a plan view of the three superior hip radial sub-frames, three inferior hip radial sub-frames and six non-perpendicularly interconnecting top hat sub-frames located separately from each other and shown prior to being interconnected to form the roof frame shown in FIG. 45.
Figures 4, 5, 6, 7, 8, 9:
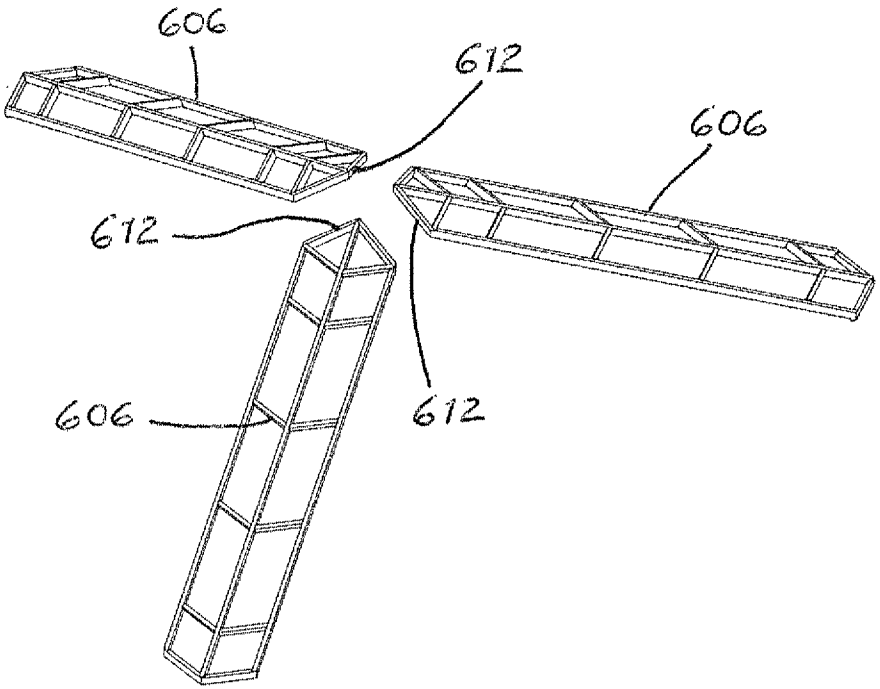
Figure 50:
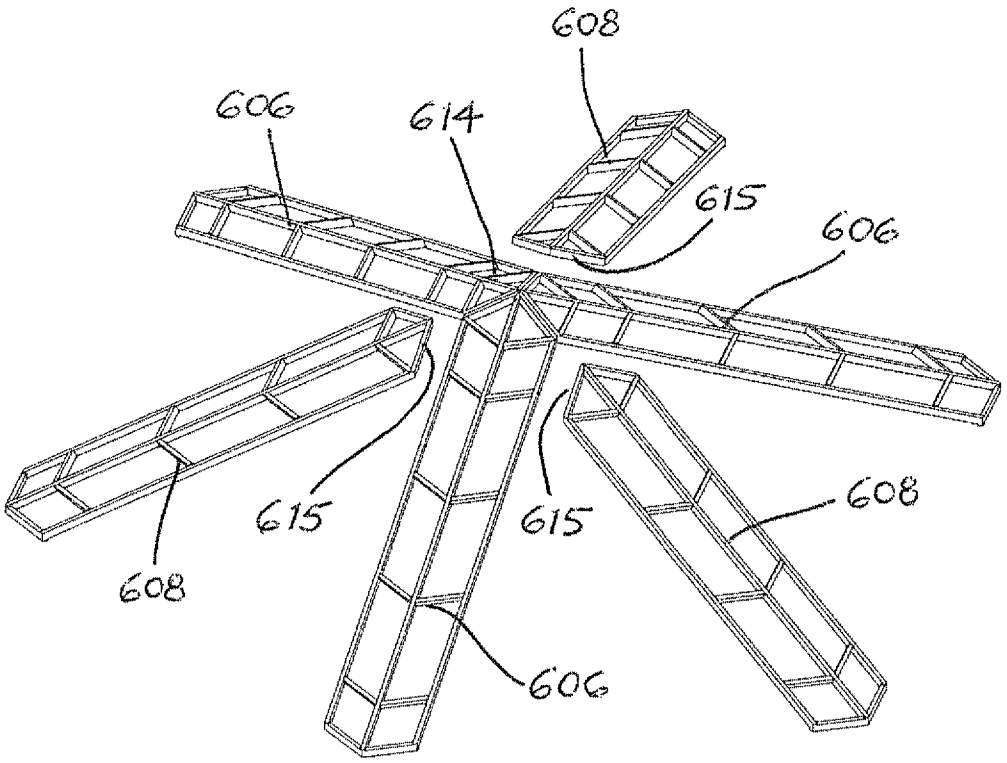
FIG. 50 is a perspective view of the three superior hip radial sub-frames of FIG. 49 shown interconnected with each other, and about to be further interconnected with the three inferior hip radial sub-frames shown in FIG. 48 in a second step of a process for forming the hexagonally hipped roof frame of FIG. 45.
Figure 51:
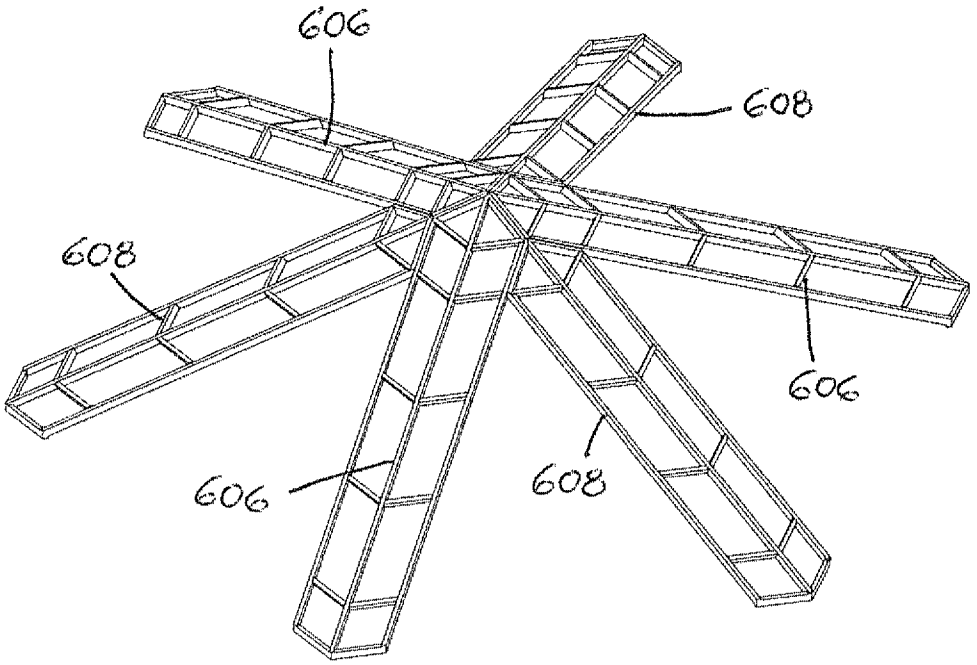
FIG. 51 is a perspective view of the three superior hip radial sub-frames and the three inferior hip radial sub-frames shown in FIG. 50 all interconnected with each other.
Figure 52:
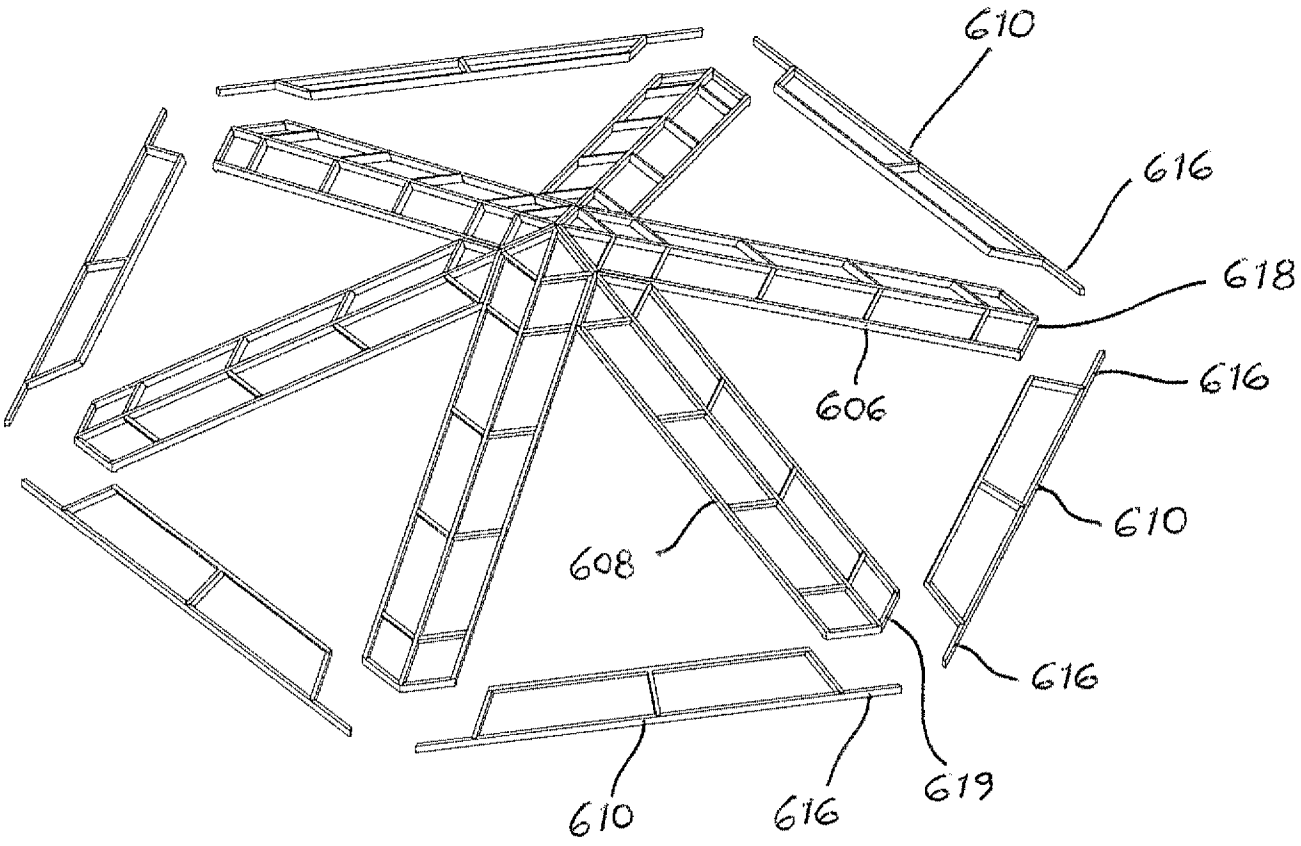
FIG. 52 is a perspective view of the interconnected superior and inferior hip radial sub-frames of FIG. 51 about to be further interconnected with the six non-perpendicularly interconnecting top hat sub-frames in a third step of a process for forming the hexagonally hipped roof frame of FIG. 45.
Figure 53:
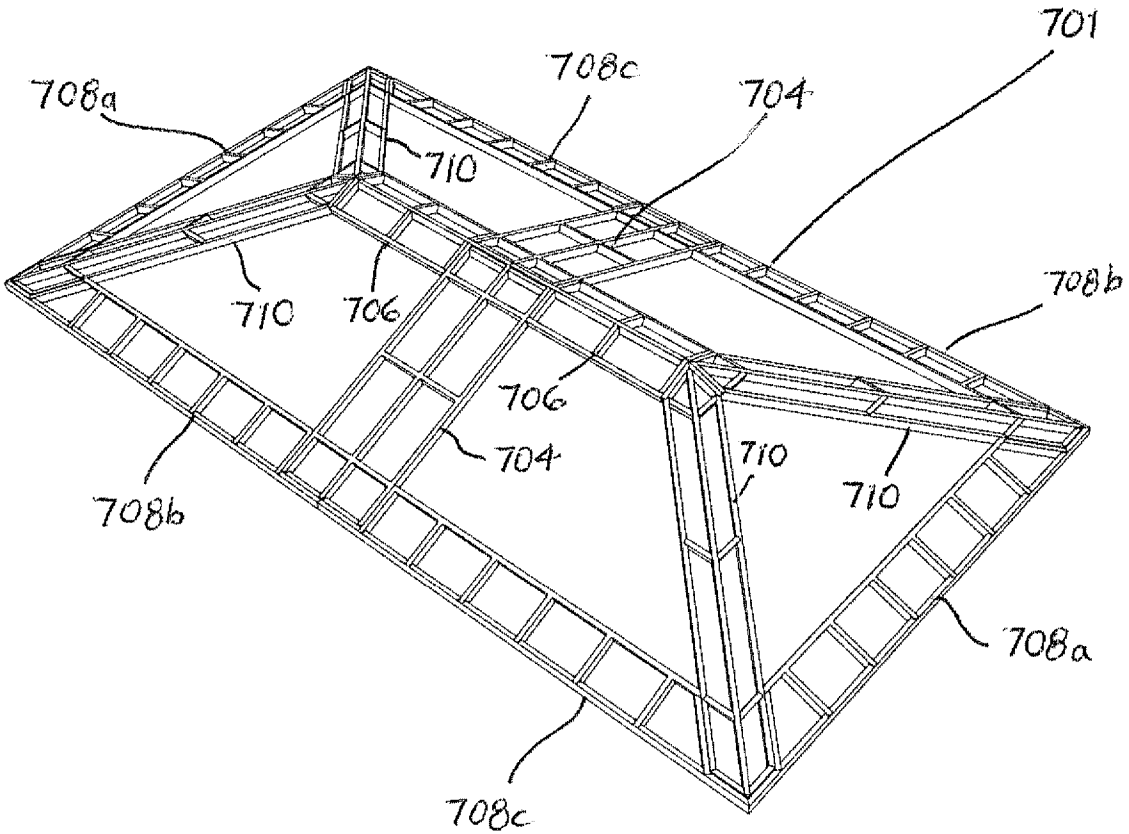
FIG. 53 is a perspective view of a rectangular hipped roof frame formed from a modular perimeter frame system according to a ninth embodiment of the present invention, the system comprising a plurality of sub-frames which are shown after they have been interconnected to form the roof frame for use in the construction of a roof of a building.
Figure 54:
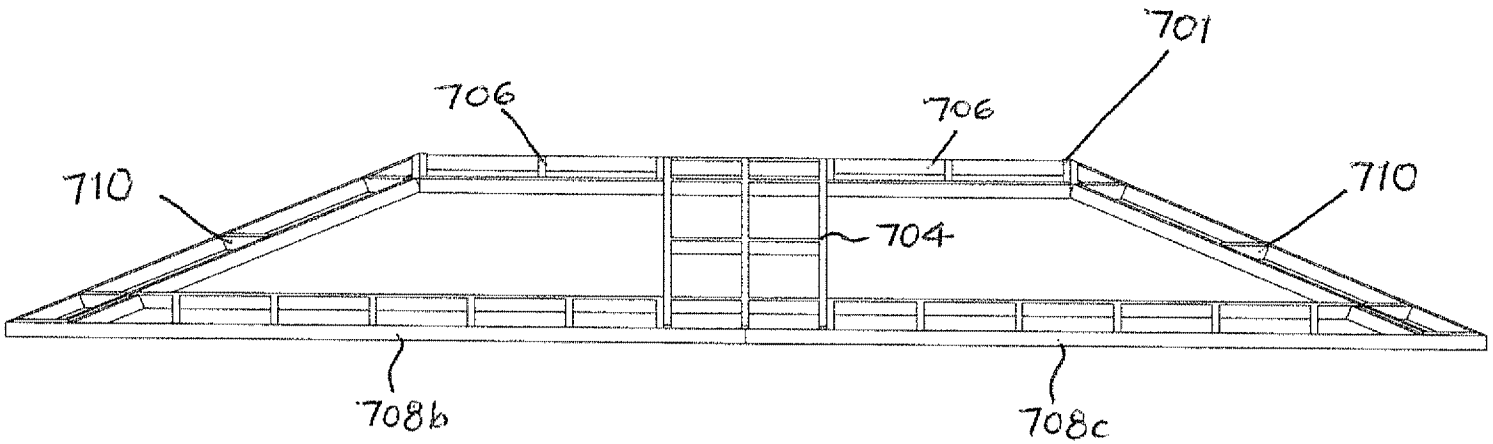
FIG. 54 is a front view of the rectangular hipped roof frame shown in FIG. 53.
Figure 55:
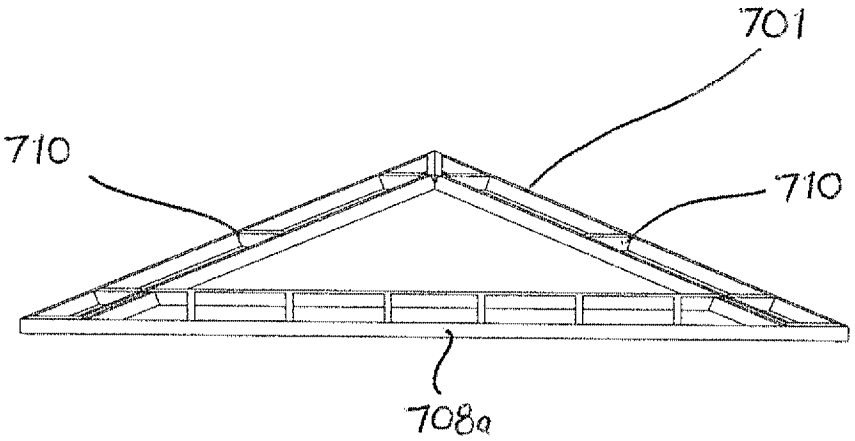
FIG. 55 is a side view of the rectangular hipped roof frame shown in FIG. 53.
Figure 56:
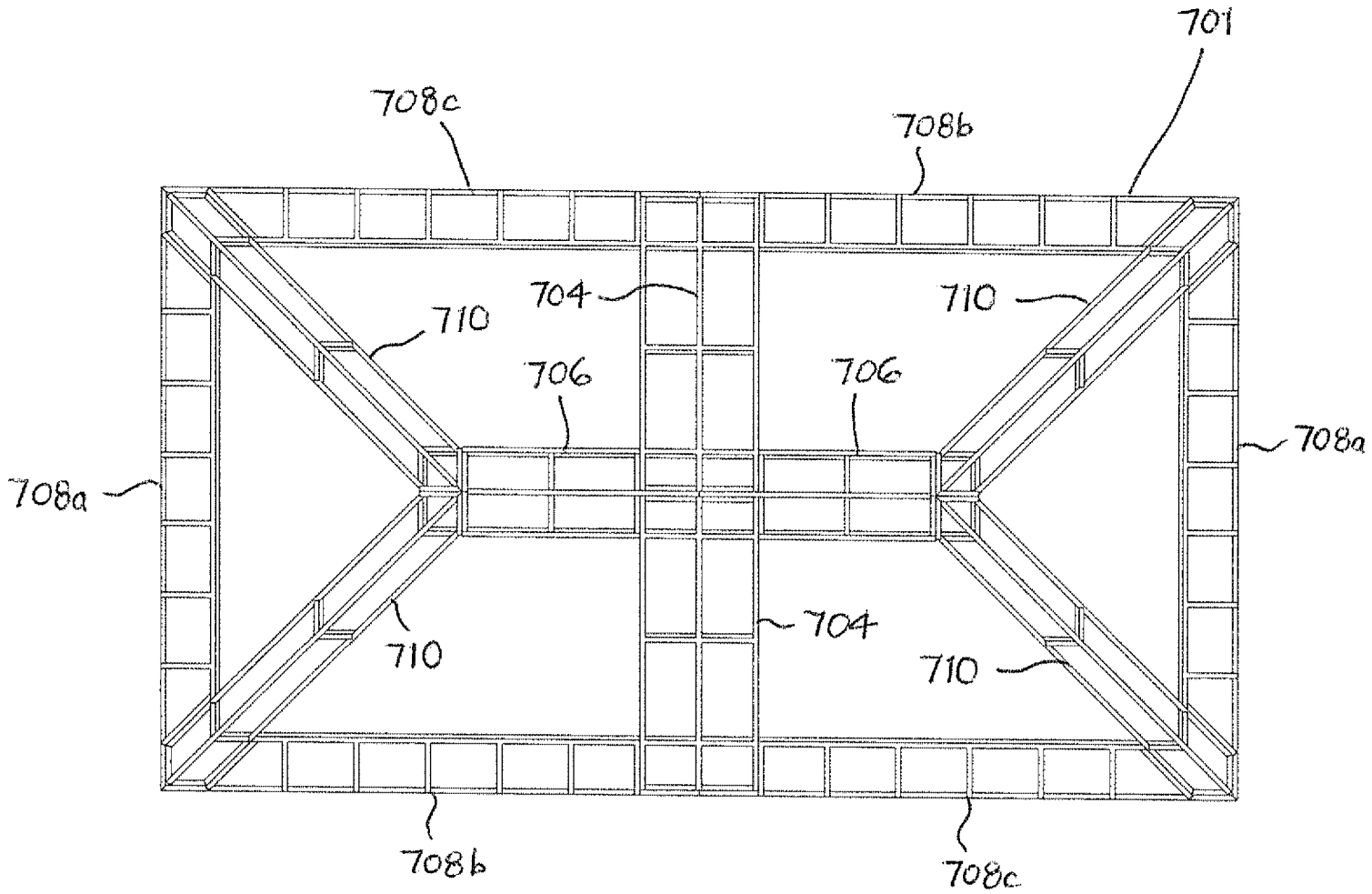
FIG. 56 is a plan view of the rectangular hipped roof frame shown in FIG. 53.

Turning now to FIGS. 45 to 52 which show a similar hexagonally hipped roof frame 601 in greater detail, FIG. 48 shows that the modular perimeter frame system 600 for forming the roof frame 601 includes three superior hip radial sub-frames 606, three inferior hip radial sub-frames 608 and six non-perpendicularly interconnecting top hat sub-frames 610 which are preassembled before they arrive at the site of construction.

The superior and inferior hip radial sub-frames 606, 608 are located at desired radially-centred, but spaced apart positions, and the top hat sub-frames 610 are located at symmetrically spaced apart positions around a perimeter.

Each superior hip radial sub-frame 606 is located between a pair of inferior hip radial sub-frames 608, and vice versa, such that there is a 60° angle between the longitudinal axes of any two adjacent hip radial sub-frames 606, 608.

Figure 45:
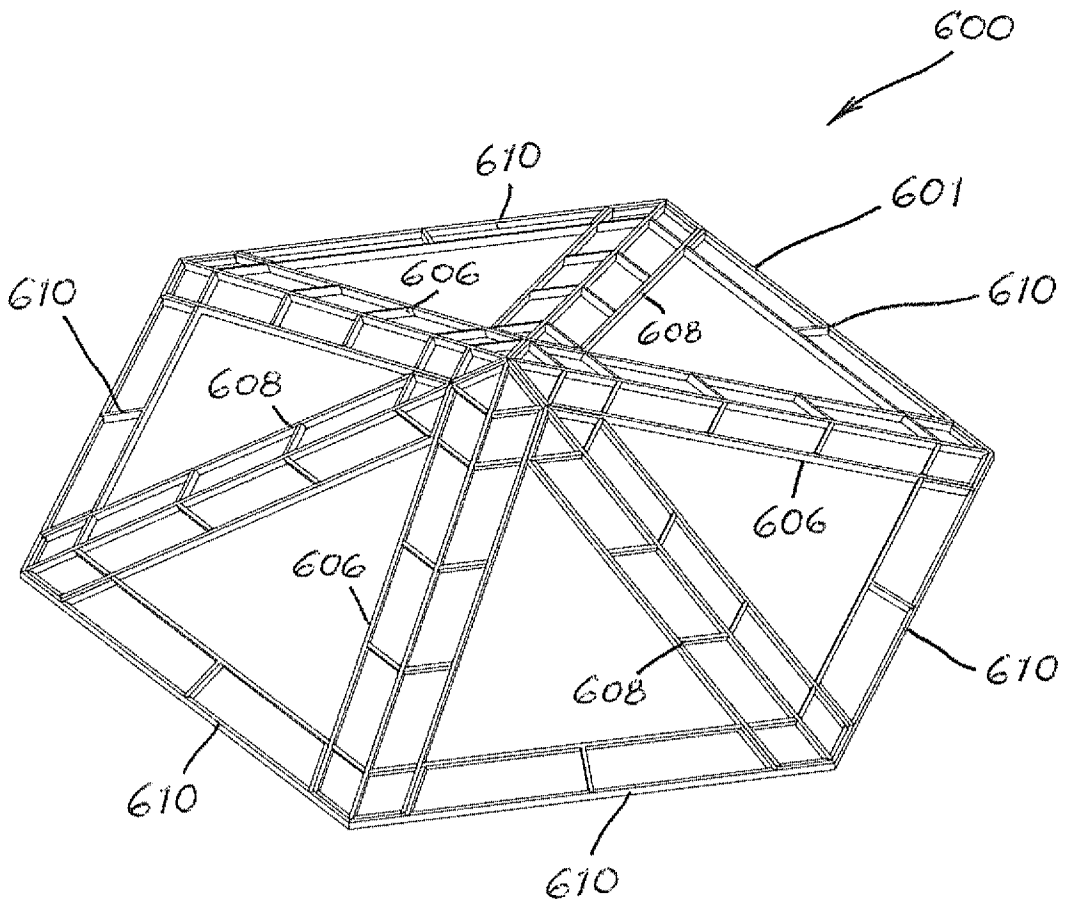
FIG. 45 is a perspective view of a hexagonally hipped roof frame which is similar to the hexagonally hipped roof frame shown in FIG. 41, the roof frame comprising three superior hip radial sub-frames, three inferior hip radial sub-frames and six non-perpendicularly interconnecting top hat sub-frames which are shown after they have been interconnected to form the roof frame for use in the construction of a roof of a building.

FIGS. 49 to 52 show a process of interconnecting the sub-frames to form the roof frame 601 shown in FIGS. 45 to 47.

The innermost blunt end portions 612 of the superior hip radial sub-frames 606 are interconnected (see FIGS. 49 and 50) to define a hexagonal pyramid structure 614 at the centre of the desired frame, and then each of the innermost blunt end portions 615 of the inferior hip radial sub-frames 608 are connected (see FIGS. 50 and 51) to a converging region of adjoining surfaces of each adjacent pair of superior hip radial sub-frames 606.

The overhang end portions 616 of the top hat sub-frames 610 and the outermost blunt end portions 618, 619 of the superior and inferior hip radial sub-frames 606, 608 are then interconnected (see FIGS. 52 and 47) to define the six corners and the six hips of the roof frame 601, as shown in FIGS. 45 to 47.

FIGS. 53 to 58 show a rectangular hipped roof frame 701 formed from a modular perimeter frame system 700 according to another embodiment of the present invention. The roof frame 701 is used in the construction of a roof of a building.

Unless otherwise stated, the structure and function of both the modular perimeter frame system 700 and the rectangular hipped roof frame 701 formed with that system are substantially similar to, or would be readily understood from a comparison with, the above described structure and function of the modular perimeter frame systems 10, 70, 100, 200, 300, 400, 500, 600 and the frames 11, 72, 101, 202, 301, 401, 501, 601, respectively, formed therewith.

Figure 57:
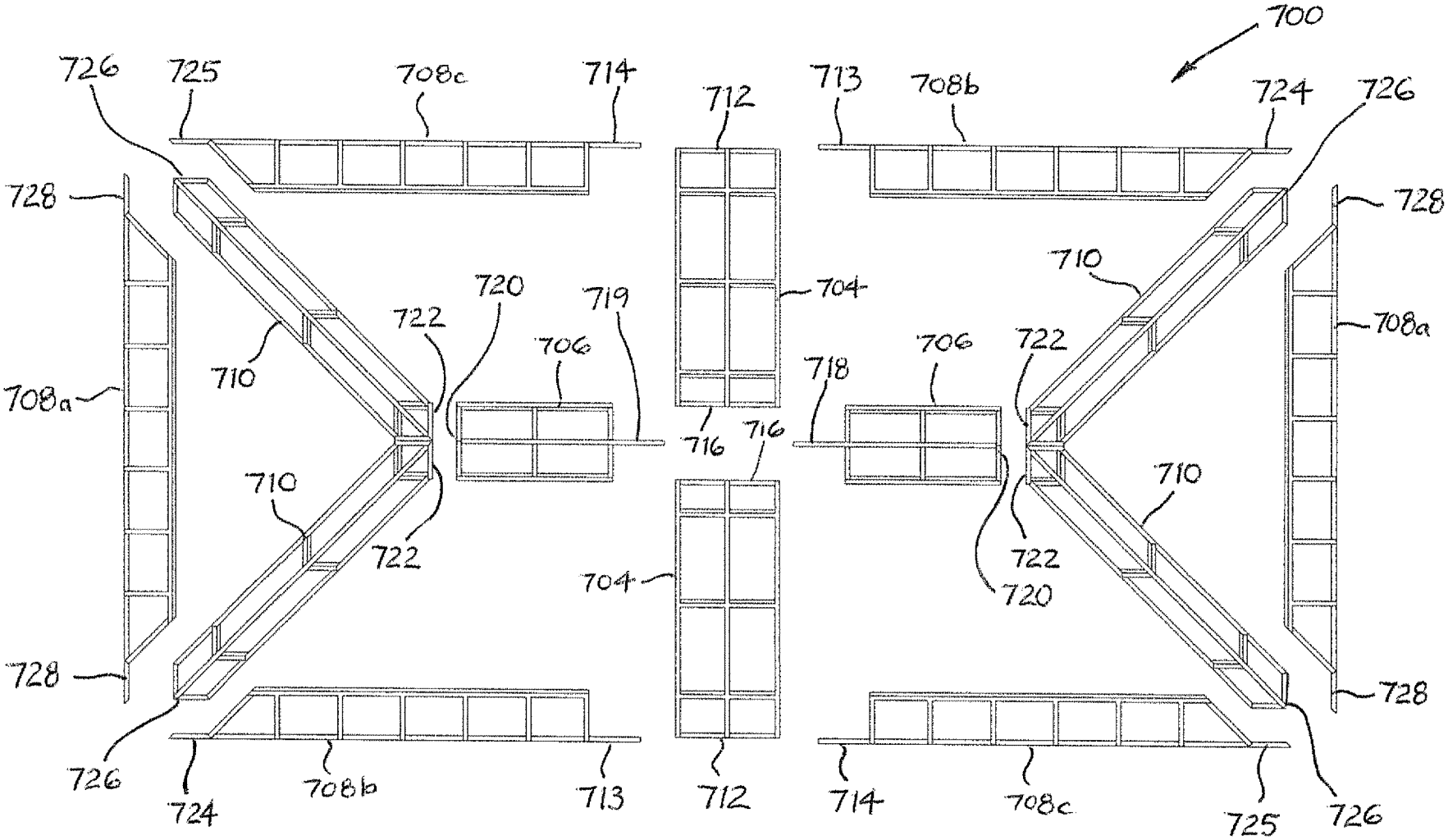
FIG. 57 is a plan view of a plurality of sub-frames located separately from each other and shown prior to being interconnected to form the rectangular hipped roof frame shown in FIG. 53.
Figure 58:
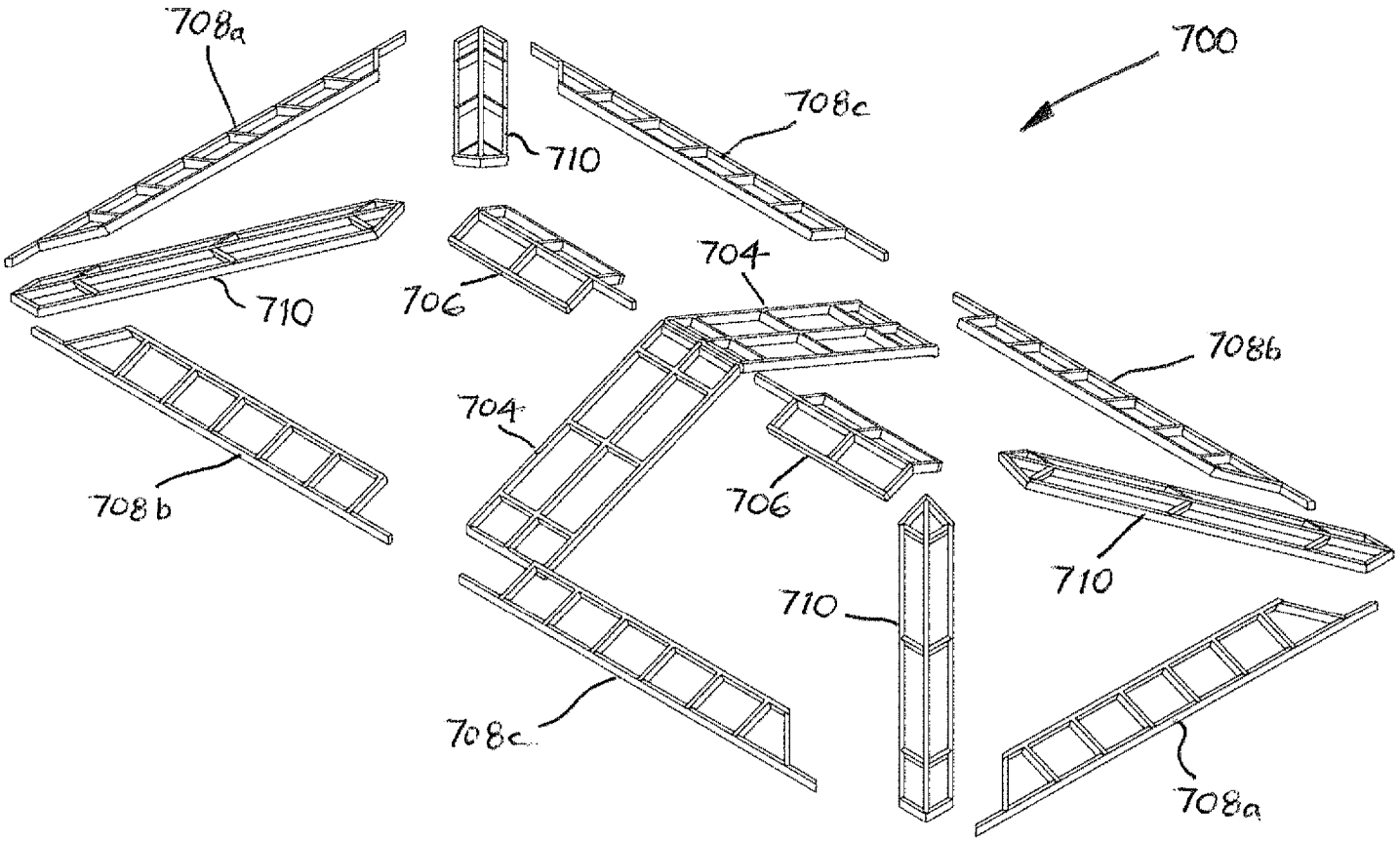
FIG. 58 is a perspective view of the plurality of sub-frames shown in FIG. 57.

As best shown in FIGS. 57 and 58, the modular perimeter frame system 700 includes two bridging twin sub-frames 704, two ridge sub-frames 706, six non-perpendicularly interconnecting top hat sub-frames 708*a* to 708*c*, and four hip sub-frames 710 which are preassembled before they arrive at the site of construction.

As shown in FIGS. 53 to 56, a lowermost blunt end portion 712 of each bridging twin sub-frame 704 is connected perpendicularly to overhang end portions 713, 714 of a respective top hat sub-frame 708*b*, 708*c*. The uppermost blunt end portion 716 of each bridging twin sub-frame 704 is connected perpendicularly to respective opposite sides of overhang end portions 718, 719 of ridge sub-frames 706. In each ridge sub-frame 706, a blunt end portion 720 is at the opposite end to that of the overhang end portion 718, 719. The uppermost blunt end portions 722 of each adjoining pair of hip sub-frames 710 are connected to the blunt end portion 720 of a respective ridge sub-frame 706.

The other overhang end portions 724, 725 of the top hat sub-frames 708*b*, 708*c*, respectively, are each connected non-perpendicularly to the lowermost blunt end portion 726 of hip sub-frame 710. The lowermost blunt end portion 726 of each hip sub-frame 710 is also connected non-perpendicularly to a respective one of the two overhang end portions 728 of top hat sub-frame 708*a*.

Figure 59:
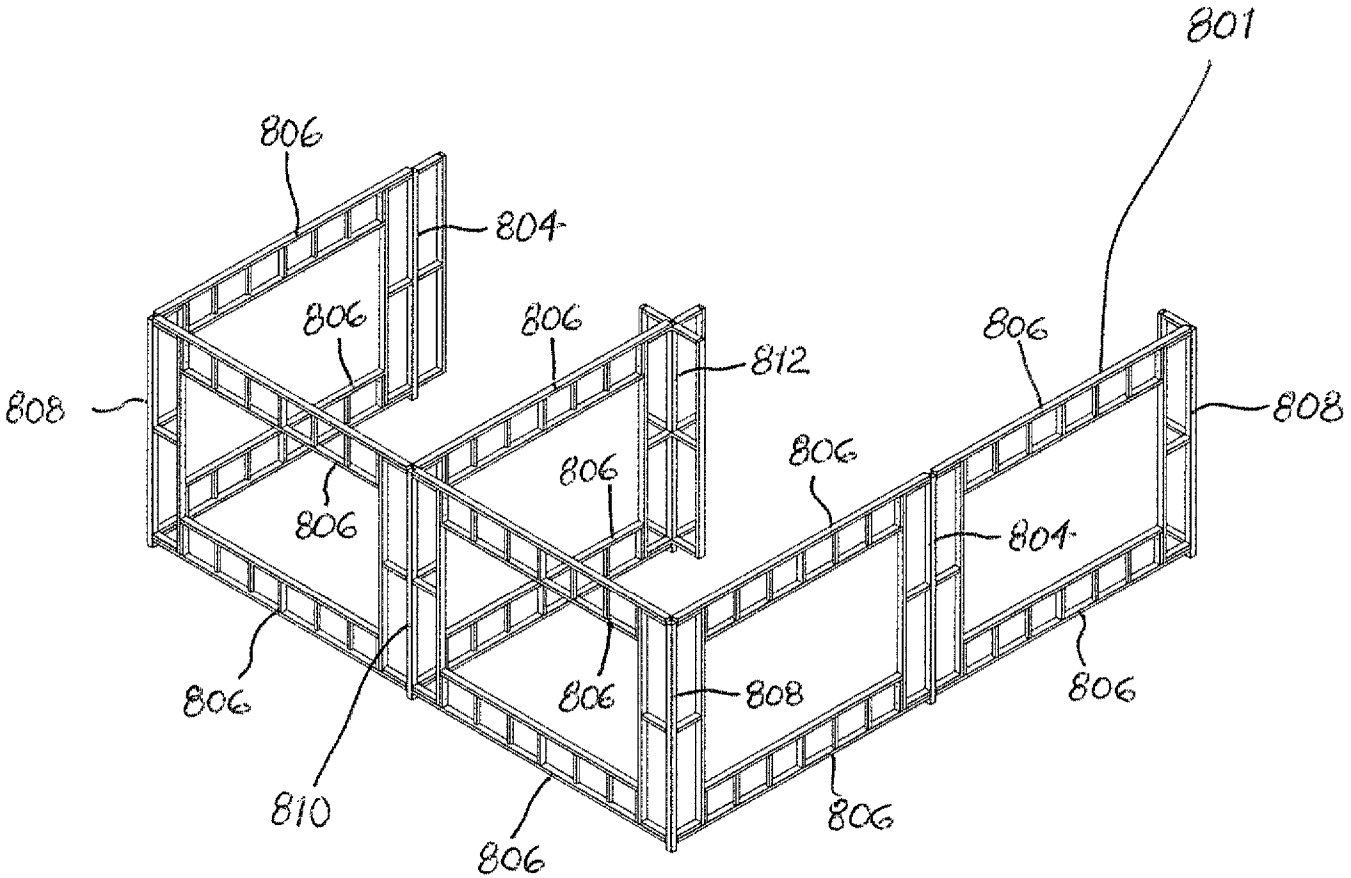
FIG. 59 is a perspective view of a multi-room wall frame formed from a modular perimeter frame system according to a tenth embodiment of the present invention, the system comprising a plurality of sub-frames which are shown after they have been interconnected to form the wall frame for use in the construction of walls of a building.
Figure 60:
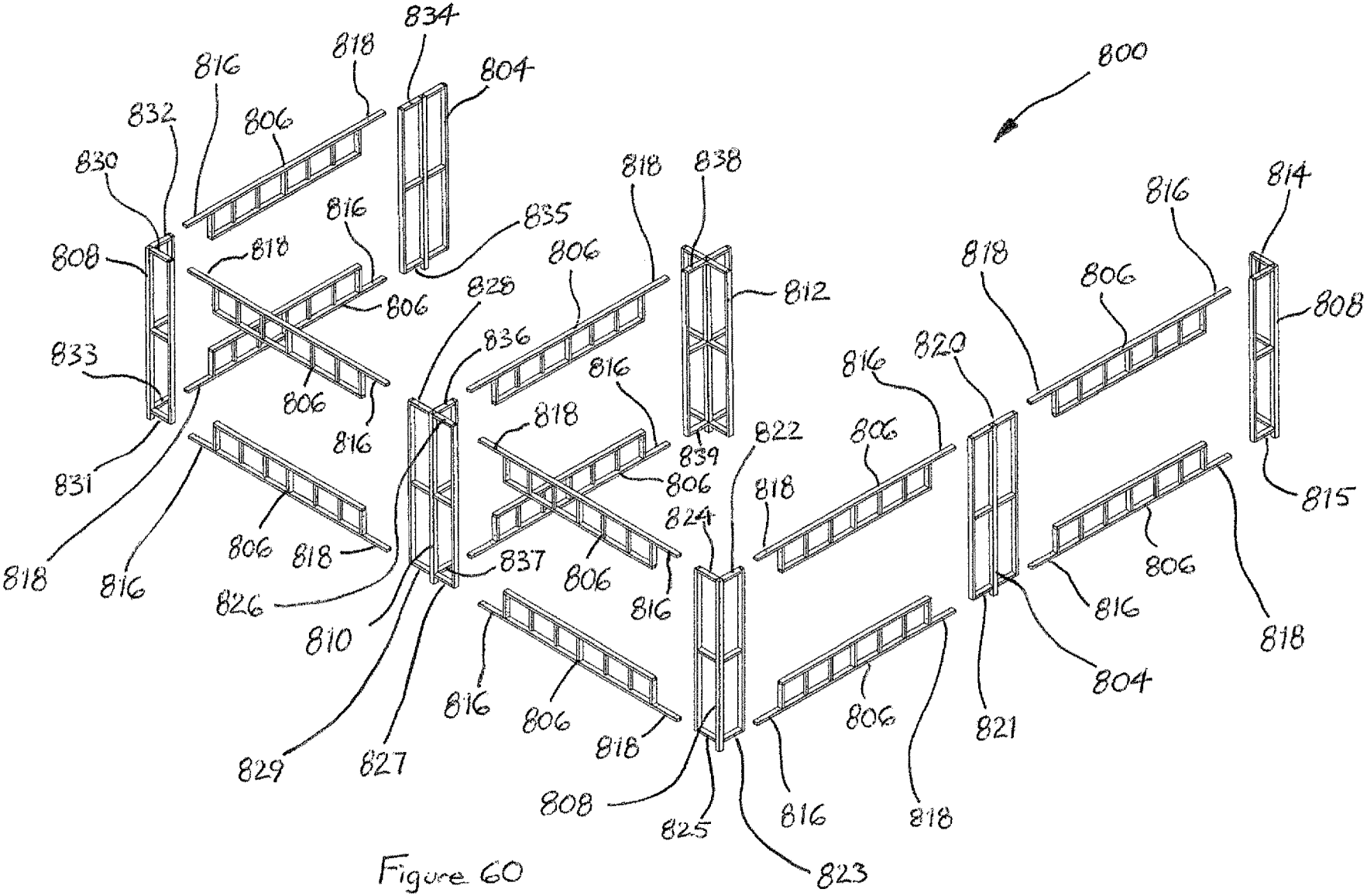
FIG. 60 is a perspective view of a plurality of sub-frames located separately from each other and shown prior to being interconnected to form the multi-room wall frame shown in FIG. 59.

FIGS. 59 and 60 show a multi-room wall frame 801 formed from a modular perimeter frame system 800 according to another embodiment of the present invention. The wall frame 801 is used in the construction of a wall of a building.

Unless otherwise stated, the structure and function of both the modular perimeter frame system 800 and the multi-room wall frame 801 formed with that system are substantially similar to, or would be readily understood from a comparison with, the above described structure and function of the modular perimeter frame systems 10, 70, 100, 200, 300, 400, 500, 600, 700 and the frames 11, 72, 101, 202, 301, 401, 501, 601, 701, respectively, formed therewith.

As best shown in FIG. 60, the modular perimeter frame system 800 includes two wall stud sub-frames 804, twelve top hat sub-frames 806, three single corner sub-frames 808 (or L-section studs), one double corner sub-frame 810 (or T-section stud), and one quadruple corner sub-frame 812 (or +-section stud) which are preassembled before they arrive at the site of construction.

As shown in FIG. 59, a right-most single corner sub-frame 808 has its upper and lower blunt end portions 814, 815 connected perpendicularly to the adjacent overhang end portions 816, 818, respectively, of the upper and lower top hat sub-frames 806. The overhang end portions 818, 816 at the other end of these top hat sub-frames 806 are connected perpendicularly to the adjacent upper and lower blunt end portions 820, 821 of a wall stud sub-frame 804. The upper and lower blunt end portions 820, 821 of that sub-frame 804 are also connected perpendicularly to the adjacent overhang end portions 816, 818, respectively, of the upper and lower top hat sub-frames 806. The overhang end portions 818, 816 at the other end of these top hat sub-frames 806 are connected perpendicularly to the adjacent upper and lower blunt end portions 822, 823 of a single corner sub-frame 808.

The other (change of direction) upper and lower blunt end portions 824, 825 of that sub-frame 808 are also connected perpendicularly to the adjacent overhang end portions 816, 818, respectively, of the upper and lower top hat sub-frames 806. The overhang end portions 818, 816 at the other end of these top hat sub-frames 806 are connected perpendicularly to the adjacent upper and lower blunt end portions 826, 827 of a double corner sub-frame 810.

The other (continuous direction) upper and lower blunt end portions 828, 829 of that sub-frame 810 are also connected perpendicularly to the adjacent overhang end portions 816, 818, respectively, of the upper and lower top hat sub-frames 806. The overhang end portions 818, 816 at the other end of these top hat sub-frames 806 are connected perpendicularly to the adjacent upper and lower blunt end portions 830, 831 of a single corner sub-frame 808.

The other (change of direction) upper and lower blunt end portions 832, 833 of that left-most single corner sub-frame 808 are also connected perpendicularly to the adjacent overhang end portions 816, 818, respectively, of the upper and lower top hat sub-frames 806. The overhang end portions 818, 816 at the other end of these top hat sub-frames 806 are connected perpendicularly to the adjacent upper and lower blunt end portions 834, 835 of a wall stud sub-frame 804.

Returning to the double corner sub-frame 810, the other (change of direction) upper and lower blunt end portions 836, 837 of that sub-frame 810 are also connected perpendicularly to the adjacent overhang end portions of the upper and lower top hat sub-frames 806. The overhang end portions 818, 816 at the other end of these top hat sub-frames 806 are connected perpendicularly to the adjacent upper and lower blunt end portions 838, 839 of a quadruple corner sub-frame 812.

It will be readily apparent from the above that there are many advantages of the modular perimeter frame systems 10, 70, 100, 200, 300, 400, 500, 600, 700, 800, and still further advantages will be apparent to persons skilled in the art.

Floor frames, wall frames and roof frames formed from the modular perimeter frame system of the present invention may take many different shapes and sizes as may be required and feasible. For example, such frames may be square, rectangular, triangular, pentagonal, hexagonal, heptagonal, octagonal or even circular, or any combination of these shapes, provided that the interconnecting sub-frames of such assembled frames comprise a first sub-frame which has a blunt end portion and a second sub-frame which has an overhang end portion whereby the interconnection of the blunt end portion and the overhang end portion facilitates the strong and stable end to end connection of the sub-frames, either perpendicularly or non-perpendicularly.

It will also be readily apparent to persons skilled in the art that various other modifications may be made in details of design and construction of the embodiments of the frames and associated structural components which are formed from, or operably rely on, the modular perimeter frame system, and in the steps of assembling and using that system, without departing from the scope or ambit of the present invention.

For example, the piers which support a floor frame, and any ant capping that may protrude from those piers, remain entirely within the cantilevered confines of the perimeter frame. A new building constructed with the perimeter frame can, via the perimeter frame, abut an existing conventional building without the piers of the new building bearing on the outer footings of the existing building and without requiring the existing building to take any additional load. Furthermore, the piers of the new building and the perimeter frame they support will not disturb, or require the re-routing of, any service lines which run parallel with the outer footings of the existing building.

Also, the modular perimeter frame system makes feasible the construction of a building structure within another building structure in circumstances where, say, the floor and even the inner walls of a double walled (or brick veneer) building have been damaged through prolonged use, age, fire or termite attack. The old floor can be taken up and new piers can be installed, before bringing in the perimeter frame and completing the new internal building structure. In this way, the damaged building can be made safe and habitable without significant demolition work or impacting on other existing building structures. Also, previously unused or dilapidated buildings, such as garages and other outbuildings, may be converted in this way to granny flats or dry area storage sheds, and at the end of this new use, the new internal building structure (and especially the perimeter frame) can be removed and used again at a later opportunity.

Some general advantages arise from the fact that the modular perimeter frame system is self squaring when it is quickly and easily assembled with the use of prefabricated sub-frames. Disassembly is also quick and easy.

The modularity of the system also means that users can readily customize, say, with the quick and easy use of the link sub-frames, the size and even the configuration of the frame assembly and the structure it supports to suit their requirements.

As a frame system for supporting floors, it requires fewer piers or other ground supporting structures than, say, traditional timber floor frame constructions. For example, in a typical perimeter frame of the present invention with dimensions of 3.6 m×2.7 m, only four piers are required to provide the necessary support, whereas traditional timber floor frame constructions having the same dimensions may require up to nine supporting piers.

Additional uses or applications of the modular perimeter frame system are in the fields of landscaping, above ground pool surround decks, temporary accommodation, stages and boardwalks, pontoons and wharfs, film and stage sets, scaffolding and hoardings, building foundations and formwork, and shop fitting structures.

The reference in this specification to any prior use or publication (or information derived from it), or to any matter which is known, is not, and should not be taken as, an acknowledgement or admission or any form of suggestion that that prior use or publication (or information derived from it) or known matter forms part of the common general knowledge in the field of endeavour to which this specification relates before the filing date of this patent application.

The invention claimed is:

1. A perimeter frame used in a construction of floors, walls or roofs of buildings, comprising:

(a) a pair of first modular sub-frames being symmetrically opposite each other across a first axis, each of the first modular sub-frames having a blunt end portion, the blunt end portion formed at one or both ends of the first modular sub-frame which has a pair of parallel, spaced apart, linear beam members interconnected by one or more cross-beam members, the linear beam members being symmetrically opposite each other at the, or each, blunt end portion, (b) a pair of second modular sub-frames being symmetrically opposite each other across a second axis perpendicular to the first axis, each of the second modular sub-frames having an overhang end portion, the overhang end portion formed at one or both ends of the second modular sub-frame which has a pair of parallel, spaced apart, linear beam members interconnected by one or more cross-beam members, a first of the linear beam members having a length which extends further at the, or each, overhang end portion than a length of a second of the linear beam members to form a linear extension of the first linear beam member at the, or each, overhang end portion, wherein the linear extension has a length which is substantially equal to a distance separating the linear beam members of the first modular sub-frame, wherein the linear beam members of the first and second modular sub-frames are perpendicularly interconnected at respective end portions of the first and second modular sub-frames, and wherein each of the symmetrically opposite first modular sub-frames has an internal linear beam member located along an internal perimeter of the perimeter frame, and each of the symmetrically opposite second modular sub-frames has an internal linear beam member located along the internal perimeter of the perimeter frame, and the internal linear beam members of the first modular sub-frames are spaced apart from each other by a distance equal to a length of the internal linear beam members of the second modular sub-frame.

2. The perimeter frame of claim 1 further comprising any one or more of:

(a) a chair sub-frame, (b) a corner link sub-frame, and (c) an offset sub-frame, a blunt end portion at an end of a ladder sub-frame, or at an end of a corner link sub-frame, or at an end of a first chair sub-frame, being perpendicularly connected to an overhang end portion at an end of a top hat sub-frame, or at an end of a second chair sub-frame, or at an end of an offset sub-frame, to define a corner of an irregular shape perimeter frame.

3. The perimeter frame of claim 1 further comprising a bridging twin sub-frame.

4. The perimeter frame of claim 1 wherein each of the first modular sub-frames comprises a ladder sub-frame and each of the second modular sub-frames comprises a top hat sub-frame.

5. The perimeter frame of claim 1 wherein the pair of the first modular sub-frames comprises a pair of ladder sub-frames and the pair of the second modular sub-frames comprises a pair of top hat sub-frames, each of the ladder sub-frames having a pair of parallel, spaced apart, ladder beam members interconnected by one or more ladder cross-beam members, the ladder beam members being symmetrically opposite each other, thereby forming a blunt end portion at each opposite end of the ladder sub-frame, a first of the ladder beam members being adapted to be located along an external perimeter of the perimeter frame and a second of the ladder beam members being adapted to be located along an internal perimeter of the perimeter frame, each of the top hat sub-frames having a pair of parallel, spaced apart, top hat beam members interconnected by one or more top hat cross-beam members, the top hat beam members being of a different length to each other and being symmetrically opposite each other, such that a first of the top hat beam members has opposite ends and has a length which extends further at each of the opposite ends of the first top hat beam member than a length of a second of the top hat beam members to form a linear extension of the first top hat beam member at each of the opposite ends, thereby forming an overhang end portion at each opposite end of the top hat sub-frame, the first of the top hat beam members being adapted to be located along an external perimeter of the perimeter frame and the second of the top hat beam members being adapted to be located along an internal perimeter of the perimeter frame, wherein the linear extension has a length which is substantially equal to a distance separating the first and second of the ladder beam members, the pair of the ladder sub-frames being symmetrically opposite each other across the first axis, with the first of the ladder beam members of each ladder sub-frame being outermost, the pair of the top hat sub-frames being symmetrically opposite each other across the second axis perpendicular to the first axis, with the first of the top hat beam members of each top hat sub-frame being outermost, and the ladder and top hat sub-frames being perpendicularly interconnected at respective end portions of the ladder and top hat sub-frames.

6. The perimeter frame of claim 5 further comprising any one or more of:

(a) a ladder link sub-frame, and (b) a top hat link sub-frame, the ladder sub-frame and the top hat sub-frame being perpendicularly interconnected at respective end portions of the ladder and top hat sub-frames to define a corner of the perimeter frame, the corner having opposite free ends, and at least one of the ladder link sub-frame or the top hat link sub-frame being longitudinally connected to a selected one of the opposite free ends of the corner, wherein the ladder link sub-frame is longitudinally connected between respective blunt end portions of a pair of the ladder sub-frames, and the top hat link sub-frame is longitudinally connected between respective overhang end portions of a pair of the top hat sub-frames, to form an enlarged perimeter frame.

7. The perimeter frame of claim 6 wherein the ladder link sub-frame has a peg end portion at each opposite end thereof, and the top hat link sub-frame has an offset end portion at each opposite end thereof, and wherein each peg end portion is securably engageable within an adjacent blunt end portion of a ladder sub-frame and each offset end portion is securably engageable alongside an adjacent overhang end portion of a top hat sub-frame.

8. The perimeter frame of claim 5 wherein the second of the ladder beam members is an internal ladder beam member of the ladder sub-frame and has opposite ends which are separated by a length which is shorter than the length separating opposite ends of the first of the ladder beam members which is an external ladder beam member of the ladder sub-frame, the shorter length being substantially equal to a width of the overhang end portion of the top hat sub-frame.

9. The perimeter frame of claim 8 wherein the external ladder beam member has opposite ends and includes a corner socket at each of the opposite ends for receiving therethrough a corner post for supporting a wall.

* * * * *